US006610949B2

(12) United States Patent
Mori et al.

(10) Patent No.: US 6,610,949 B2
(45) Date of Patent: Aug. 26, 2003

(54) SWITCHGEAR OPERATING APPARATUSES

(75) Inventors: Tomohito Mori, Tokyo (JP); Kyoichi Ohtsuka, Tokyo (JP); Nobuya Nakajima, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 35 days.

(21) Appl. No.: 10/046,818

(22) Filed: Jan. 17, 2002

(65) Prior Publication Data

US 2003/0034242 A1 Feb. 20, 2003

(30) Foreign Application Priority Data

Aug. 20, 2001 (JP) ..... P2001-248465

(51) Int. Cl.[7] ..... H01H 5/00
(52) U.S. Cl. ..... 200/400
(58) Field of Search ..... 200/17 R, 400, 200/401, 500, 501, 318, 320, 323, 324–326; 218/84, 154

(56) References Cited

U.S. PATENT DOCUMENTS 4,839,476 A 6/1989 Okuno ..... 200/17 R
5,541,378 A * 7/1996 Niklaus ..... 200/400
6,072,136 A * 6/2000 Wehrli et al. ..... 200/401
6,232,569 B1 5/2001 Nakajima et al. ..... 200/400
6,316,739 B1 11/2001 Ohtsuka et al. ..... 200/400
6,348,847 B1 * 2/2002 Nakajima et al. ..... 335/195
6,437,269 B1 * 8/2002 Rakus ..... 200/400
6,444,934 B1 * 9/2002 Imura et al. ..... 200/400

* cited by examiner

*Primary Examiner*—Michael A Friedhofer
(74) *Attorney, Agent, or Firm*—Sughrue Mion, PLLC

(57) ABSTRACT

A compact, lightweight and low-cost operating apparatus for a switchgear include a second cam (50) turned counterclockwise by an electric motor begins to maintain contact with a closing lever (37) at a first angular position (POS1), turns the closing lever (37) counterclockwise to energize a circuit-making coil spring (77), and causes a closing latch (48) to lock the closing lever (37). The second cam (50) further turning counterclockwise becomes separated from the closing lever (37) and actuates a cam switch (156) at a second angular position (POS2) to interrupt an electric current supplied to the electric motor. The second cam (50) further turns due to inertial turning of the electric motor and is braked by a elastic brake member (159) at a third angular position (POS3), whereby the second cam (50) stops within a specific angular range $\Delta\theta$ of rotation. Despite its simple structure, the elastic brake member (159) can halt the second cam (50) in a reliable fashion.

13 Claims, 39 Drawing Sheets

"PRIOR ART"

"PRIOR ART"

"PRIOR ART"

"PRIOR ART"

"PRIOR ART"

"PRIOR ART"

"PRIOR ART"

"PRIOR ART"

SWITCHGEAR OPERATING APPARATUSES

BACKGROUND OF THE INVENTION AND RELATED ART STATEMENT

The present invention relates to an improvement of operating apparatuses for switchgears like circuit breakers used as electric power switching devices installed in an electric power substation or in a switching station, for example.

A conventionally available operating apparatus for a circuit breaker, which is a typical example of switchgears, utilizes an elastic force exerted by a spring as an operating force. FIGS. 32–35 show a conventional operating apparatus for a circuit breaker disclosed in Japanese Laid-open Patent Publication No. 63-304542, in which FIG. 32 is a perspective view generally showing the construction of the operating apparatus for the circuit breaker, and FIG. 33 is a constructional diagram of the operating apparatus for the circuit breaker of FIG. 32 showing a state in which the circuit breaker is closed and torsion bars 29, 35, 28, 34 for making and breaking a circuit are all energized (caused to store elastic restoring energy by twisting).

FIG. 34 is a constructional diagram of the operating apparatus for the circuit breaker of FIG. 32 showing a state in which the circuit breaker is opened, the circuit-breaking torsion bars 28, 34 are deenergized (caused to release elastic restoring energy by restoring the original shape), and the circuit-making torsion bars 29, 35 are energized. FIG. 35 is a constructional diagram of the operating apparatus for the circuit breaker of FIG. 32 showing a state in which the circuit breaker is closed, the circuit-breaking torsion bars 28, 34 are energized and the circuit-making torsion bars 29, 35 are deenergized.

In these Figures, designated by the numeral 1 is a housing, designated by the numeral 24 is cylindrical body fixed to the housing 1, and designated by the numerals 26 and 27 are rotatable levers fitted to pins (not shown) provided on an end surface of the cylindrical body 24. Since the circuit-breaking torsion bars 28, 34 are energized when the circuit-making torsion bars 29, 35 are deenergized, the amount of energy stored in the circuit-making torsion bars 29, 35 is made larger than the amount of energy stored in the circuit-breaking torsion bars 28, 34. One end of the circuit-breaking torsion bar 28 is fixed to the housing 1 while the other end of the circuit-breaking torsion bar 28 is fixed to the lever 26. Also, one end of the circuit-breaking torsion bar 34 is fixed to a rotary shaft 32 while the other end of the circuit-breaking torsion bar 34 is fixed to the lever 26 as shown in FIG. 32.

On the other hand, one end of the circuit-making torsion bar 29 is fixed to the housing 1 while the other end of the circuit-making torsion bar 29 is fixed to the lever 27. Also, one end of the circuit-making torsion bar 35 is fixed to a rotary shaft 33 while the other end of the circuit-making torsion bar 35 is fixed to the lever 27 as shown in FIG. 32. Referring to FIG. 33, designated by the numeral 37 is a closing lever fixed to the rotary shaft 33. A counterclockwise turning force is exerted on the closing lever 37 by the circuit-making torsion bars 29, 35 through the rotary shaft 33. It is to be noted that the direction of rotation, as well as horizontal and vertical directions, is expressed as they appear in the relevant Figures unless otherwise mentioned in the following discussion.

Referring again to FIG. 33, designated by the numeral 2 is a cam shaft rotatably supported by the housing 1, designated by the numeral 3 is a cam which is fixed to the cam shaft 2 and rotates together with the cam shaft 2, designated by the numeral 13 is a pin provided on the cam 3, and designated by the numeral 14 is a closing latch engaged with the pin 13. Further, designated by the numeral 15 is a closing trigger meshed with the closing latch 14, and designated by the numeral 16 is a closing electromagnet having a plunger 17. Designated by the numeral 38 is a rotary shaft which is rotatably supported by the housing 1 and turned counterclockwise by an electric motor (not shown), designated by the numeral 39 is a small gear wheel which is fixedly mounted on the rotary shaft 38, and designated by the numeral 40 is a large gear wheel which is fixedly mounted on the cam shaft 2 and engaged with the small gear wheel 39. The large gear wheel 40 lacks teeth on one part of its periphery such that the large gear wheel 40 becomes disengaged from the small gear wheel 39 when the circuit-making torsion bars 29, 35 are energized.

In FIG. 33, designated by the numeral 41 is a link which connects the closing lever 37 and the large gear wheel 40 to each other via pins provided on the closing lever 37 and the large gear wheel 40. Designated by the numeral 36 is an interrupting lever fixedly mounted on the rotary shaft 32 on which a counterclockwise turning force is exerted by the circuit-breaking torsion bars 28, 34 via the rotary shaft 32. Designated by the numeral 8 is a pin provided on the interrupting lever 36, and designated by the numeral 9 is a rotary member provided on the interrupting lever 36. Designated by the numeral 18 is a tripping latch meshed with the pin 8, wherein a clockwise turning force is exerted on the tripping latch 18 by a spring 43.

Designated by the numeral 19 is a tripping trigger meshed with the tripping latch 18, and designated by the numeral 20 is a tripping electromagnet having a plunger 21. The plunger 21 is driven rightward as illustrated in FIG. 33 when the tripping electromagnet 20 is excited, and the plunger 21 is caused to return to its original position by a reset spring (not shown) when the tripping electromagnet 20 is deenergized. Designated by the numeral 10 is an on-off switch having a stationary contact 12 and a movable contact 22. The movable contact 22 is connected to the interrupting lever 36 via a link mechanism 23 and a rod 61. Designated by the numeral 42 is a shock absorber connected to the interrupting lever 36 to alleviate shocks occurring when the movable contact 22 goes into contact with and comes apart from the stationary contact 12.

Now, circuit-breaking and making operations of the aforementioned conventional operating apparatus for the circuit breaker are described, beginning with the circuit-breaking operation below.

Referring to FIG. 33, the interrupting lever 36 continuously receives the counterclockwise turning force exerted by the circuit-breaking torsion bars 28, 34, and this turning force is carried by the tripping trigger 19 via the tripping latch 18. If the tripping electromagnet 20 is excited in this condition, the plunger 21 moves rightward, causing the tripping trigger 19 to turn clockwise and become disengaged from the tripping latch 18. At this time, the tripping latch 18 is caused to turn counterclockwise by a reaction force exerted by the pin 8 and become released from the pin 8. When the tripping latch 18 and the pin 8 are disengaged, the interrupting lever 36 turns counterclockwise, causing the movable contact 22 to move in a circuit-breaking direction and become separated from the stationary contact 12. Shown in FIG. 34 is the state in which the above-described circuit-breaking operation has been completed.

The circuit-making operation from the state shown in FIG. 34 is carried out as described below. In FIG. 34, the cam 3 fixed to the cam shaft 2 is connected to the closing lever 37 via the cam shaft 2, the large gear wheel 40 fixed to the cam shaft 2 and the link 41, and a clockwise turning force is exerted on the cam 3 by the circuit-making torsion bars 29, 35. This turning force is carried by the closing trigger 15 via the closing latch 14.

If the closing electromagnet 16 is excited in this condition, the plunger 17 moves rightward and hits against the closing trigger 15, causing the closing trigger 15 to turn clockwise and become disengaged from the closing latch 14. At this time, the closing latch 14 is caused to turn counterclockwise by a reaction force exerted by the pin 13 and become released from the pin 13. When the closing latch 14 and the pin 13 are disengaged, the large gear wheel 40 and the cam 3, on which the clockwise turning force is exerted by the circuit-making torsion bars 29, 35, turn clockwise and push the rotary member 9 provided on the interrupting lever 36 upward, so that the interrupting lever 36 is caused to turn clockwise. As the interrupting lever 36 turns clockwise in this way, the circuit-breaking torsion bars 28, 34 are twisted and store elastic restoring energy. At the same time, the clockwise turn of the interrupting lever 36 causes the movable contact 22 to move in a circuit-making direction.

When the interrupting lever 36 turns clockwise by a specific angle, the tripping latch 18 meshes with the pin 8 and the tripping trigger 19 engages with the tripping latch 18. The cam 3 further turns clockwise while pushing against the interrupting lever 36 via the rotary member 9 until the tripping latch 18 and the pin 8, and the tripping trigger 19 and the tripping latch 18, engage with each other in a stable fashion. The cam 3 is eventually released from the rotary member 9 and goes into a position shown in FIG. 35. Shown in FIG. 35 is the state in which the above-described circuit-making operation has been completed, where the circuit-breaking torsion bars 28, 34 are energized, the pin 8 is locked by the tripping latch 18 and the circuit-making torsion bars 29, 35 are deenergized.

The circuit-making torsion bars 29, 35 are energized (caused to store elastic restoring energy by twisting) from the state shown in FIG. 35 in a manner described below. The circuit-making torsion bars 29, 35 are deenergized immediately upon completion of the aforementioned circuit-making operation as shown in FIG. 35. As the small gear wheel 39 is turned counterclockwise by the earlier-mentioned electric motor (not shown), the large gear wheel 40 turns clockwise. As a result, the closing lever 37 connected to the link 41 turns clockwise and the circuit-making torsion bars 29, 35 are energized (twisted) via the rotary shaft 33.

As the large gear wheel 40 turns clockwise, the direction of tensile load exerted on the link 41 approaches a dead point where the direction of the tensile load intersects the central axis of the cam shaft 2. When the direction of the tensile load just goes beyond this dead point, the large gear wheel 40, or the cam shaft 2, receives the clockwise turning force exerted by the circuit-making torsion bars 29, 35 via the link 41 and, at the same time, the small gear wheel 39 and the large gear wheel 40 are disengaged because the large gear wheel 40 lacks teeth on one part of its periphery. Therefore, even if the electric motor continues to run, the large gear wheel 40 remains stationary (without rotating) at a position where it is disengaged from the small gear wheel 39. Then, the pin 13 meshes with the closing latch 14 and the clockwise turning force exerted on the large gear wheel 40 due to twisting force of the circuit-making torsion bars 29, 35 is maintained, whereby storage of elastic restoring energy in the circuit-making torsion bars 29, 35 is completed. The conventional operating apparatus for the circuit breaker returns to the state shown in FIG. 33 in the aforementioned manner.

In the above-described conventional operating apparatus for the circuit breaker, the circuit-making torsion bars 29, 35 are energized (twisted) by the closing lever 37 and the link 41 connected to the large gear wheel 40. In this operating apparatus, torque to be produced by the electric motor for twisting the circuit-making torsion bars 29, 35 increases as the torsion bars 29, 35 approach their final energizing stage. For this reason, it is necessary that components of the electric motor and the operating apparatus, such as the large gear wheel 40, the link 41, the closing lever 37, have high strength. In addition, since the large gear wheel 40 is used as a crank with the link 41 connected to the large gear wheel 40, the large gear wheel 40 should have a large diameter.

To overcome the aforementioned problems, Japanese Laid-open Utility Model Publication No. 56-165319 discloses a different type of operating apparatus, in which a cam rotating with a large gear wheel is fixedly mounted on a rotary shaft of the large gear wheel, and a spring for making a circuit is energized by means of this cam. If the shape of the cam is properly designed, this operating apparatus makes it possible to avoid an increase in torque of an electric motor for driving the large gear wheel even at a final stage of energizing circuit-making torsion bars 29, 35 and achieve a reduction in size of an energizing mechanism.

This alternative arrangement of the prior art is now described in detail. FIGS. 36–39 show a conventional operating apparatus for a circuit breaker in which elastic restoring energy is stored by using the aforementioned type of cam. FIG. 36 is a perspective view generally showing the construction of the operating apparatus for the circuit breaker, FIG. 37 is a constructional diagram of the operating apparatus for the circuit breaker of FIG. 36 showing a state in which the circuit breaker is closed and torsion bars 29, 35, 28, 34 for making and breaking a circuit are all energized (caused to store elastic restoring energy by twisting), FIG. 38 is a constructional diagram of the operating apparatus for the circuit breaker of FIG. 36 showing a state in which the circuit breaker is opened, the circuit-breaking torsion bars 28, 34 are deenergized (caused to release elastic restoring energy by restoring the original shape), and the circuit-making torsion bars 29, 35 are energized, and FIG. 39 is a constructional diagram of the operating apparatus for the circuit breaker of FIG. 36 showing a state in which the circuit breaker is closed, the circuit-breaking torsion bars 28, 34 are energized and the circuit-making torsion bars 29, 35 are deenergized.

In these Figures, elements identical or equivalent to those shown in FIGS. 32–35 are designated by the same reference numerals and a description of such elements is omitted here. Compared to the construction of FIGS. 32–35, the circuit-making torsion bar 35 and a rotary shaft 33 are provided at different positions, although one end of the circuit-making torsion bar 35 is fixed to the rotary shaft 33 and the other end of the circuit-making torsion bar 35 is fixed to a lever 27 in similar fashion (FIG. 32). The circuit-making torsion bars 29, 35 exerts a clockwise turning force (as illustrated in FIG. 37) on a closing lever 37 which is fixedly mounted on the rotary shaft 33. While the counterclockwise turning force is exerted on the closing lever 37 in FIG. 32, the clockwise turning force is exerted on the closing lever 37 in FIG. 37. Although the direction of the turning force differs from each other, the same operational and working effects are obtained.

In FIGS. 36–39, designated by the numeral 2 is a cam shaft rotatably supported by a housing 1, designated by the numeral 3 is the aforementioned cam which is fixed to the cam shaft 2, designated by the numeral 5 is a pin provided on the cam 3, designated by the numeral 6 is a pin provided on the closing lever 37, and designated by the numeral 41 is a link. The closing lever 37 and the cam 3 are connected to the link 41 via the pins 5, 6. Designated by the numeral 7 is a second rotary member mounted on a common axis with the pin 6. Twisting force of the circuit-making torsion bars 29, 35 is transmitted to the cam 3 via the rotary shaft 33, the closing lever 37, the pin 6, the link 41 and the pin 5. Designated by the numeral 25 is a rotary shaft for rotatably supporting a closing trigger 15, designated by the numeral 98 is a rotary shaft for rotatably supporting a tripping trigger 19, and designated by the numeral 75 is a rotary shaft for rotatably supporting a tripping latch 18. These rotary shafts 25, 75, 98 are not assigned any reference numerals in the earlier-described conventional operating apparatus of FIG. 32.

Designated by the numeral 4 is a rotary shaft rotatably supported by the housing 1, and designated by the numeral 48 is a closing latch which is supported by the rotary shaft 4 in such a manner that it can rotate independently of the rotary shaft 4. The closing latch 48 continuously receives a counterclockwise turning force exerted by a spring (not shown) and engages with the pin 6. Designated by the numeral 49 is a pin provided on the closing latch 48. The closing latch 48 is locked by the closing trigger 15 via the pin 49. Designated by the numeral 45 is a small gear wheel which is rotatably supported by the housing 1 and rotated by an electric motor (not shown), and designated by the numeral 46 is a large gear wheel fixedly mounted on the rotary shaft 4. The large gear wheel 46 is engaged with the small gear wheel 45 and turned thereby.

Since maximum load required for storing elastic restoring energy in, or twisting, the circuit-making torsion bars 29, 35 is small for reasons described later, the diameters of the small gear wheel 45 and the large gear wheel 46 may be smaller than the small gear wheel 39 and the large gear wheel 40 of the conventional operating apparatus of FIG. 33, respectively. Designated by the numeral 50 is a second cam which is fixedly mounted on the rotary shaft 4 and rotates together with the large gear wheel 46. The small gear wheel 45, the large gear wheel 46, the second cam 50, the second rotary member 7, the closing lever 37, the closing latch 48, the closing trigger 15, a closing electromagnet 16 and a plunger 17 together constitute an energizing mechanism 30.

Now, circuit-breaking and making operations of this conventional operating apparatus for the circuit breaker are described, beginning with the circuit-breaking operation below.

Referring to FIG. 37, an interrupting lever 36 continuously receives a counterclockwise turning force exerted by the circuit-breaking torsion bars 28, 34, and this turning force is carried by the tripping trigger 19 via the tripping latch 18. If a tripping electromagnet 20 is excited in this condition, a plunger 21 moves rightward, causing the tripping trigger 19 to turn clockwise about the rotary shaft 98 and become disengaged from the tripping latch 18. At this time, the tripping latch 18 is caused to turn counterclockwise by a reaction force exerted by a pin 8 provided on the interrupting lever 36 and become released from the pin 8. When the tripping latch 18 and the pin 8 are disengaged, the interrupting lever 36 turns counterclockwise, causing a movable contact 22 of an on-off switch 10 to move in a circuit-breaking direction and become separated from its stationary contact 12. Shown in FIG. 38 is the state in which the above-described circuit-breaking operation has been completed.

The circuit-making operation from the state shown in FIG. 38 is carried out as described below. In FIG. 38, the cam 3 is connected to the closing lever 37 via the link 41, and the circuit-making torsion bars 29, 35 exerts a clockwise turning force on the closing lever 37 via the rotary shaft 33. This turning force is carried by the closing trigger 15 via the closing latch 48. If the closing electromagnet 16 is excited in this condition, the plunger 17 moves upward and hits against the closing trigger 15, causing the closing trigger 15 to turn counterclockwise about the rotary shaft 25. When the closing trigger 15 turns counterclockwise in this fashion, the closing latch 48 is caused to turn clockwise by a reaction force exerted by the pin 49 and become released from the pin 6.

When the pin 6 is released from the closing latch 48, the closing lever 37 turns clockwise and the cam 3 connected to the closing lever 37 via the link 41 turns clockwise about the cam shaft 2, thereby pushing a rotary member 9 provided on the interrupting lever 36 upward. This causes the interrupting lever 36 to turn clockwise and, as a consequence, the circuit-breaking torsion bars 28, 34 are twisted and store elastic restoring energy. At the same time, the clockwise turn of the interrupting lever 36 causes the movable contact 22 to move in a circuit-making direction. When the interrupting lever 36 turns clockwise by a specific angle, the tripping latch 18 meshes with the pin 8 and the tripping trigger 19 engages with the tripping latch 18.

The cam 3 further turns clockwise while pushing against the interrupting lever 36 via the rotary member 9 until the tripping latch 18 and the pin 8, and the tripping trigger 19 and the tripping latch 18, engage with each other in a stable fashion. The cam 3 eventually comes off the rotary member 9 and goes into a position shown in FIG. 39. Shown in FIG. 39 is the state in which the above-described circuit-making operation has been completed, where the circuit-breaking torsion bars 28, 34 are energized and the circuit-making torsion bars 29, 35 are deenergized.

In this operating apparatus for the circuit breaker, there are two cases in the circuit-breaking operation. These are a case where the circuit breaker breaks the circuit from the state shown in FIG. 39, and a case where the circuit breaker rebreaks the circuit immediately upon completion of the circuit-making operation. This circuit-rebreaking operation is performed as follows. If a circuit-rebreaking command is received when the circuit-making torsion bars 29, 35 have not been energized yet after deenergizing, the tripping electromagnet 20 is actuated and, as a consequence, the circuit-breaking torsion bars 28, 34 are deenergized and the on-off switch 10 is opened. At this point, the circuit breaker is opened, and the circuit-making torsion bars 29, 35 and the circuit-breaking torsion bars 28, 34 are all deenergized.

Storage of elastic restoring energy in the circuit-making torsion bars 29, 35 is performed as follows. Immediately upon completion of the circuit-making operation, the closing lever 37 is in a position rotated clockwise as shown in FIG. 39 from the state of FIG. 37, and the circuit-making torsion bars 29, 35 are deenergized. The circuit-making torsion bars 29, 35 are energized from the state shown in FIG. 39, for example. When the electric motor is run, the small gear wheel 45 turns clockwise and the large gear wheel 46 meshed with the small gear wheel 45 turns counterclockwise. Thus, the second cam 50 fixed to the large gear wheel 46 also turns counterclockwise.

When the second cam 50 reaches a specific position after turning counterclockwise, the second cam 50 comes into contact with the second rotary member 7 which is provided on the closing lever 37 and further turns counterclockwise, causing the closing lever 37 and the rotary shaft 33 to rotate counterclockwise. As a result of this counterclockwise rotation of the closing lever 37, the circuit-making torsion bars 29, 35 are twisted, or energized, via the rotary shaft 33.

Pushed by the second cam 50, the closing lever 37 further turns counterclockwise. When the closing lever 37 reaches a point slightly beyond its locking position with the closing latch 48, the second cam 50 separates from the second rotary member 7. When the second cam 50 has separated from the closing lever 37 (second rotary member 7), the closing lever 37 reversely turns clockwise due to the turning force exerted by the circuit-making torsion bars 29, 35 and is locked by the closing latch 48 via the pin 6 at the aforementioned locking position. At the same time, the closing trigger 15 meshes with the pin 49 provided on the closing latch 48. Consequently, the clockwise turning force exerted on the closing lever 37 by the circuit-making torsion bars 29, 35 is sustained by the closing latch 48 and the closing trigger 15, and storage of elastic restoring energy in the circuit-making torsion bars 29, 35 is finished at this point.

At the point where the circuit-making torsion bars 29, 35 have been energized and the closing lever 37 has reached the locking position with the closing latch 48, the closing lever 37 is actuated by pressing an unillustrated lever switch to open the circuit, and power supply to the electric motor is interrupted. The electric motor continues to turn counterclockwise for a while due to inertia and stops while the second cam 50 also continues to turn counterclockwise for a while and stops. Under conditions in which the closing lever 37 has been locked by the closing latch 48, the aforementioned unillustrated lever switch maintains an open-circuit state. The operating apparatus returns to the state shown in FIG. 37 in the above-described manner.

Since the second cam 50 is used to energize the circuit-making torsion bars 29, 35 by twisting them, the second cam 50 is properly shaped such that torques exerted on the electric motor and the large gear wheel 46 would not become too large even at a final stage of energizing the circuit-making torsion bars 29, 35. More specifically, the second cam 50 has a cam surface which produces a generally constant torque from the beginning to the final stage of energizing the circuit-making torsion bars 29, 35. This makes it possible to reduce the sizes of the electric motor, the small gear wheel 45 and the large gear wheel 46.

In the operating apparatus for the circuit breaker in which the second cam 50 is used for energizing the circuit-making torsion bars 29, 35 as described above, the second cam 50 overruns counterclockwise before it stops, due to inertial turning of the electric motor, after the circuit-making torsion bars 29, 35 have been energized and the power supply to the electric motor has been interrupted. The angle of overrun of the second cam 50 due to the inertial turning of the electric motor varies with the amount of frictional resistance, which is affected by such factors as the sizes of components of the energizing mechanism and the viscosity of lubricating oil. The frictional resistance also varies with temperature changes and the lapse of time. Therefore, the position where the second cam 50 stops is not definitely fixed. Rather, the second cam 50 is likely to stop before it reaches a specific angular range of rotation, or overrun that range.

If the second cam 50 stops before it reaches the specific angular range, that is, on the clockwise side of the desired stopping range, the closing lever 37 might hit against the second cam 50 when the closing lever 37 locked by the closing latch 48 is released for closing the on-off switch 10 and energizing the circuit-breaking torsion bars 28, 34. Should this happen, it is likely that the circuit-breaking operation is interrupted halfway. Also, an intense shock occurs when the closing lever 37 hits against the second cam 50.

As stated earlier, the power supply to the electric motor is interrupted by pressing unillustrated lever switch to open the circuit when the closing lever 37 has reached the locking position with the closing latch 48. To enable the closing lever 37 to engage with the closing latch 48, it is necessary to allow the closing lever 37 to overrun, or turn counterclockwise, slightly beyond its locking position with the aid of the inertia of the electric motor. If the amount of this overrun is too large, a correspondingly large amount of energy is required. Therefore, if the closing lever 37 is to be overrun with the aid of the inertia of the electric motor, it is necessary that the amount of overrun be sufficiently small so that the electric motor would not come to a halt halfway during its overrunning, and the individual components should be manufactured with high mechanical accuracy, resulting in an eventual cost increase.

Although it might be possible to employ an electric motor provided with a brake such that the second cam 50 can be stopped within the desired stopping range, this approach also results in a cost increase.

SUMMARY OF THE INVENTION

In view of the foregoing problems of the prior art, it is an object of the invention to provide a lightweight, low-cost operating apparatus for a switchgear.

According to the invention, an operating apparatus for a switchgear comprises an on-off switch driver including a rotatably mounted energizing lever linked to an on-off switch of the switchgear and an energy-storing device linked to the energizing lever, a retaining device including a locking lever, and an energizing mechanism including a cam turned by an electric motor in a specific direction, a current interrupter and a braking device, wherein the cam of the energizing mechanism turning in the specific direction begins to maintain contact with the energizing lever at a first angular position, turns the energizing lever in its energizing direction to energize the energy-storing device, causes the locking lever of the retaining device to lock the energizing lever such that the energizing lever remains in its energized condition without turning opposite to the energizing direction, and becomes separated from the energizing lever by further turning in the specific direction, the current interrupter is actuated and interrupts an electric current supplied to the electric motor when the cam reaches a second angular position after turning by a first specific angle from the first angular position, and the braking device brakes the cam when the cam reaches a third angular position after turning by a second specific angle from the second angular position due to inertial turning of the electric motor, whereby the cam stops within a specific angular range of rotation.

As the cam is forcibly braked by the braking device in this operating apparatus, it is possible to decrease variations in the amount of overrun of the cam, which could occur due to variations in the amount of frictional resistance caused by temperature changes or property changes with the lapse of time, and halt the cam such that the orientation of the cam falls within the specific angular range of rotation. This makes it possible to prevent shocks which could occur if the energizing lever collides with the cam when the energy-storing device is deenergized and the energizing lever turns opposite to its energizing direction. This serves to make the operating apparatus compact and inexpensive.

Furthermore, since the cam is braked by the braking device when the electric motor is in its final stage of inertial turning and its inertial energy has declined, energy required for braking is small and, therefore, the braking device may be of a simple structure. This also serves to make the operating apparatus compact and inexpensive.

In one aspect of the invention, the retaining device further includes an energizing lever deactivator which prohibits the locking lever from unlocking the energizing lever when the orientation of the cam is out of the specific angular range of rotation.

Since the energizing lever deactivator prohibits the locking lever from unlocking the energizing lever when the orientation of the cam is out of the specific angular range of rotation in this construction, it is possible to prevent an intense shock which could occur when the energizing lever released from the locking lever turns in its deenergizing direction and hits against the cam.

In another aspect of the invention, the energizing mechanism further includes an electric motor deactivator which prohibits the electric motor from operating when the energizing lever is locked by the locking lever.

Since the energy-storing device is already energized when the energizing lever is locked by the locking lever in this construction, the electric motor is kept from unnecessarily executing energizing operation.

In another aspect of the invention, the retaining device further includes an energizing lever deactivator which prohibits the locking lever from unlocking the energizing lever when the orientation of the cam is out of the specific angular range of rotation, and the energizing mechanism further includes an electric motor deactivator which prohibits the electric motor from operating when the energizing lever is locked by the locking lever.

Since the energizing lever deactivator prohibits the locking lever from unlocking the energizing lever when the orientation of the cam is out of the specific angular range of rotation in this construction, it is possible to prevent an intense shock which could occur when the energizing lever released from the locking lever turns in its deenergizing direction and hits against the cam.

Also, since the energy-storing device is already energized when the energizing lever is locked by the locking lever, the electric motor is kept from unnecessarily executing energizing operation.

In another aspect of the invention, the locking lever is rotatably mounted and maintains the energizing lever in its energized condition when locked by a rotatably mounted closing trigger, the energizing lever is unlocked when the locking lever locked by the closing trigger is released by turning the closing trigger by a swingable member swingably connected to a plunger of an electromagnet, and the energizing lever deactivator includes an operating member which causes the swingable member to swing when pushed by the cam and thereby prevents the closing trigger from turning even when the plunger moves.

In this construction, the swingable member is caused to swing by pushing the operating member with the cam such that the closing trigger is not turned even if the plunger moves when the orientation of the cam is out of the specific angular range of rotation. This makes it possible to prevent an intense shock which could occur when the energizing lever released from the locking lever turns in its deenergizing direction and hits against the cam.

In another aspect of the invention, the electric motor deactivator is a lever switch operated by the energizing lever when the energizing lever is locked by the locking lever.

This makes it possible to cut power supply to the electric motor by means of a simple and low-cost lever switch.

In another aspect of the invention, the braking device is an elastic member having a specific elasticity which elastically deforms and slides over the cam to brake it when the rotating cam reaches the third angular position and pushes the braking device.

By use of the elastic member, it is possible to simplify the construction of the operating apparatus and make it compact and inexpensive.

In another aspect of the invention, the braking device is a leverlike member joined to the energizing lever, wherein the leverlike member is located at a position where it can go into contact with the cam and brake it when the rotating cam reaches the third angular position while the energizing lever is locked by the locking lever, and the leverlike member is located at a position where it does not go into contact with the cam when the energizing lever is released from the locking lever.

In this construction, the energizing lever is released from the locking lever when energizing the energy-storing device. At this time, the leverlike member is located at the position where it does not go into contact with the cam such that the leverlike member does not exert any load on the cam during the energizing operation.

In still another aspect of the invention, the energizing lever of the on-off switch driver includes a first lever section which is connected to the energy-storing device and a second lever section which is connected to the first lever section and turned by the cam.

Since the second lever section is turned when energizing the energy-storing device, it is not necessary to provide the cam and the locking lever around the first lever section. This construction helps increase the degree of freedom of the design of the operating apparatus.

In yet another aspect of the invention, the energy-storing device is a torsion bar which is connected to the energizing lever and elastically deforms when twisted by the energizing lever.

It is possible to make an energy-storing device capable of achieving a high energy efficiency and free of stress concentration by use of a torsion bar.

In a further aspect of the invention, the energy-storing device is a coil spring which is connected to the energizing lever and elastically deforms when compressed or extended by the energizing lever.

This makes it possible to produce a compact energy-storing device.

In a still further aspect of the invention, the cam has a cam surface which produces a generally constant torque applied to the electric motor when the energy-storing device is energized by turning the energizing lever.

In this construction, it is possible to make the torque applied to the electric motor generally constant while the energy-storing device is being energized. As a result, it is possible to reduce maximum torques applied to components of the electric motor and the energizing mechanism.

In a yet further aspect of the invention, the switchgear is a circuit breaker.

The operating apparatus of the invention is suited for use with the circuit breaker.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

First Embodiment

Figure 1:
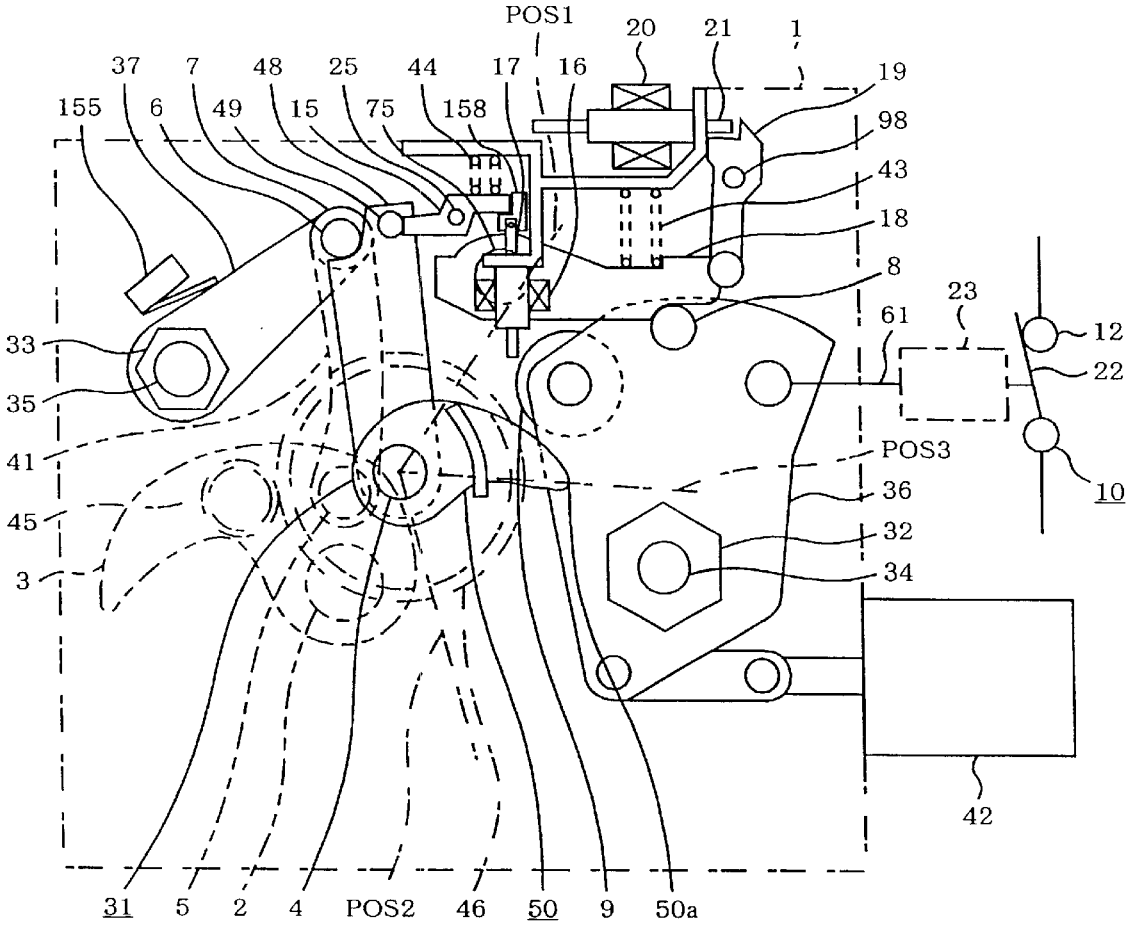
FIG. 1 is a constructional diagram of an operating apparatus for a circuit breaker according to a first embodiment of the invention showing a state in which the circuit breaker is closed, torsion bars for making and breaking a circuit are all energized, and a second cam of an energizing mechanism is stationary within a specific angular range of rotation.
Figure 2:
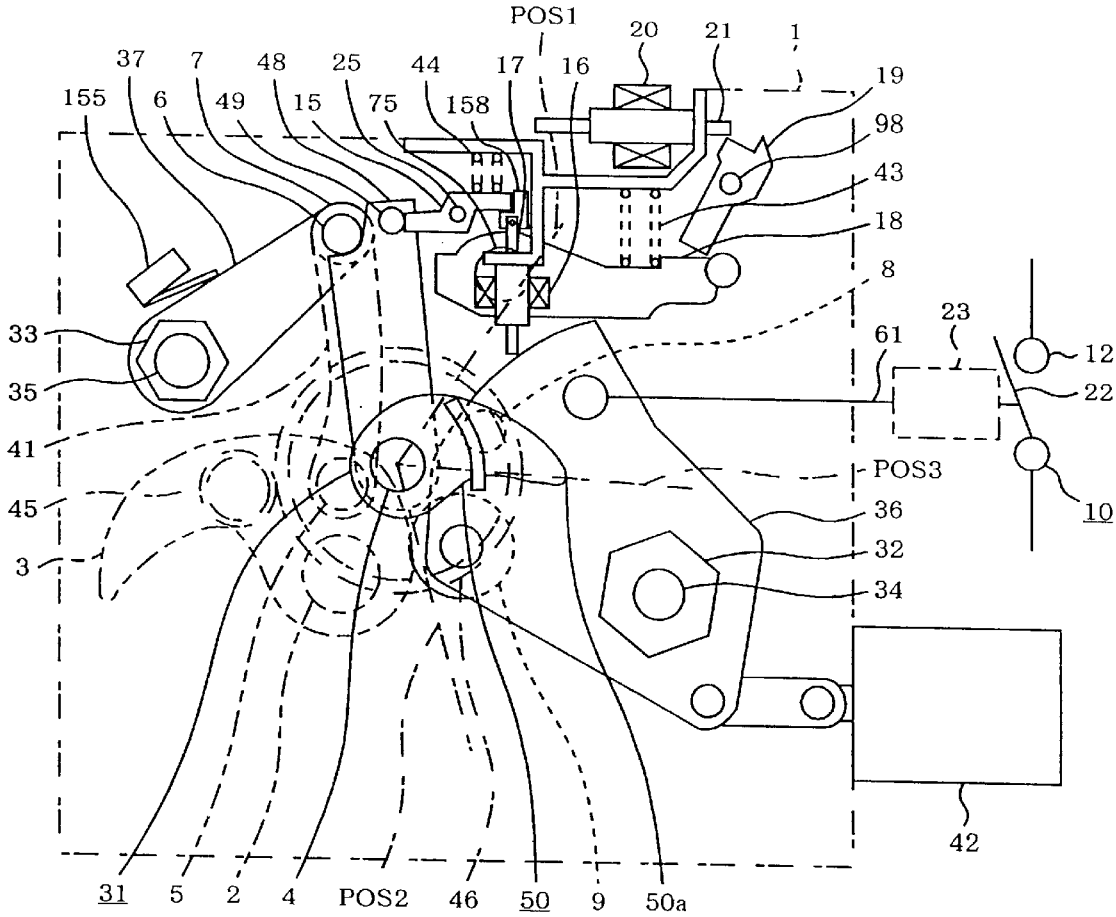
FIG. 2 is a constructional diagram of the operating apparatus for the circuit breaker of the first embodiment showing a state in which the circuit breaker is opened, the circuit-breaking torsion bars are deenergized, the circuit-making torsion bars are energized, and the second cam of the energizing mechanism is stationary within the specific angular range of rotation.

FIGS. 1–9 show an operating apparatus for a circuit breaker according to a first embodiment of the invention, in which FIG. 1 is a constructional diagram of the operating apparatus for the circuit breaker showing a state in which the circuit breaker is closed, torsion bars 29, 35, 28, 34 for making and breaking a circuit are all energized (caused to store elastic restoring energy by twisting), and a second cam 50 of an energizing mechanism 31 is stationary within a specific angular range $\Delta\theta$ of rotation, and FIG. 2 is a constructional diagram of the operating apparatus for the circuit breaker of the first embodiment showing a state in which the circuit breaker is opened, the circuit-breaking torsion bars 28, 34 are deenergized (caused to release elastic restoring energy by restoring the original shape), the circuit-making torsion bars 29, 35 are energized, and the second cam 50 of the energizing mechanism 31 is stationary within the specific angular range $\Delta\theta$ of rotation.

Figure 3:
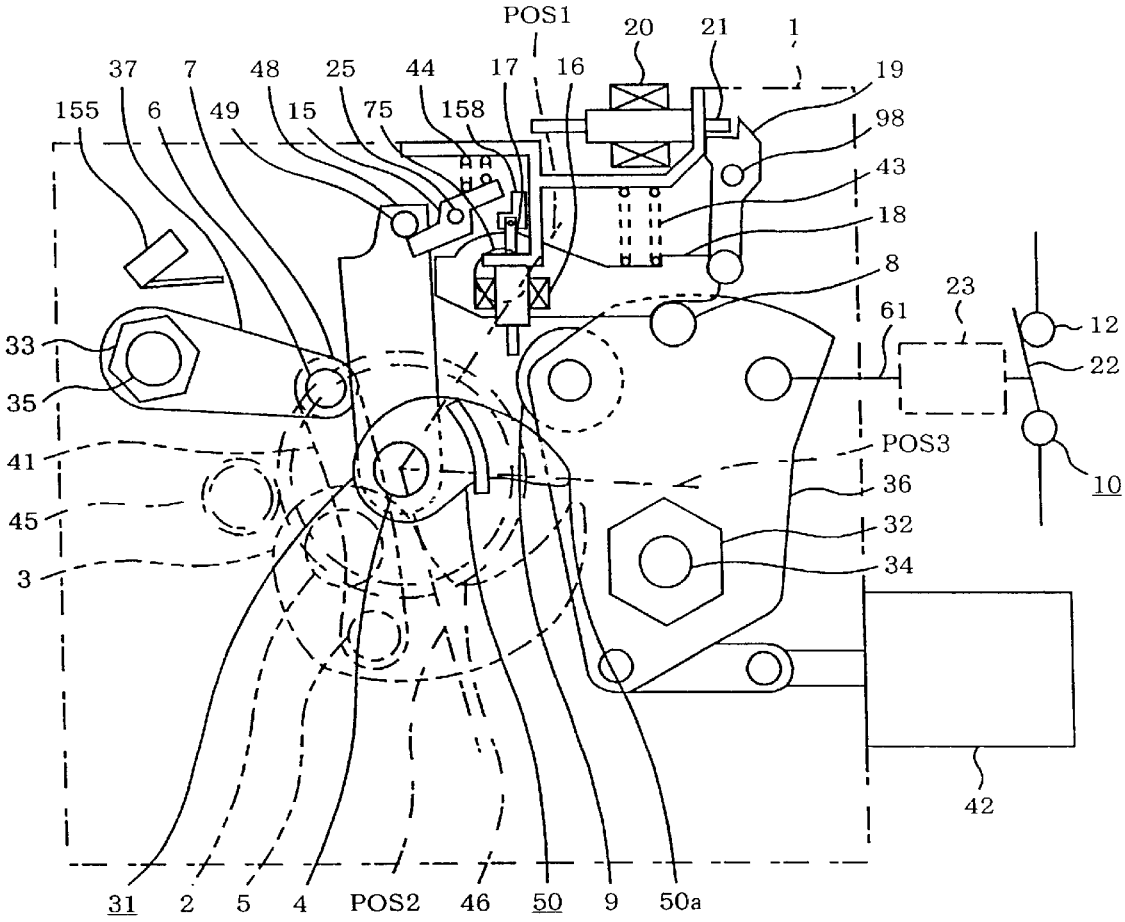
FIG. 3 is a constructional diagram of the operating apparatus for the circuit breaker of the first embodiment showing a state in which the circuit breaker is closed, the circuit-breaking torsion bars are energized, the circuit-making torsion bars are deenergized, a closing lever is stationary after turning clockwise, and the second cam of the energizing mechanism is stationary within the specific angular range of rotation.
Figure 4:
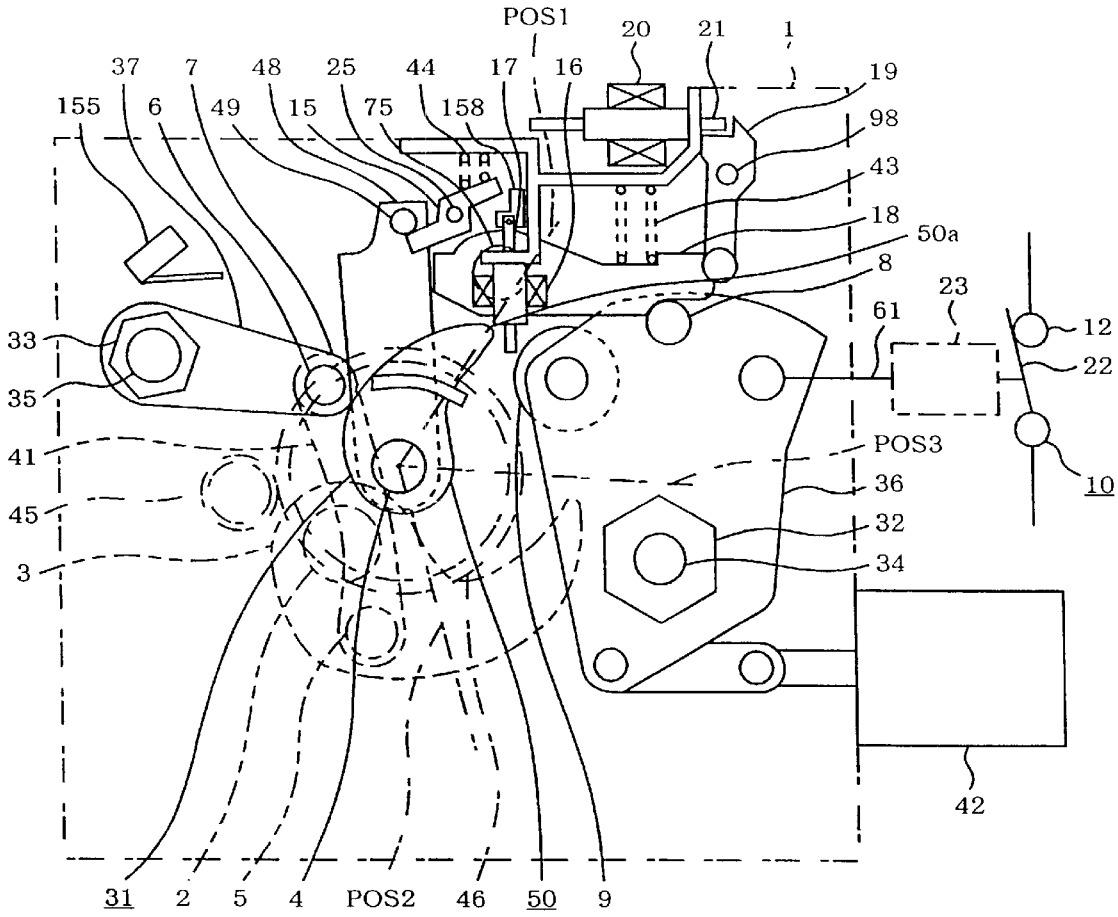
FIG. 4 is a constructional diagram of the operating apparatus for the circuit breaker of the first embodiment showing a state in which the circuit breaker is closed, the circuit-breaking torsion bars are energized, the circuit-making torsion bars have begun energizing operation from their deenergized condition, and the second cam of the energizing mechanism has come into contact with the closing lever.

FIG. 3 is a constructional diagram of the operating apparatus for the circuit breaker of the first embodiment showing a state in which the circuit breaker is closed, the circuit-breaking torsion bars 28, 34 are energized, the circuit-making torsion bars 29, 35 are deenergized, a closing lever 37 is stationary after turning clockwise, and the second cam 50 of the energizing mechanism 31 is stationary within the specific angular range $\Delta\theta$ of rotation. FIG. 4 is a constructional diagram of the operating apparatus for the circuit breaker of the first embodiment showing a state in which the circuit breaker is closed, the circuit-breaking torsion bars 28, 34 are energized, the circuit-making torsion bars 29, 35 have begun energizing operation (storage of elastic restoring energy) from their deenergized condition, and the second cam 50 of the energizing mechanism 31 has come into contact with the closing lever 37.

Figure 5:
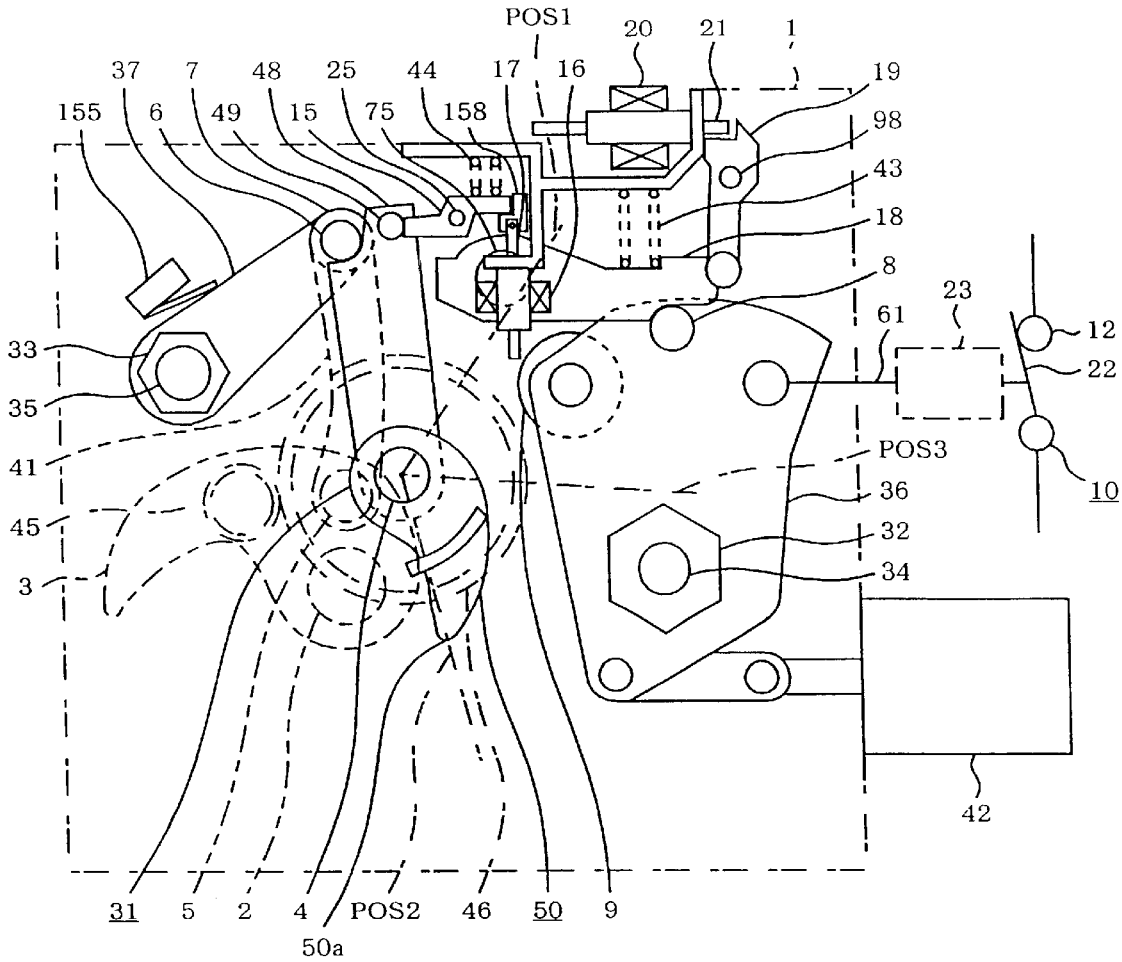
FIG. 5 is a constructional diagram of the operating apparatus for the circuit breaker of the first embodiment showing a state in which the circuit breaker is closed, the circuit-breaking torsion bars are energized, and the second cam has come into contact with a cam switch after the circuit-making torsion bars have been energized.
Figure 6:
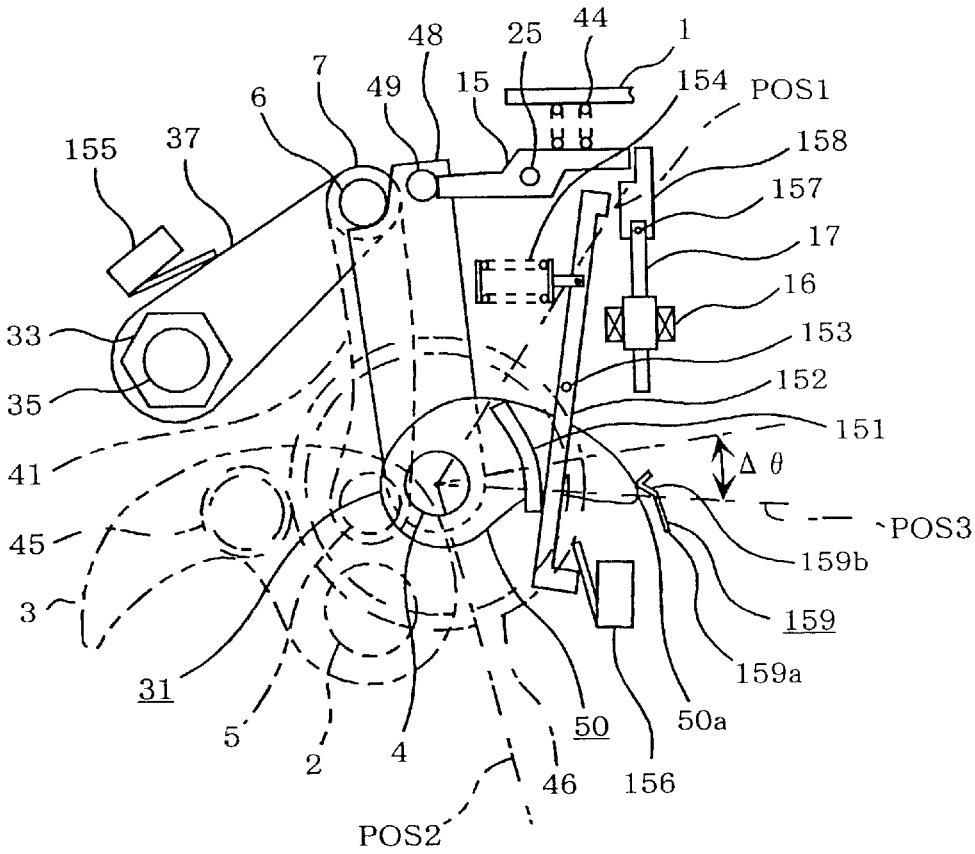
FIG. 6 is a constructional diagram of the energizing mechanism for energizing the circuit-making torsion bars of the first embodiment showing a state in which the circuit-making torsion bars are energized, and the second cam is stationary within the specific angular range of rotation.

FIG. 5 is a constructional diagram of the operating apparatus for the circuit breaker of the first embodiment showing a state in which the circuit breaker is closed, the circuit-breaking torsion bars 28, 34 are energized, and the second cam 50 has come into contact with a cam switch 156 (shown in FIG. 6) after the circuit-making torsion bars 29, 35 have been energized. FIG. 6 is a constructional diagram of the energizing mechanism 31 for energizing the circuit-making torsion bars 29, 35 of the first embodiment showing a state in which the circuit-making torsion bars 29, 35 are energized, and the second cam 50 is stationary within the specific angular range $\Delta\theta$ of rotation.

Figure 7:
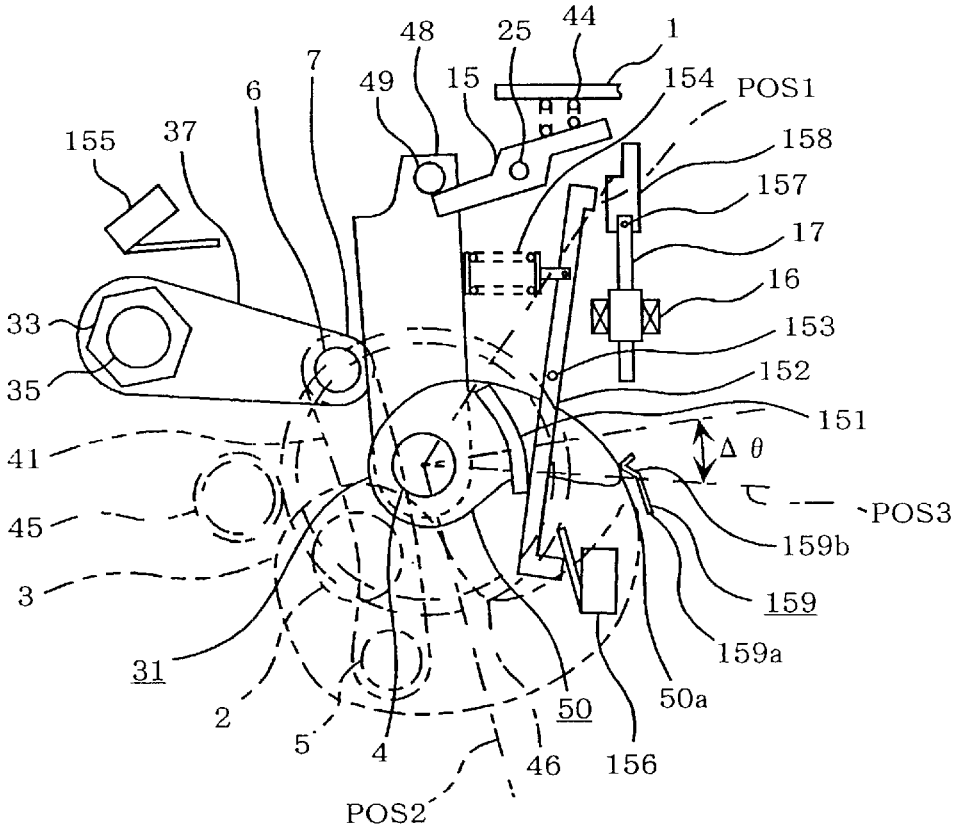
FIG. 7 is a constructional diagram of the energizing mechanism for energizing the circuit-making torsion bars of the first embodiment showing a state in which the circuit-making torsion bars are deenergized, and the second cam is stationary within the specific angular range of rotation.
Figure 8:
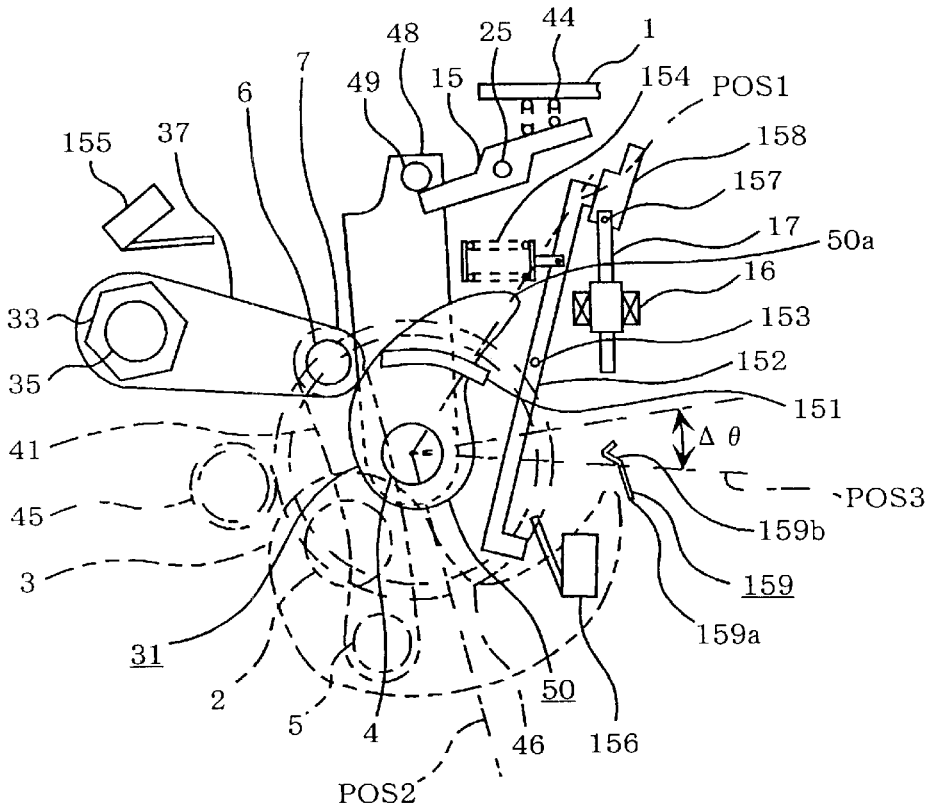
FIG. 8 is a constructional diagram of the energizing mechanism for energizing the circuit-making torsion bars of the first embodiment showing a state in which the circuit-making torsion bars have begun energizing operation from their deenergized condition shown in FIG. 7, and the second cam has come into contact with the closing lever.

FIG. 7 is a constructional diagram of the energizing mechanism 31 for energizing the circuit-making torsion bars 29, 35 of the first embodiment showing a state in which the circuit-making torsion bars 29, 35 are deenergized, and the second cam 50 is stationary within the specific angular range $\Delta\theta$ of rotation. FIG. 8 is a constructional diagram of the energizing mechanism 31 for energizing the circuit-making torsion bars 29, 35 of the first embodiment showing a state in which the circuit-making torsion bars 29, 35 have begun energizing operation from their deenergized condition shown in FIG. 7, and the second cam 50 has come into contact with the closing lever 37.

Figure 9:
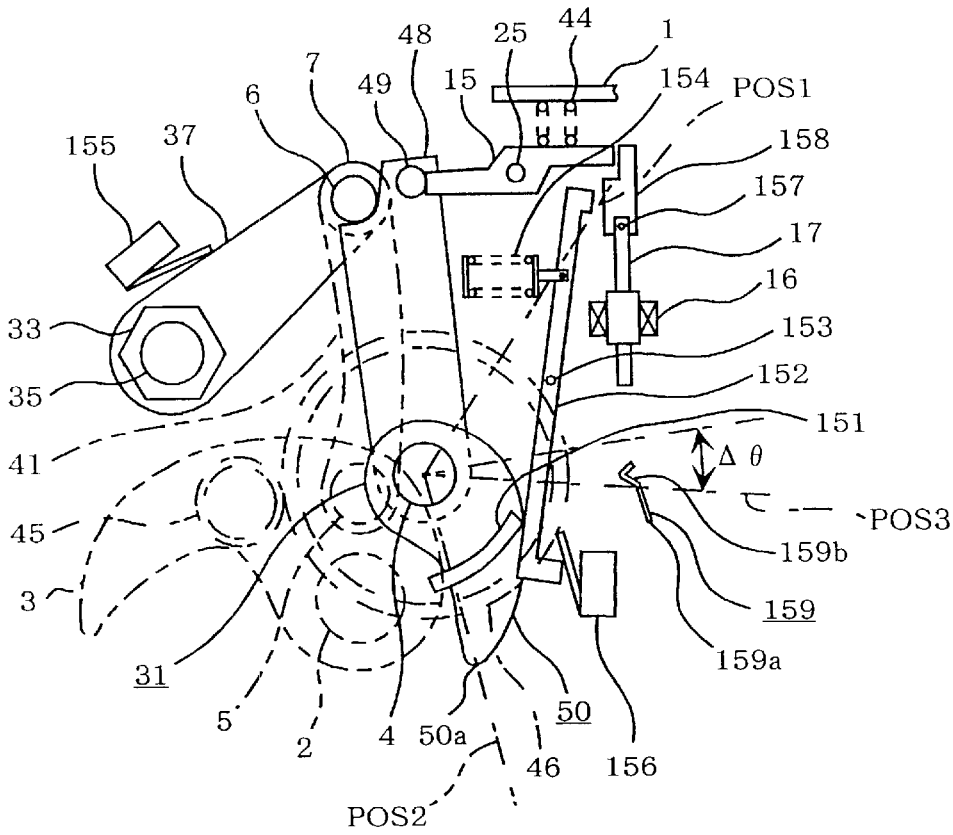
FIG. 9 is a constructional diagram of the energizing mechanism for energizing the circuit-making torsion bars of the first embodiment showing a state in which the circuit-making torsion bars have been energized from their condition shown in FIG. 8, and the second cam has further turned and actuated the cam switch.

FIG. 9 is a constructional diagram of the energizing mechanism 31 for energizing the circuit-making torsion bars 29, 35 of the first embodiment showing a state in which the circuit-making torsion bars 29, 35 have been energized from their condition shown in FIG. 8, and the second cam 50 has further turned and actuated the cam switch 156.

It is to be noted that a lever 152, a rotary shaft 153, a spring 154, the aforementioned cam switch 156 and an elastic brake member 159 depicted in FIGS. 6–9 are not shown in FIGS. 1–5 to avoid complication caused by illustrating too many constituent elements. Also, a cam shaft 2, a cam 3 and a link 41 are shown by alternate long and two short dashed lines for the sake of simplification. These elements will be described later in detail.

Referring to FIGS. 1–9, the energizing mechanism 31 includes components identical or equivalent to those of the energizing mechanism 30 of FIGS. 36–39, such as a small gear wheel 45, a large gear wheel 46, the aforementioned second cam 50, a second rotary member 7, the aforementioned closing lever 37 serving as an energizing lever, a closing latch 48, a closing trigger 15, a closing electromagnet 16 and a plunger 17. Referring to FIGS. 6–9, designated by the numeral 151 is an arc-shaped projecting part which is fixed to the second cam 50, and the lever 152 is rotatably supported by the rotary shaft 153 and continuously receives a clockwise turning force exerted by the spring 154.

Designated by the numeral 155 is a lever switch serving as an electric motor deactivator. The lever switch 155 is pushed by the closing lever 37 and opened when the circuit-making torsion bars 29, 35 are energized and the closing lever 37 is locked by the closing latch 48. The provision of the lever switch 155 is conventional although it is not specifically shown in the conventional operating apparatus of FIGS. 36–39. The cam switch 156 serves as a current interrupter and is opened when pushed by the lever 152. The lever switch 155 and the cam switch 156 are connected parallel to each other and, therefore, power supply to an electric motor (not shown) is interrupted only when both of these switches 155, 156 are opened.

Designated by the numeral 158 is a trigger lever which is swingably connected to the plunger 17 of the closing electromagnet 16 by a pin 157. The elastic brake member 159 is platelike element made of spring steel. A supporting portion 159*a* of the elastic brake member 159 is fixed to a housing 1, allowing a hooked end portion 159*b* of the elastic brake member 159 to swing about the supporting portion 159*a*, or move back and forth in a radial direction of a rotary shaft 4, by elastic deformation. When the second cam 50 turns about the rotary shaft 4, the end portion 159*b* of the elastic brake member 159 elastically deforms and slides along a peripheral surface of the second cam 50, thereby applying a braking force to the rotating second cam 50.

The lever 152 which is moved by the projecting part 151 provided on the second cam 50 and the trigger lever 158 which is a rotary member connected to the plunger 17 via the pin 157 together constitute an energizing lever deactivator in this invention.

The second cam 50 has a cam surface which produces a generally constant torque applied to the electric motor (not shown) while the circuit-making torsion bars 29, 35 are energized by turning the closing lever 37 counterclockwise, all the way from the beginning to the end of energizing process.

As described above, the energizing mechanism 31 of this embodiment includes the projecting part 151, the lever 152, the rotary shaft 153, the spring 154, the cam switch 156, the pin 157, the trigger lever 158 and the elastic brake member 159, in addition to the small gear wheel 45, the large gear wheel 46, the second cam 50, the second rotary member 7, the closing lever 37, the lever switch 155, the closing latch 48, the closing trigger 15, the closing electromagnet 16 and the plunger 17 of the energizing mechanism 30 of FIGS. 36–39.

Now, circuit-breaking and making operations of the operating apparatus for the circuit breaker of this embodiment are described.

When the circuit-making torsion bars 29, 35 and the circuit-breaking torsion bars 28, 34 are all energized and the energizing mechanism 31 is in the state shown in FIG. 6, the operating apparatus for the circuit breaker is in the state shown in FIG. 1. The circuit-breaking operation is performed as follows. When a tripping electromagnet 20 is excited and its plunger 21 causes a tripping trigger 19 to turn clockwise about a rotary shaft 98 in the state shown in FIG. 1, the tripping trigger 19 unlocks a tripping latch 18.

When the tripping latch 18 is disengaged from the tripping trigger 19, the tripping latch 18 which receives a reaction force from an interrupting lever 36 turns counterclockwise about a rotary shaft 75 overwhelming a force exerted by a spring 43, thereby releasing a pin 8 provided on the interrupting lever 36. Then, the interrupting lever 36 turns counterclockwise as the circuit-breaking torsion bars 28, 34 are deenergized and, as a consequence, an on-off switch 10 opens and the operating apparatus goes into the state shown in FIG. 2. At this point, the state shown in FIG. 6 is maintained with the second cam 50 remaining stationary and the closing lever 37 remaining locked by the closing latch 48.

If the closing electromagnet 16 is excited in the state shown in FIG. 2 in which the circuit breaker is opened, the plunger 17 moves and the trigger lever 158 which is currently in line with the plunger 17 causes the closing trigger 15 to turn counterclockwise about its rotary shaft 25. Then, the closing lever 37 locked by the closing trigger 15 via the closing latch 48 is released, and the closing lever 37 fixed to an end of the circuit-making torsion bar 35 turns clockwise as the circuit-making torsion bars 29, 35 release their elastic restoring energy.

At this time, the cam 3 connected to the closing lever 37 via the link 41 turns clockwise, and the interrupting lever 36 turns clockwise from its position shown in FIG. 2, thereby closing the on-off switch 10 and energizing the circuit-breaking torsion bars 28, 34. Then, the operating apparatus goes into the state shown in FIG. 3 in which the on-off switch 10 is closed, the circuit-breaking torsion bars 28, 34 are energized, and the circuit-making torsion bars 29, 35 are deenergized.

From the state shown in FIG. 3 in which the circuit-making torsion bars 29, 35 are deenergized, the circuit-making torsion bars 29, 35 are energized. In the state shown in FIG. 3, the closing lever 37 which has rotated clockwise is separated from the lever switch 155 and the lever switch 155 is closed. Thus, it is possible to supply electric power to the electric motor in this condition. When the electric motor is run, the small gear wheel 45 turns clockwise, causing the large gear wheel 46 meshed with the small gear wheel 45 to turn counterclockwise. As a result, the second cam 50 fixed to the large gear wheel 46 also turns counterclockwise and becomes separated from the elastic brake member 159 as the second cam 50 slides past the elastic brake member 159 while pushing the end portion 159*b* of the elastic brake member 159 outward against its elastic force.

When the second cam 50 further turns counterclockwise and reaches a first angular position POS1, the second cam 50 goes into contact with the second rotary member 7 which is provided on the closing lever 37 as shown in FIGS. 4 and 8. Here, the first angular position POS1, as well as a second angular position POS2, a third angular position POS3 and the aforementioned specific angular range $\Delta\theta$ of rotation explained in the following discussion, are based on the position of an outermost point 50*a* (farthest from the rotary shaft 4) of the second cam 50. The second cam 50 further turns counterclockwise while pushing the closing lever 37 upward via the second rotary member 7, thereby causing the closing lever 37 to turn counterclockwise about a rotary shaft 33. When the second cam 50 further turns and its outermost point 50*a* reaches a specific angular position of rotation, the closing lever 37 which has been forced to turn counterclockwise by the second cam 50 pushes against the lever switch 155 and opens it.

Even when the lever switch 155 is pushed and opened by the closing lever 37, the cam switch 156 is not opened, so that the electric motor continues to run and the second cam 50 continues to turn counterclockwise. Thus, the second cam 50 causes the closing lever 37 to turn counterclockwise slightly beyond its locking position with the closing latch 48. When the second cam 50 further turns, the closing lever 37 is caused to reversely turn slightly clockwise due to a clockwise turning force exerted by the circuit-making torsion bars 29, 35 and is locked by the closing latch 48 via a pin 6 provided on the closing lever 37. The clockwise turning force exerted on the closing lever 37 by the circuit-making torsion bars 29, 35 is sustained by the closing latch 48 in the earlier-described fashion, and storage of elastic restoring energy in the circuit-making torsion bars 29, 35 is finished.

The lever 152 is continuously biased to turn clockwise by the spring 154. Immediately after the circuit-making torsion bars 29, 35 have been energized, the lever 152 is in a position where it has pushed and turned the trigger lever 158 connected to the plunger 17 of the closing electromagnet 16 clockwise up to a specific position. Specifically, the trigger lever 158 is in the same position as shown in FIG. 8, although the second cam 50 is in a different angular position of rotation from what is shown in FIG. 8. Even if a circuit-making command is generated causing the plunger 17 to move in this condition, the trigger lever 158 does not go into contact with the closing trigger 15, so that the circuit-making operation is not performed at this point.

The second cam 50 further turns counterclockwise and separates from the second rotary member 7. The electric motor continues to run even after the second cam 50 has separated from the second rotary member 7. When the second cam 50 has turned by a first specific angle from the aforementioned first angular position POS1 and its outermost point 50*a* has reached the second angular position POS2, the projecting part 151 fixed to the second cam 50 comes into contact with the lever 152, causing it to turn counterclockwise about the rotary shaft 153.

As the lever 152 turns, the trigger lever 158 which has been pushed by the lever 152 turns counterclockwise about the pin 157 following the movement of the lever 152 due to a pushing force exerted by an unillustrated spring until the lever 152 becomes in line with the plunger 17. In this condition, it is now possible for the trigger lever 158 to turn the closing trigger 15 counterclockwise when the plunger 17 is actuated. Also, when the lever 152 turns counterclockwise, the cam switch 156 is pushed and opened. Shown in FIG. 9 is a state in which the cam switch 156 has been opened in this fashion.

At this point, the switches 155, 156 are both opened and the power supply to the electric motor is interrupted. Since the electric motor continues to run due to inertia of its rotor even after the power supply to the electric motor has been interrupted, the large gear wheel 46 and the second cam 50 continue to turn as well. The large gear wheel 46 and the second cam 50 are however decelerated due to frictional resistance exerted by the large gear wheel 46 and other components. When the second cam 50 has turned by a specific angle from the second angular position POS2 and its outermost point 50*a* has reached the third angular position POS3 in a final stage of deceleration, the peripheral surface of the second cam 50 goes into firm contact with the elastic brake member 159. As the elastic brake member 159 brakes the second cam 50 at this point, its outermost point 50*a* halts within the aforementioned specific angular range $\Delta\theta$ of rotation shown in FIG. 6.

The specific angular range $\Delta\theta$ of rotation is determined such that the closing lever 37 does not hit against the second cam 50 when the closing lever 37 locked by the closing latch 48 is released and turns clockwise. Also, the stiffness of the elastic brake member 159 is selected such that it can halt the second cam 50 with its outermost point 50*a* positioned within the specific angular range $\Delta\theta$ of rotation in a reliable fashion regardless of variations in the amount of frictional resistance exerted on the second cam 50. Although the second cam 50 halts immediately after its peripheral surface has come into contact with the elastic brake member 159 in the above-described construction of the first embodiment, the construction may be modified such that the second cam 50 halts after it has passed along the elastic brake member 159 while elastically deforming it and becomes separated from the elastic brake member 159.

The operating apparatus goes into the state shown in FIGS. 1 and 6 in which the circuit breaker is closed, the circuit-breaking torsion bars 28, 34 and the circuit-making torsion bars 29, 35 are all energized, and the second cam 50 halts with its outermost point 50*a* positioned within the specific angular range $\Delta\theta$ of rotation in the aforementioned manner. Since the trigger lever 158 can go into contact with the closing trigger 15 and push it in this condition, it is now possible to perform the circuit-making operation.

If the circuit-breaking operation is performed from the state shown in FIG. 3, the circuit-breaking torsion bars 28, 34 and the circuit-making torsion bars 29, 35 become all deenergized. However, the position of the second cam 50 does not change and, from this condition, the circuit-making torsion bars 29, 35 are energized and the operating apparatus goes into the state shown in FIGS. 2 and 6, from where the circuit-closing operation of the circuit breaker can be executed.

In the foregoing description of the first embodiment, the angular position of rotation of the second cam 50 has been illustrated with reference to the position of the outermost point 50*a* for the sake of explanation. As an alternative, the angular position of rotation of the second cam 50 may be defined by its any desired part, such as its contact point which first goes into contact with the second rotary member 7 provided on the closing lever 37 when the circuit-making torsion bars 29, 35 are energized from the state shown in FIG. 4. Although the illustrated locations of the first to third angular positions POS1–POS3 and the specific angular range Δθ of rotation vary depending on which part of the second cam 50 is used as a reference for expressing its angular position, their relative positions remain unchanged. This applies to later-described embodiments of the invention as well.

As thus far described, the operating apparatus for the circuit breaker of the first embodiment is constructed such that the power supply to the electric motor is not interrupted until the outermost point 50*a* of the second cam 50 reaches the second angular position POS2 with the provision of the cam switch 156, and the second cam 50 halts between the second angular position POS2 and the third angular position POS3 and does not collide with the closing lever 37.

Also, since the second cam 50 is braked by the elastic brake member 159, it is possible to decrease variations in the amount of overrun of the second cam 50, which could occur due to variations in the amount of frictional resistance caused by temperature changes or property changes with the lapse of time, and halt the second cam 50 with its outermost point 50*a* positioned within the specific angular range Δθ of rotation. Furthermore, the second cam 50 is braked by the elastic brake member 159 when the electric motor is in its final stage of inertial turning and its inertial energy has declined. Therefore, energy required for braking is small, making it possible to use a simple, compact and low-cost braking device.

Furthermore, until the outermost point 50*a* of the second cam 50 comes to the second angular position POS2 and the projecting part 151 provided on the second cam 50 turns the lever 152 counterclockwise, the lever 152 forces the trigger lever 158 to turn it clockwise and, therefore, the closing trigger 15 would in no case be turned counterclockwise by the plunger 17 even when the plunger 17 is actuated.

This means that it is not possible to release the closing lever 37 locked by the closing latch 48 by actuating the closing trigger 15 while the outermost point 50*a* of the second cam 50 is positioned outside the specific angular range Δθ of rotation. This makes it possible to prevent an intense shock which could occur when the closing lever 37 is released from the closing latch 48 and turns clockwise, causing the second rotary member 7 to hit against the second cam 50.

It is possible to activate the closing trigger 15 by the plunger 17 and perform the circuit-making operation only when the projecting part 151 turns the lever 152 counterclockwise and the trigger lever 158 is in line with the plunger 17 as shown in FIG. 6 or 7. Under these conditions, the second cam 50 is in a position where it can not collide with the second rotary member 7 even when the circuit-making torsion bars 29, 35 are deenergized, or the circuit-making operation is initiated.

Even if the lever switch 155 or the cam switch 156 fails and the small gear wheel 45 continues to rotate, the trigger lever 158 is in a position where it has been pushed and turned clockwise by the lever 152 when the projecting part 151 provided on the second cam 50 does not push the lever 152 and the cam switch 156 is not opened. Since the closing trigger 15 locked by a pin 49 provided on the closing latch 48 is not released and the circuit-making operation can not be performed in this condition, it is possible to prevent the closing lever 37 from colliding with the rotating second cam 50.

When the electric motor continues to run due to a failure of the lever switch 155 or the cam switch 156 and the outermost point 50*a* of the second cam 50 is positioned within the specific angular range Δθ of rotation, the projecting part 151 pushes the lever 152 and the trigger lever 158 is in line with the plunger 17, so that it is possible to perform the circuit-making operation. The second rotary member 7 does not collide with the second cam 50, however, even if the circuit-making operation is performed in this condition.

Since the torsion bars serving as energy-storing devices have such advantages that the torsion bars have a high energy efficiency because they only have their own polar moment of inertia and that there is no stress concentration in them, the torsion bars are suited to operating apparatuses for relatively large-sized circuit breakers, for example, which require a large amount of energy.

Second Embodiment

Figure 10:
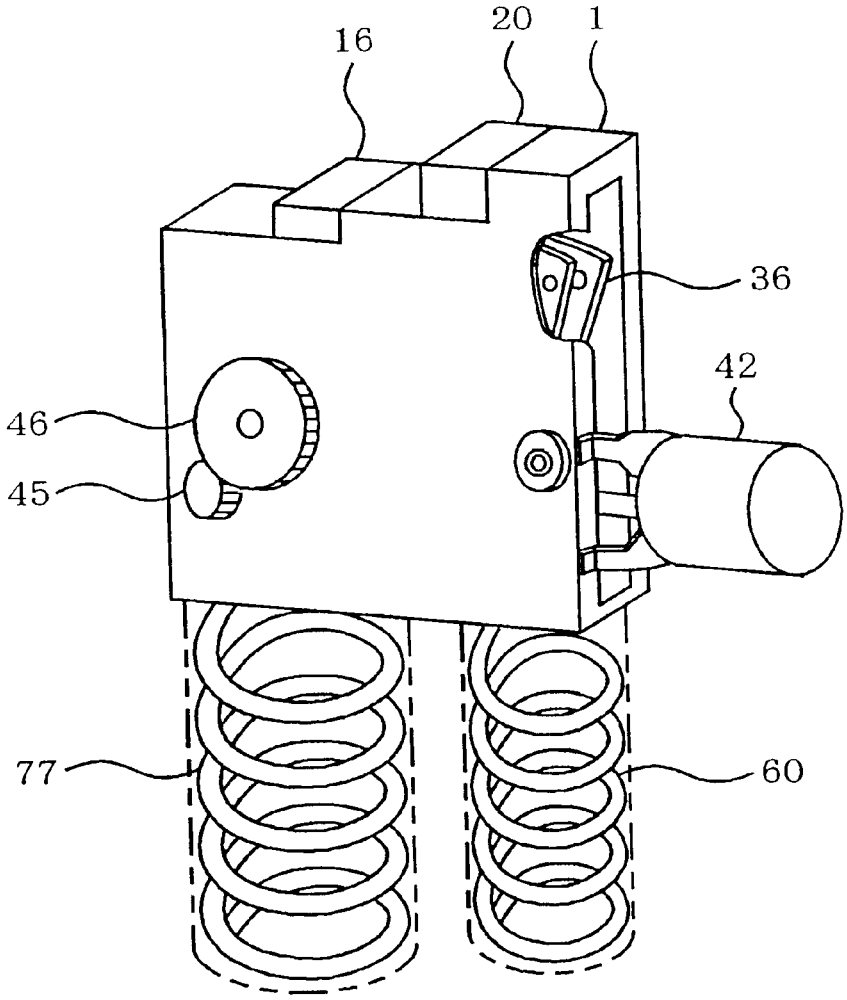
FIG. 10 is a perspective view of an operating apparatus for a circuit breaker according to a second embodiment of the invention.
Figure 11:
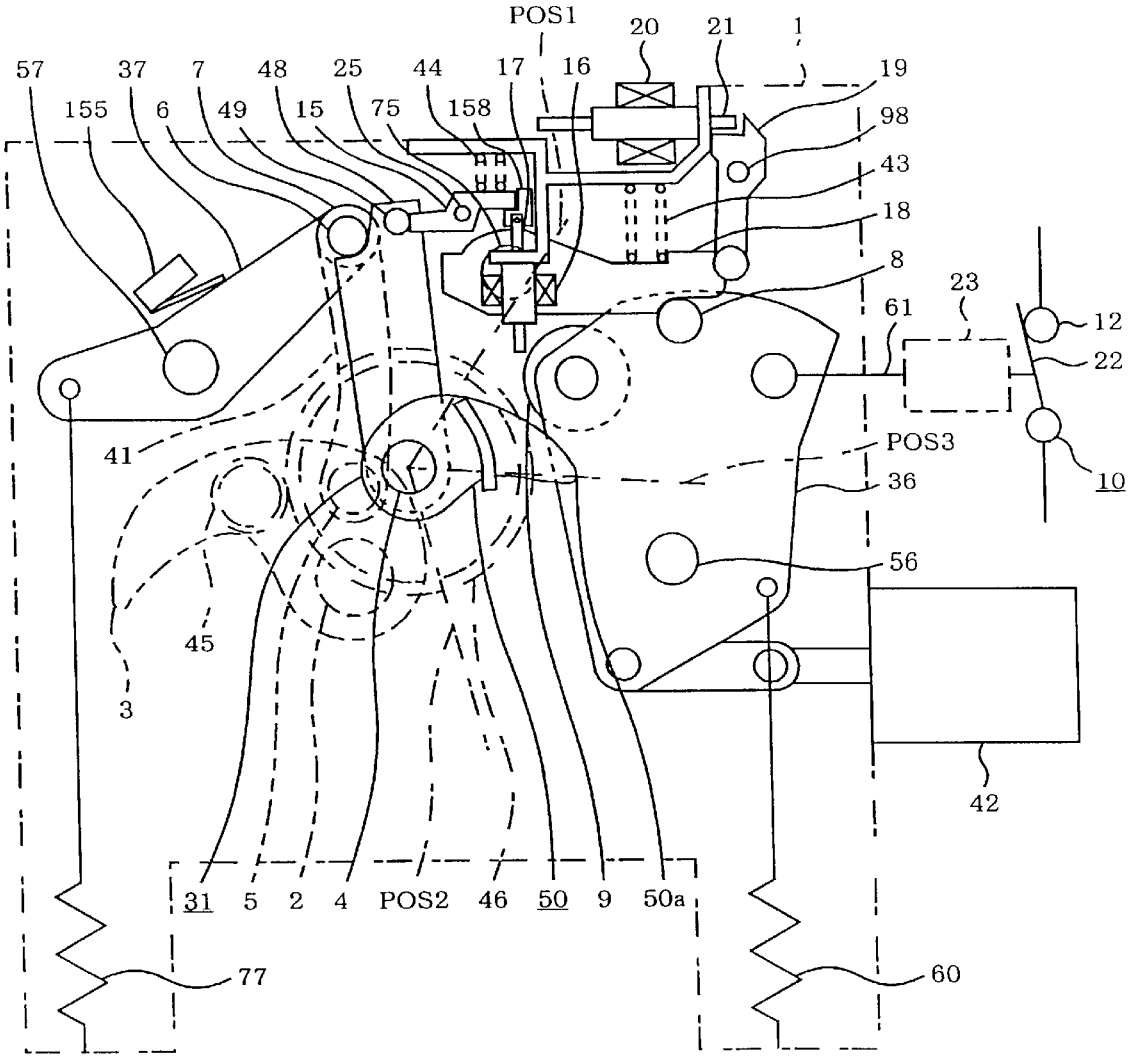
FIG. 11 is a constructional diagram of the operating apparatus for the circuit breaker of the second embodiment showing a state in which the circuit breaker is closed, a circuit-breaking coil spring and a circuit-making coil spring are both energized, and a second cam of an energizing mechanism is stationary within a specific angular range of rotation.
Figure 12:
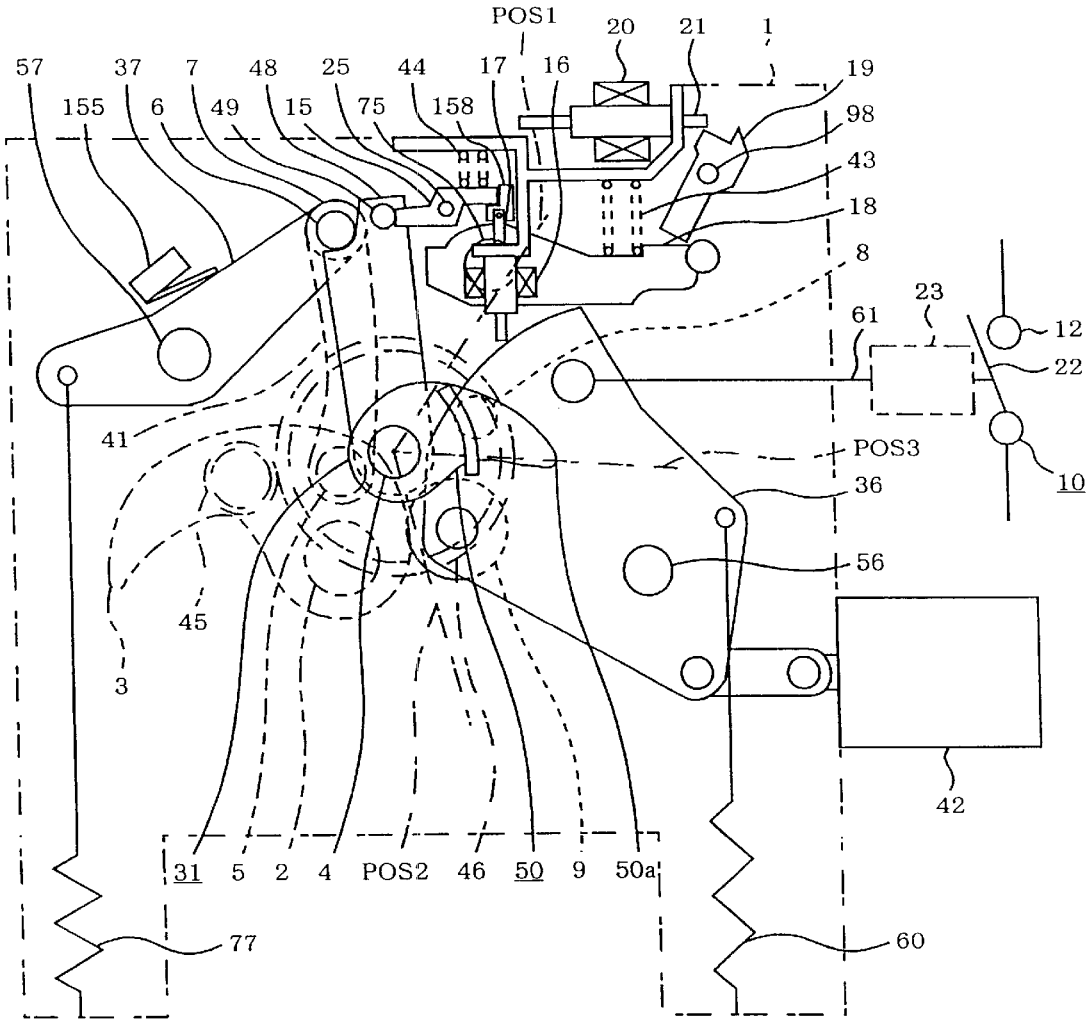
FIG. 12 is a constructional diagram of the operating apparatus for the circuit breaker of the second embodiment showing a state in which the circuit breaker is opened, the circuit-breaking coil spring is deenergized, the circuit-making coil spring is energized, and the second cam of the energizing mechanism is stationary within the specific angular range of rotation.

FIGS. 10–19 show an operating apparatus for a circuit breaker according to a second embodiment of the invention, in which FIG. 10 is a perspective view of the operating apparatus for the circuit breaker. FIG. 11 is a constructional diagram of the operating apparatus for the circuit breaker of the second embodiment showing a state in which the circuit breaker is closed, a circuit-breaking coil spring 60 and a circuit-making coil spring 77 are both energized, and a second cam 50 of an energizing mechanism 31 is stationary within a specific angular range Δθ of rotation. FIG. 12 is a constructional diagram of the operating apparatus for the circuit breaker of the second embodiment showing a state in which the circuit breaker is opened, the circuit-breaking coil spring 60 is deenergized, the circuit-making coil spring 77 is energized, and the second cam 50 of the energizing mechanism 31 is stationary within the specific angular range Δθ of rotation.

Figure 13:
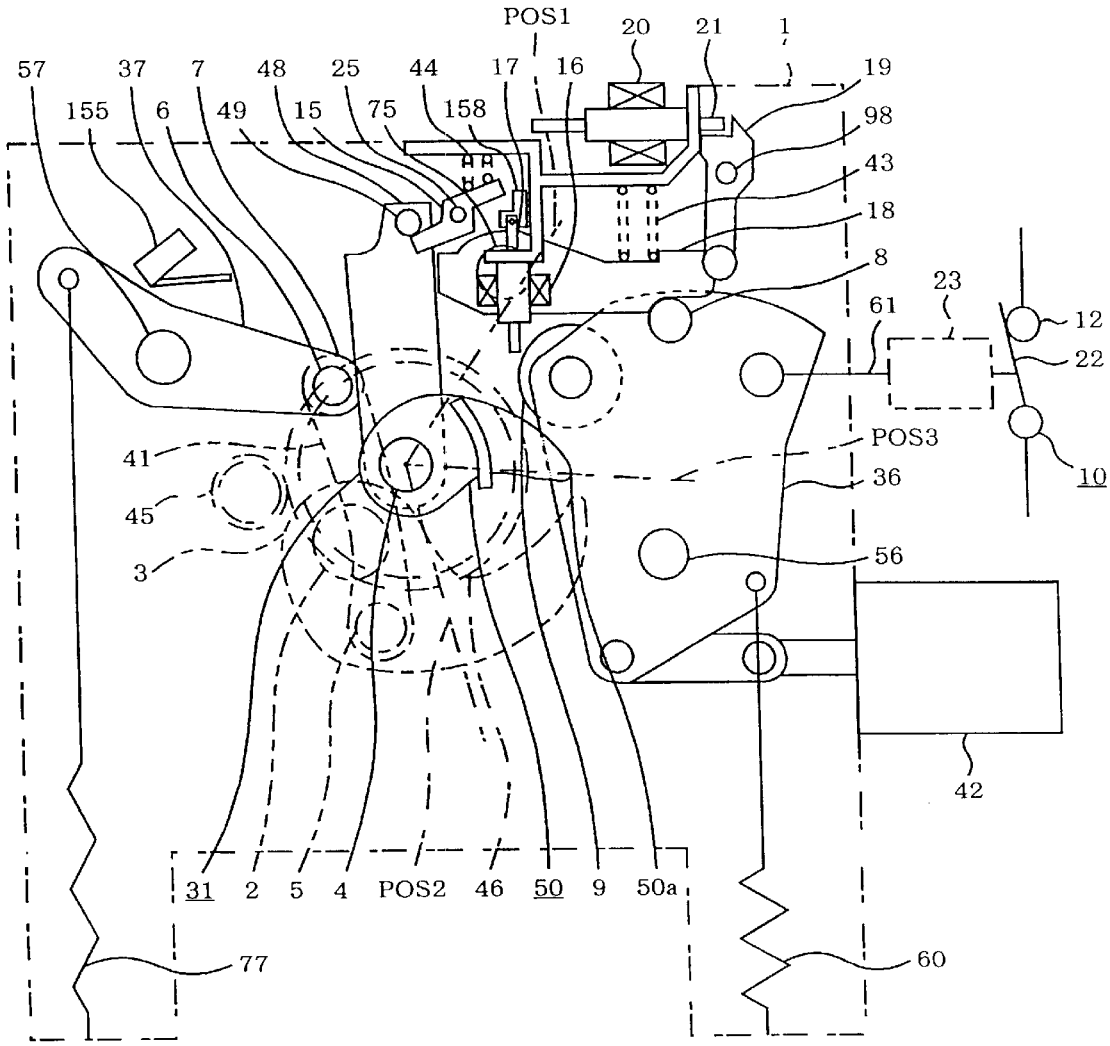
FIG. 13 is a constructional diagram of the operating apparatus for the circuit breaker of the second embodiment showing a state in which the circuit breaker is closed, the circuit-breaking coil spring is energized, the circuit-making coil spring is deenergized, a closing lever is stationary after turning clockwise, and the second cam of the energizing mechanism is stationary within the specific angular range of rotation.
Figure 14:
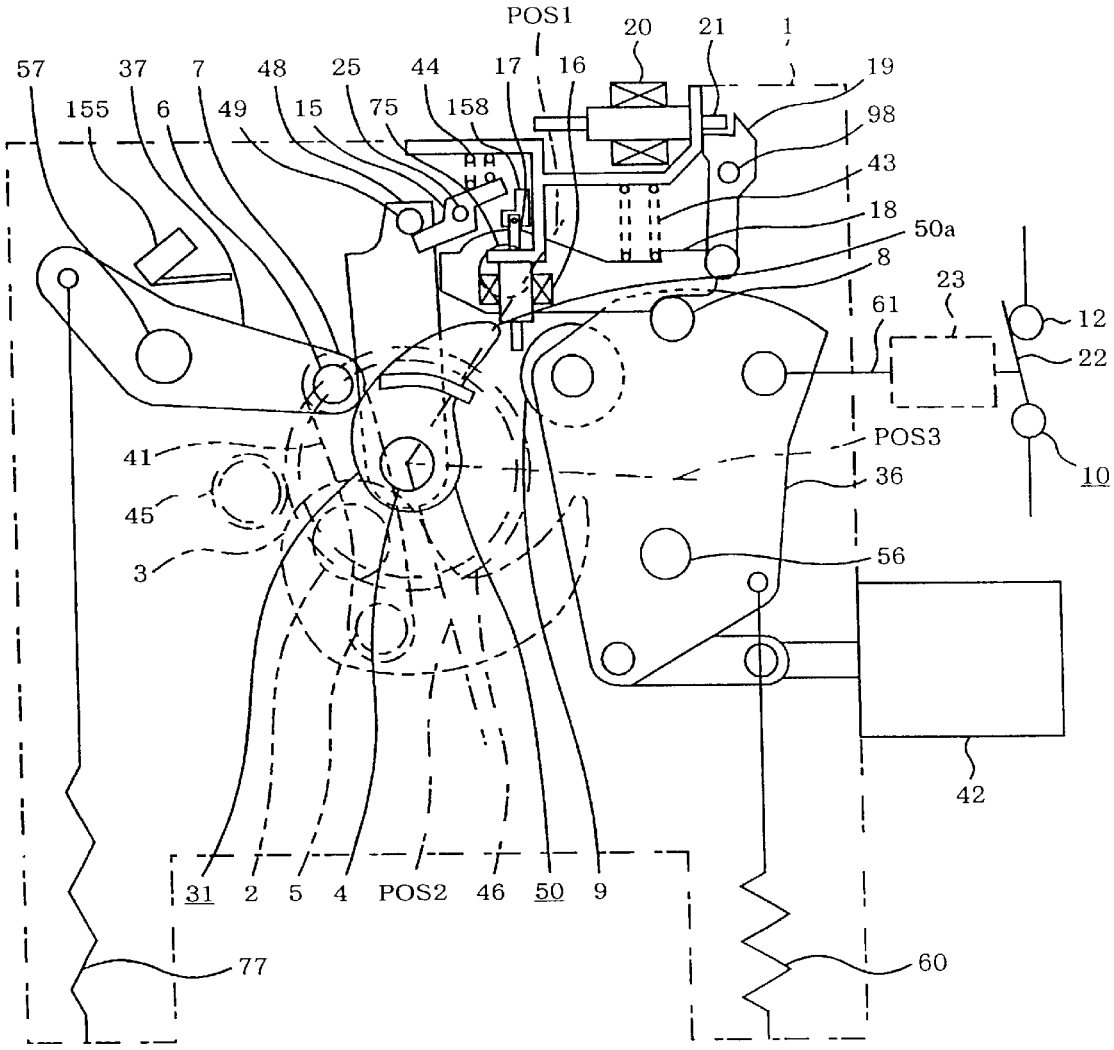
FIG. 14 is a constructional diagram of the operating apparatus for the circuit breaker of the second embodiment showing a state in which the circuit breaker is closed, the circuit-breaking coil spring is energized, the circuit-making coil spring has begun energizing operation from its deenergized condition, and the second cam of the energizing mechanism has come into contact with the closing lever.

FIG. 13 is a constructional diagram of the operating apparatus for the circuit breaker of the second embodiment showing a state in which the circuit breaker is closed, the circuit-breaking coil spring 60 is energized, the circuit-making coil spring 77 is deenergized, a closing lever 37 is stationary after turning clockwise, and the second cam 50 of the energizing mechanism 31 is stationary within the specific angular range Δθ of rotation. FIG. 14 is a constructional diagram of the operating apparatus for the circuit breaker of the second embodiment showing a state in which the circuit breaker is closed, the circuit-breaking coil spring 60 is energized, the circuit-making coil spring 77 has begun energizing operation from its deenergized condition, and the second cam 50 of the energizing mechanism 31 has come into contact with the closing lever 37.

Figure 15:
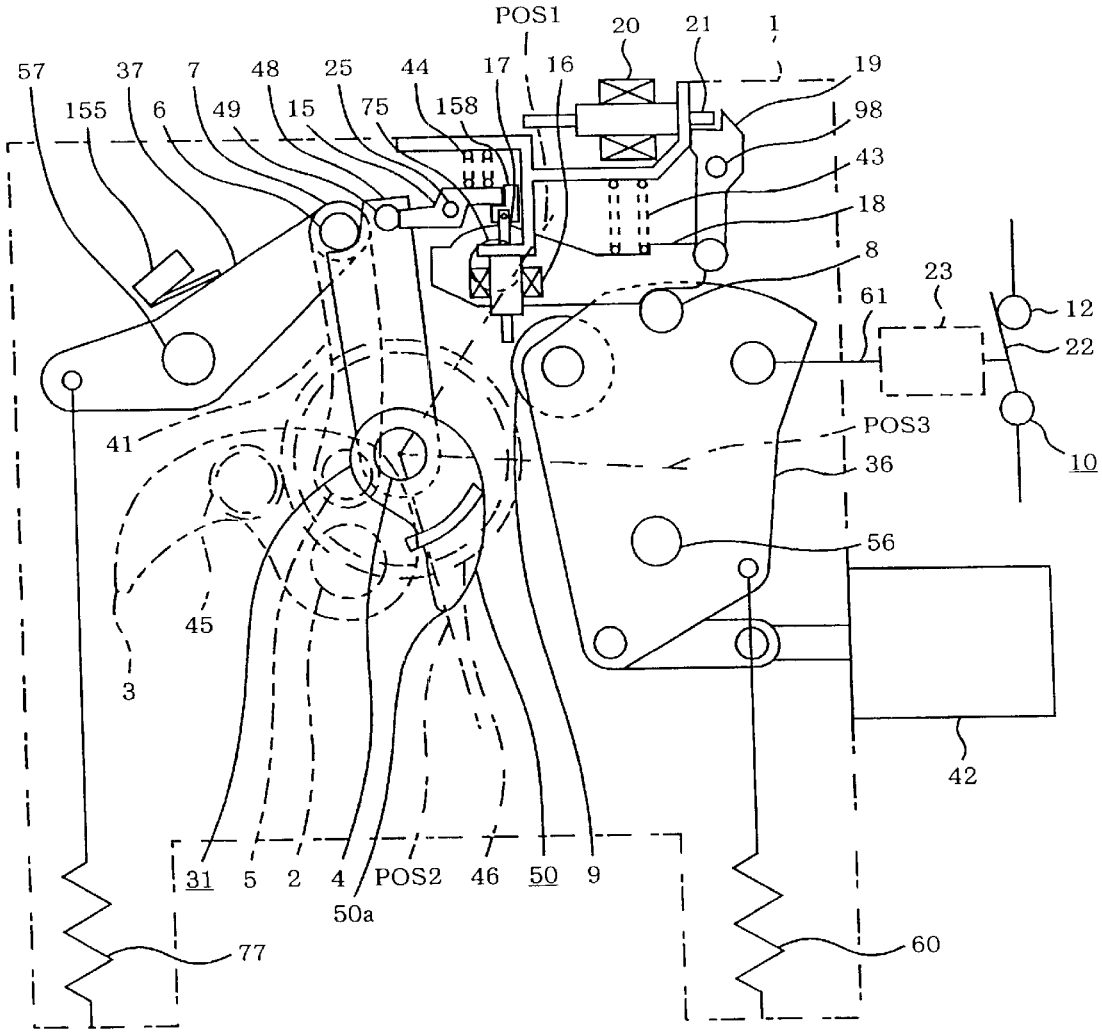
FIG. 15 is a constructional diagram of the operating apparatus for the circuit breaker of the second embodiment showing a state in which the circuit breaker is closed, the circuit-breaking coil spring is energized, and the second cam has come into contact with a cam switch after the circuit-making coil spring has been energized.

FIG. 15 is a constructional diagram of the operating apparatus for the circuit breaker of the second embodiment showing a state in which the circuit breaker is closed, the circuit-breaking coil spring 60 is energized, and the second cam 50 has come into contact with a cam switch 156 after the circuit-making coil spring 77 has been energized.

Figure 16:
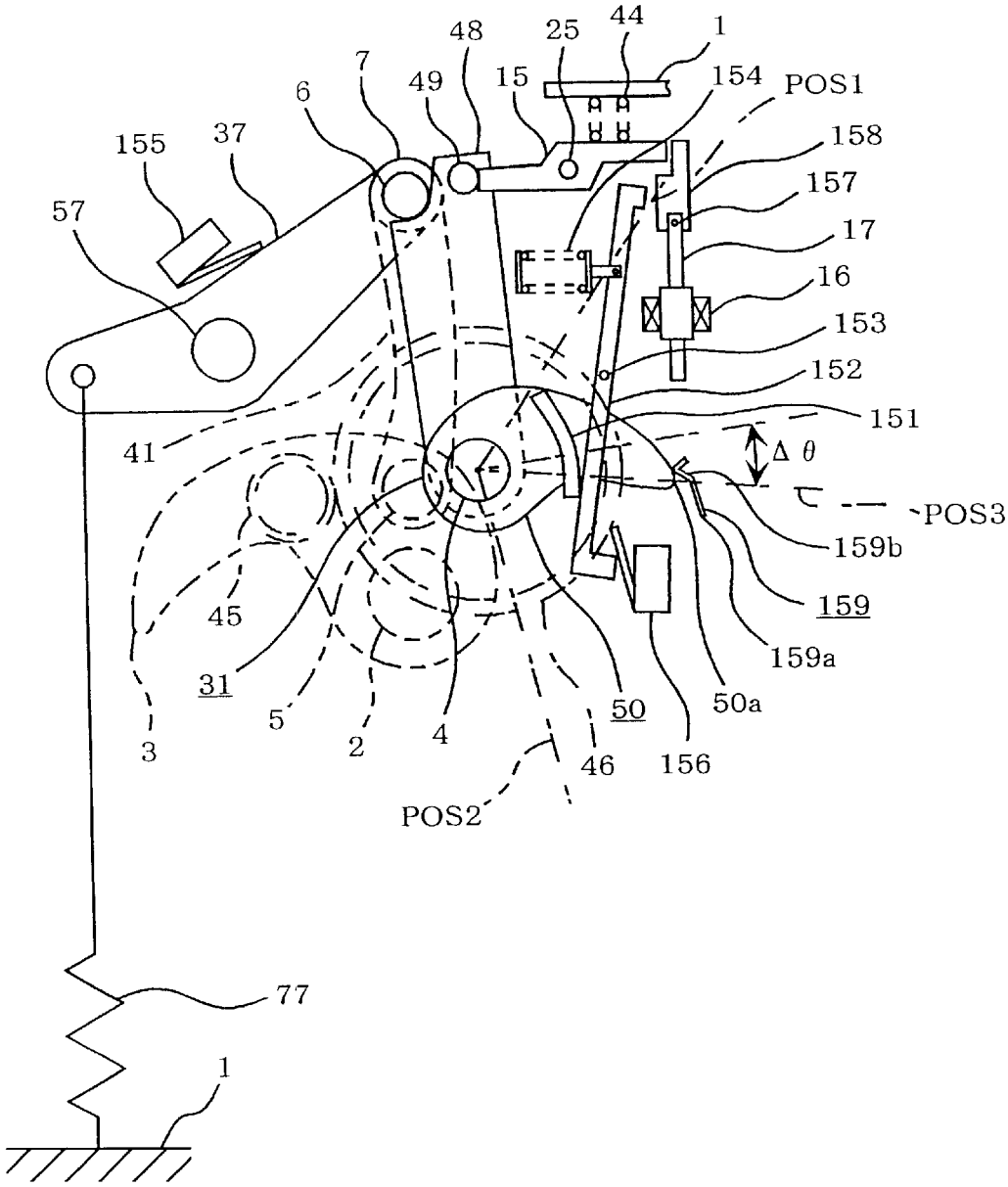
FIG. 16 is a constructional diagram of the energizing mechanism for energizing the circuit-making coil spring of the second embodiment showing a state in which the circuit-making coil spring is energized, and the second cam is stationary within the specific angular range of rotation.
Figure 17:
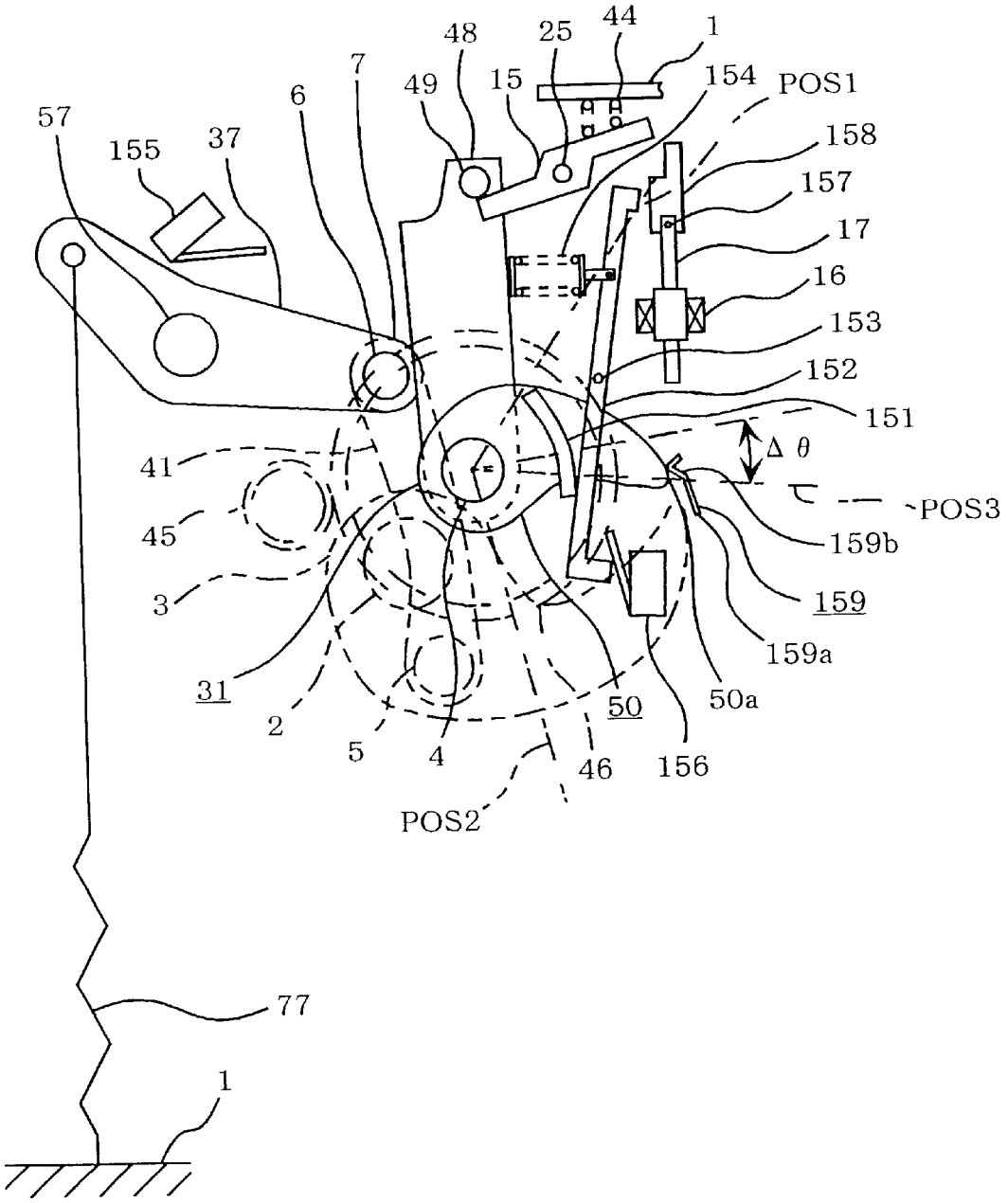
FIG. 17 is a constructional diagram of the energizing mechanism for energizing the circuit-making coil spring of the second embodiment showing a state in which the circuit-making coil spring is deenergized, and the second cam is stationary within the specific angular range of rotation.

FIG. 16 is a constructional diagram of the energizing mechanism 31 for energizing the circuit-making coil spring 77 of the second embodiment showing a state in which the circuit-making coil spring 77 is energized, and the second cam 50 is stationary within the specific angular range Δθ of rotation. FIG. 17 is a constructional diagram of the energizing mechanism 31 for energizing the circuit-making coil spring 77 of the second embodiment showing a state in which the circuit-making coil spring 77 is deenergized, and the second cam 50 is stationary within the specific angular range Δθ of rotation.

Figure 18:
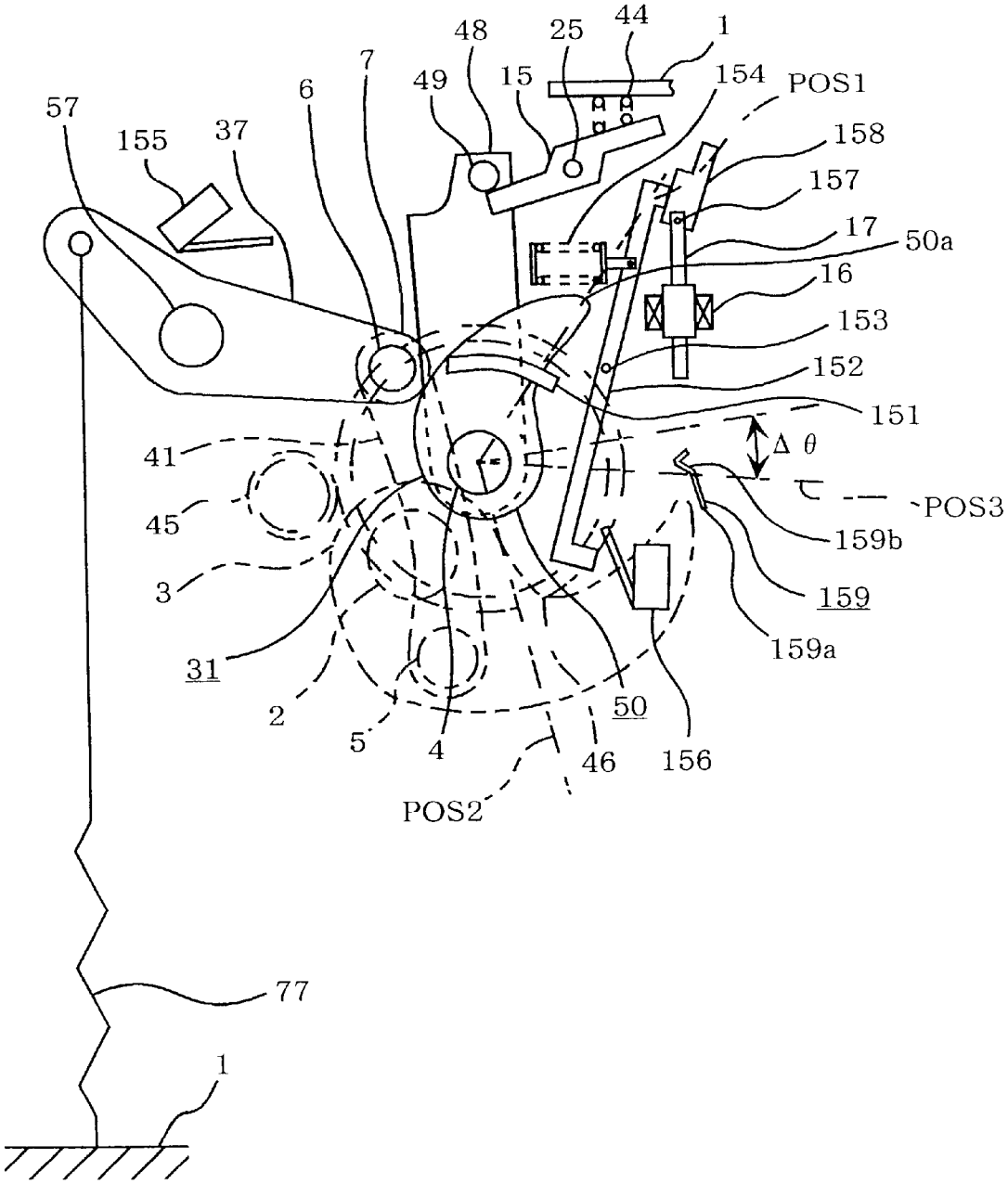
FIG. 18 is a constructional diagram of the energizing mechanism for energizing the circuit-making coil spring of the second embodiment showing a state in which the circuit-making coil spring has begun energizing operation from its deenergized condition shown in FIG. 17, and the second cam has come into contact with the closing lever.
Figure 19:
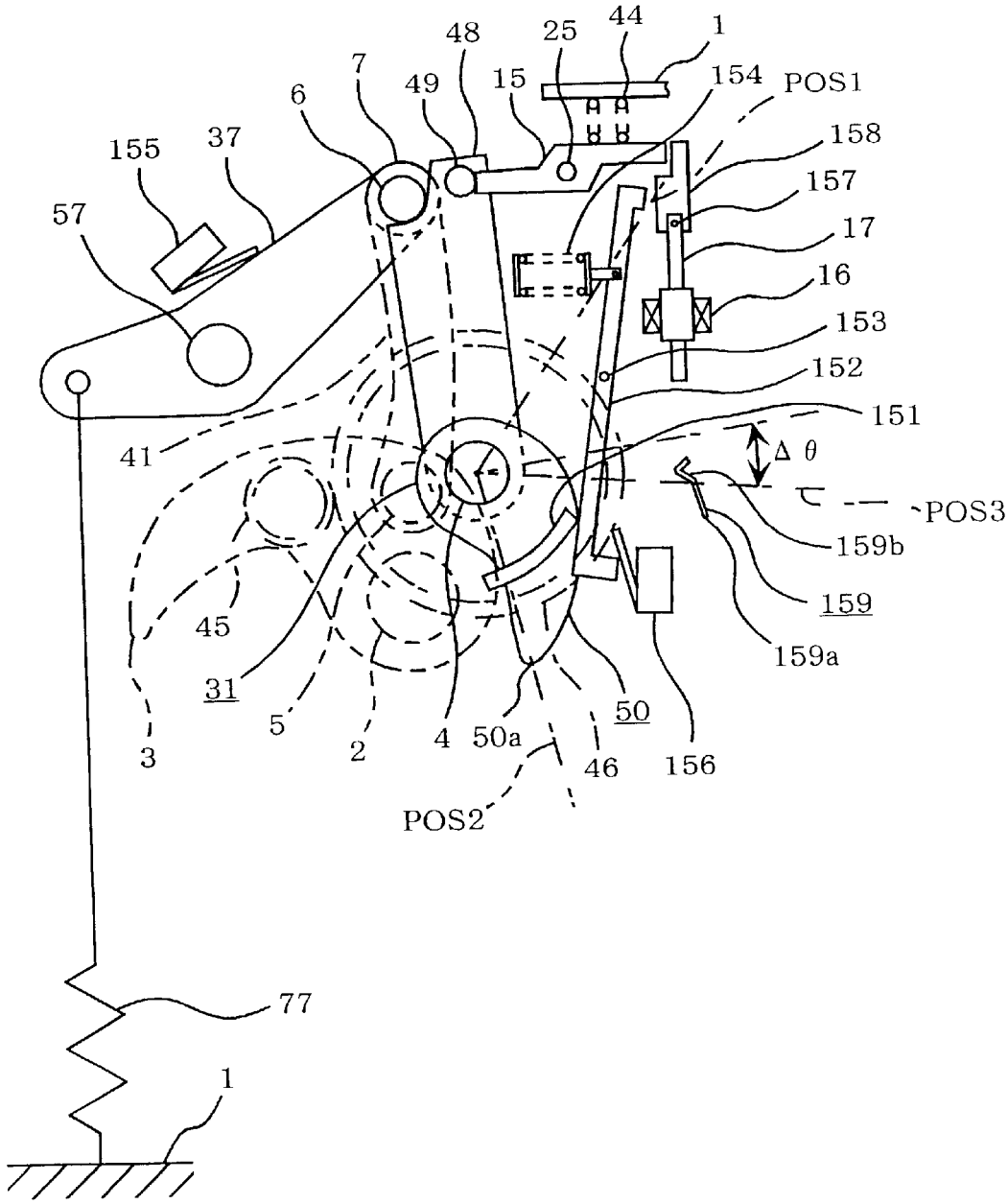
FIG. 19 is a constructional diagram of the energizing mechanism for energizing the circuit-making coil spring of the second embodiment showing a state in which the circuit-making coil spring has been energized from its condition shown in FIG. 18, and the second cam has further turned and actuated the cam switch.

FIG. 18 is a constructional diagram of the energizing mechanism 31 for energizing the circuit-making coil spring 77 of the second embodiment showing a state in which the circuit-making coil spring 77 has begun energizing operation from its deenergized condition shown in FIG. 17, and the second cam 50 has come into contact with the closing lever 37. FIG. 19 is a constructional diagram of the energizing mechanism 31 for energizing the circuit-making coil spring 77 of the second embodiment showing a state in which the circuit-making coil spring 77 has been energized from its condition shown in FIG. 18, and the second cam 50 has further turned and actuated the cam switch 156.

While elastic restoring energy stored in the torsion bars 29, 35, 28, 34 is used to provide operating forces for the on-off switch 10 in the foregoing first embodiment, elastic restoring energy stored in the aforementioned coil springs 60, 77 is used to provide operating forces for an on-off switch 10 in the second embodiment. Although the operating apparatus of the second embodiment more or less differs from that of the first embodiment in construction due to differences in the shapes of the coil springs 60, 77 and the torsion bars 29, 35, 28, 34, the operating apparatus of the second embodiment has basically the same operational and working effects as the first embodiment.

The following description of the second embodiment deals mainly with those portions which differ from the first embodiment. It is to be noted that a lever 152, a rotary shaft 153, a spring 154, the aforementioned cam switch 156 and an elastic brake member 159 depicted in FIGS. 16–19 are not shown in FIGS. 11–15 to avoid complication caused by illustrating too many constituent elements. Also, a cam shaft 2, a cam 3 and a link 41 are shown by alternate long and two short dashed lines for the sake of simplification.

Referring to FIGS. 11–19, an interrupting lever 36 is fixedly mounted on a rotary shaft 56 which is rotatably supported by a housing 1. The circuit-breaking coil spring 60 is connected to the interrupting lever 36 and exerts a counterclockwise turning force on the interrupting lever 36. The aforementioned closing lever 37 is fixedly mounted on a rotary shaft 57 which is rotatably supported by the housing 1. The circuit-making coil spring 77 is connected to the closing lever 37 and exerts a clockwise turning force on the closing lever 37.

Since the circuit-breaking coil spring 60 is energized by the circuit-making coil spring 77, the amount of energy stored in the circuit-making coil spring 77 is made larger than the amount of energy stored in the circuit-breaking coil spring 60.

As the operating apparatus of the second embodiment has otherwise the same construction as that of the first embodiment, elements identical or equivalent to those shown in FIGS. 1–9 are designated by the same reference numerals and a description of such elements is omitted here.

Operation of the operating apparatus of the second embodiment is basically the same as that of the first embodiment as well. In the state shown in FIG. 11, the circuit-making coil spring 77 and the circuit-breaking coil spring 60 are both compressed and energized and the energizing mechanism 31 is in the state shown in FIG. 16. The circuit-making coil spring 77 is energized by the energizing mechanism 31 from the state shown in FIG. 13 in which the circuit-making coil spring 77 is deenergized (extended) and the second cam 50 of the energizing mechanism 31 has halted within the specific angular range Δθ of rotation shown in FIG. 16.

As described earlier with reference to the first embodiment, the second cam 50 goes into contact with a second rotary member 7 provided on the closing lever 37 as shown in FIGS. 14 and 18 when the second cam 50 turns counterclockwise and its outermost point 50*a* reaches a first angular position POS1. The second cam 50 further turns counterclockwise and energizes (compresses) the circuit-making coil spring 77.

When the outermost point 50*a* of the second cam 50 reaches a second angular position POS2 as shown in FIGS. 15 and 19, a projecting part 151 provided on the second cam 50 pushes against the lever 152, thereby interrupting power supply to the electric motor. The electric motor continues to run due to inertia even after the power supply has been interrupted. When the outermost point 50*a* of the second cam 50 has reached a third angular position POS3 as shown in FIGS. 11 and 16, a peripheral surface of the second cam 50 goes into firm contact with the elastic brake member 159. As the elastic brake member 159 brakes the second cam 50 at this point, its outermost point 50*a* halts within the aforementioned specific angular range Δθ of rotation shown in FIG. 16.

If a circuit-breaking operation is initiated from the state shown in FIG. 11, a plunger 21 is actuated when a tripping electromagnet 20 is excited, and a tripping latch 18 releases the interrupting lever 36. As a result, the circuit-breaking coil spring 60 is deenergized (extended) and the on-off switch 10 is opened as shown in FIG. 12.

When a circuit-making operation is initiated by exciting a closing electromagnet 16 in the state shown in FIG. 12, a plunger 17 of the closing electromagnet 16 moves and a trigger lever 158 which is currently in line with the plunger 17 causes a closing trigger 15 to turn counterclockwise about its rotary shaft 25. Then, the closing lever 37 locked by the closing trigger 15 via the closing latch 48 is released, and the closing lever 37 turns clockwise due to an elastic restoring force of the circuit-making coil spring 77.

At this time, the cam 3 connected to the closing lever 37 via the link 41 turns clockwise, and the interrupting lever 36 turns clockwise from its position shown in FIG. 12, thereby closing the on-off switch 10 and energizing the circuit-breaking coil spring 60. Then, the operating apparatus goes into the state shown in FIG. 13 in which the on-off switch 10 is closed, the circuit-breaking coil spring 60 is energized, and the circuit-making coil spring 77 is deenergized. From the state shown in FIG. 13 in which the circuit-making coil spring 77 is deenergized, the circuit-making coil spring 77 is energized (compressed) in a manner similar to what has been described with reference to the first embodiment.

If the circuit-breaking operation is performed from the state shown in FIG. 13, both the circuit-breaking coil spring 60 and the circuit-making coil spring 77 become deenergized. However, the position of the second cam 50 does not change and, from this condition, the circuit-making coil spring 77 is energized and the operating apparatus goes into the state shown in FIGS. 12 and 16, from where the circuit-closing operation of the circuit breaker can be executed.

The operating apparatus for the circuit breaker of the second embodiment constructed as described above exhibits the same operational and working effects as the first embodiment by using the coil springs as energy-storing devices. The operating apparatus for the circuit breaker of the second embodiment employs the coil springs instead of the circuit-making and breaking torsion bars of the first embodiment. Each coil spring fixed at one end and movable at the other end has its own inertial mass (approximately one third of the mass of the coil spring) in addition to its polar moment of inertia. Thus, the coil springs have a lower energy efficiency compared to the torsion bars. However, the coil springs allow a reduction in the size of the energy-storing device and are suited to operating apparatuses for medium to small-sized circuit breakers, for example, which does not require a large amount of energy.

Third Embodiment

Figure 20:
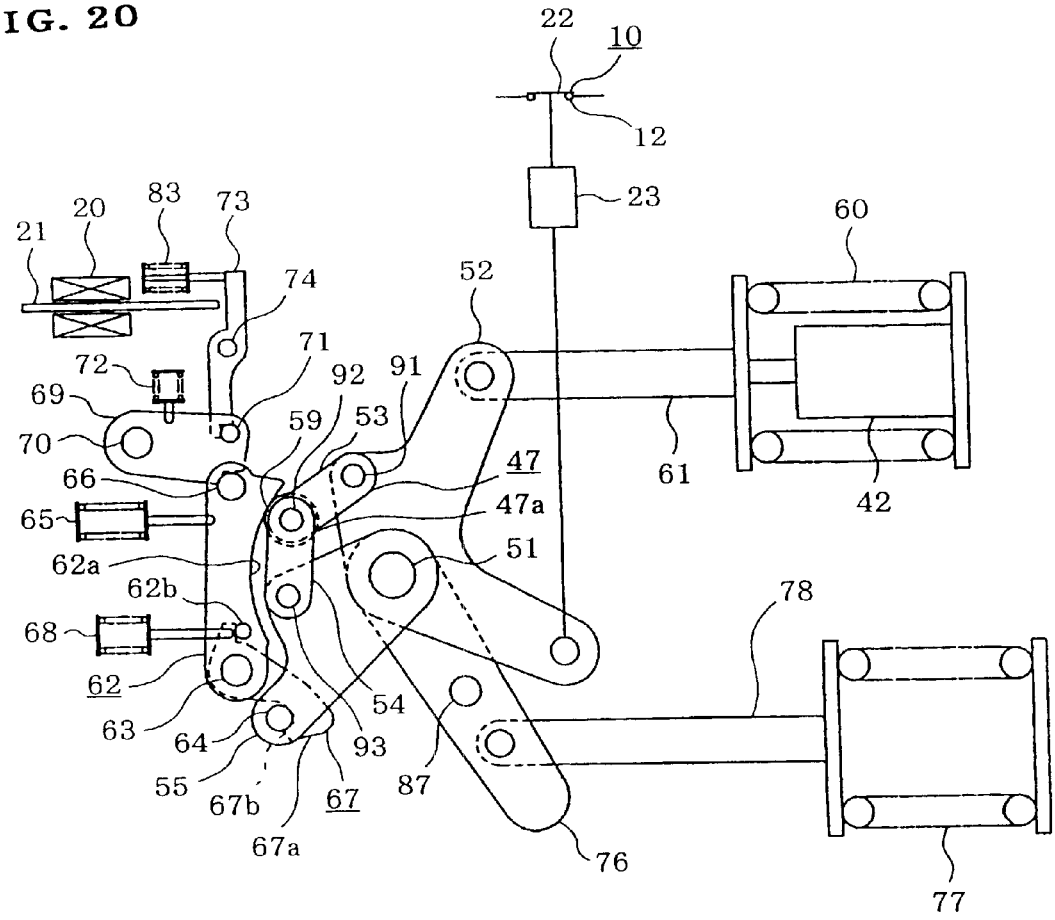
FIG. 20 is a constructional diagram of an operating apparatus for a circuit breaker according to a third embodiment showing a state in which the circuit breaker is closed, a circuit-breaking coil spring and a circuit-making coil spring are both energized.
Figure 21:
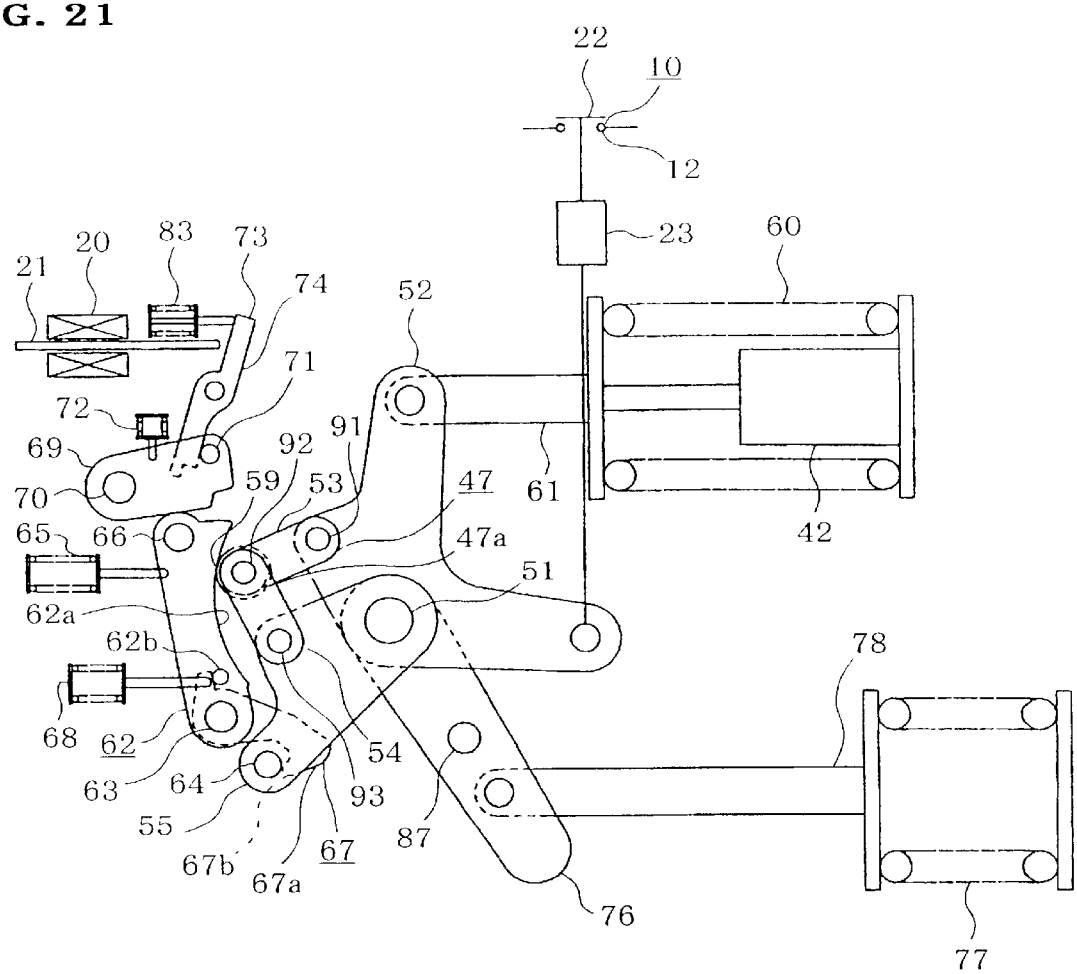
FIG. 21 is a constructional diagram of the operating apparatus for the circuit breaker of the third embodiment showing a state in which a circuit-breaking operation is being executed from the state shown in FIG. 20.
Figure 22:
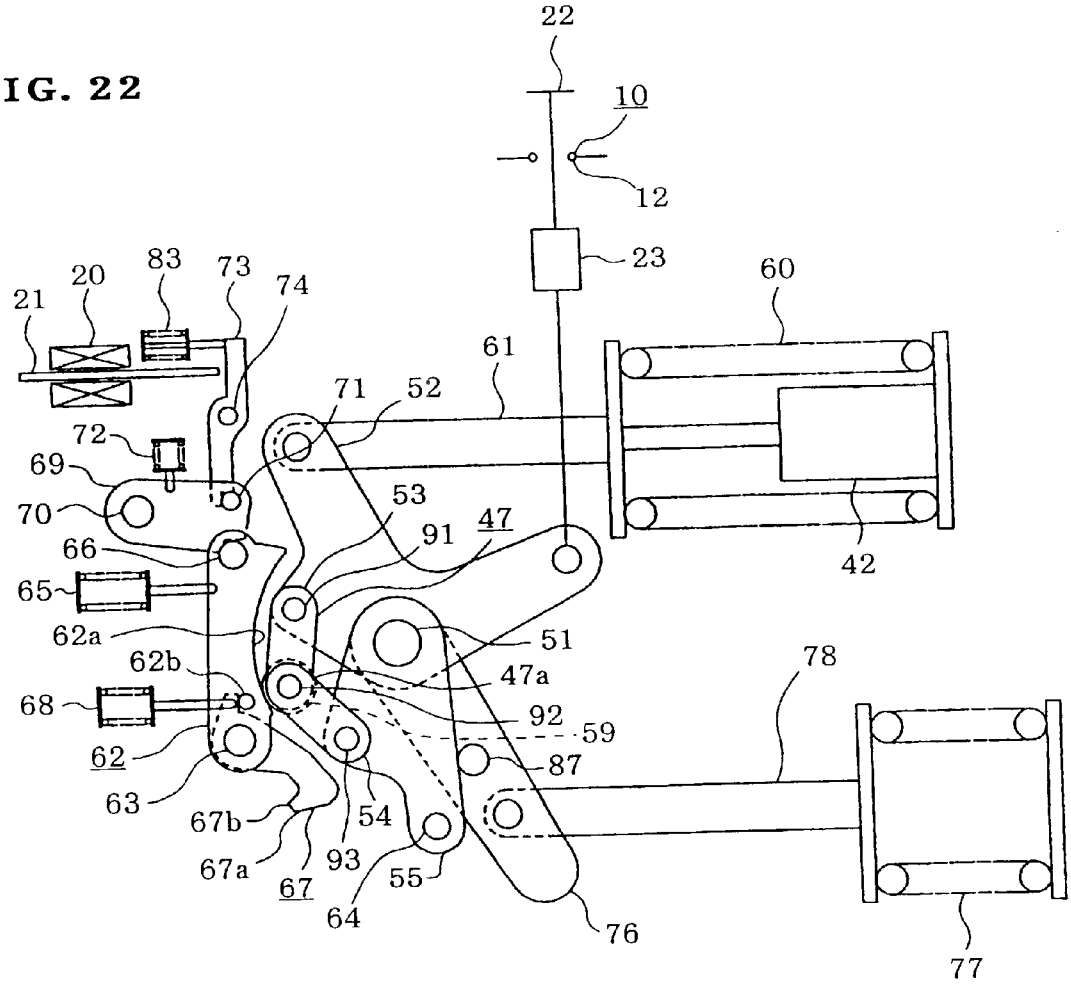
FIG. 22 is a constructional diagram of the operating apparatus for the circuit breaker of the third embodiment showing a state in which the circuit-making coil spring is energized and the circuit-breaking coil spring is deenergized upon completion of the circuit-breaking operation from the state shown in FIG. 21.

FIGS. 20–28 show an operating apparatus for a circuit breaker according to a third embodiment of the invention, in which FIG. 20 is a constructional diagram of the operating apparatus for the circuit breaker of the third embodiment showing a state in which the circuit breaker is closed, a circuit-breaking coil spring 60 and a circuit-making coil spring 77 are both energized. FIG. 21 is a constructional diagram of the operating apparatus for the circuit breaker of the third embodiment showing a state in which a circuit-breaking operation is being executed from the state shown in FIG. 20. FIG. 22 is a constructional diagram of the operating apparatus for the circuit breaker of the third embodiment showing a state in which the circuit-making coil spring 77 is energized and the circuit-breaking coil spring 60 is deenergized upon completion of the circuit-breaking operation from the state shown in FIG. 21.

Figure 23:
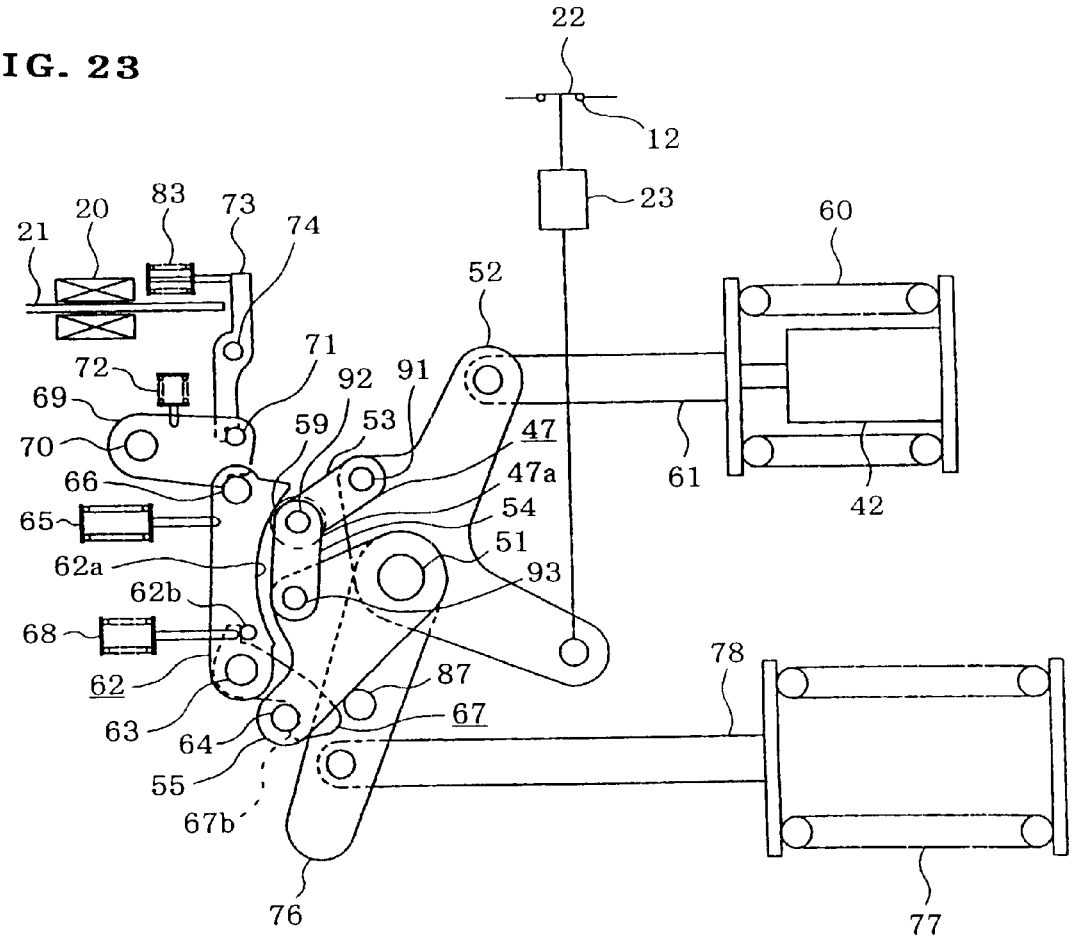
FIG. 23 is a constructional diagram of the operating apparatus for the circuit breaker of the third embodiment showing a state in which the circuit breaker is closed, the circuit-making coil spring is deenergized and the circuit-breaking coil spring is energized.
Figure 24:
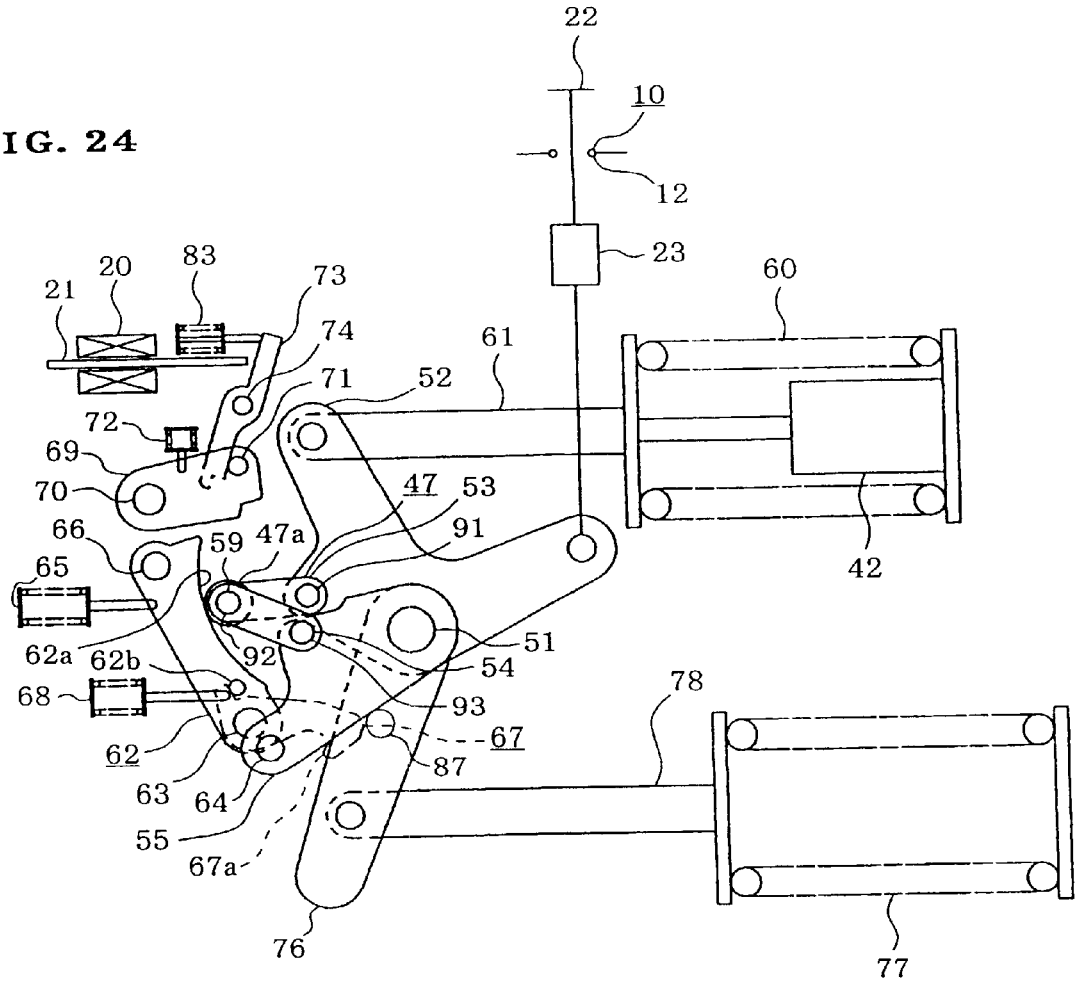
FIG. 24 is a constructional diagram of the operating apparatus for the circuit breaker of the third embodiment showing a state in which the circuit breaker is opened and both the circuit-making coil spring and the circuit-breaking coil spring are deenergized when a second circuit-breaking operation has been finished immediately after a high-speed circuit-remaking operation.

FIG. 23 is a constructional diagram of the operating apparatus for the circuit breaker of the third embodiment showing a state in which the circuit breaker is closed, the circuit-making coil spring 77 is deenergized and the circuit-breaking coil spring 60 is energized. FIG. 24 is a constructional diagram of the operating apparatus for the circuit breaker of the third embodiment showing a state in which the circuit breaker is opened and both the circuit-making coil spring 77 and the circuit-breaking coil spring 60 are deenergized when a second circuit-breaking operation has been finished immediately after a high-speed circuit-remaking operation.

Figure 25:
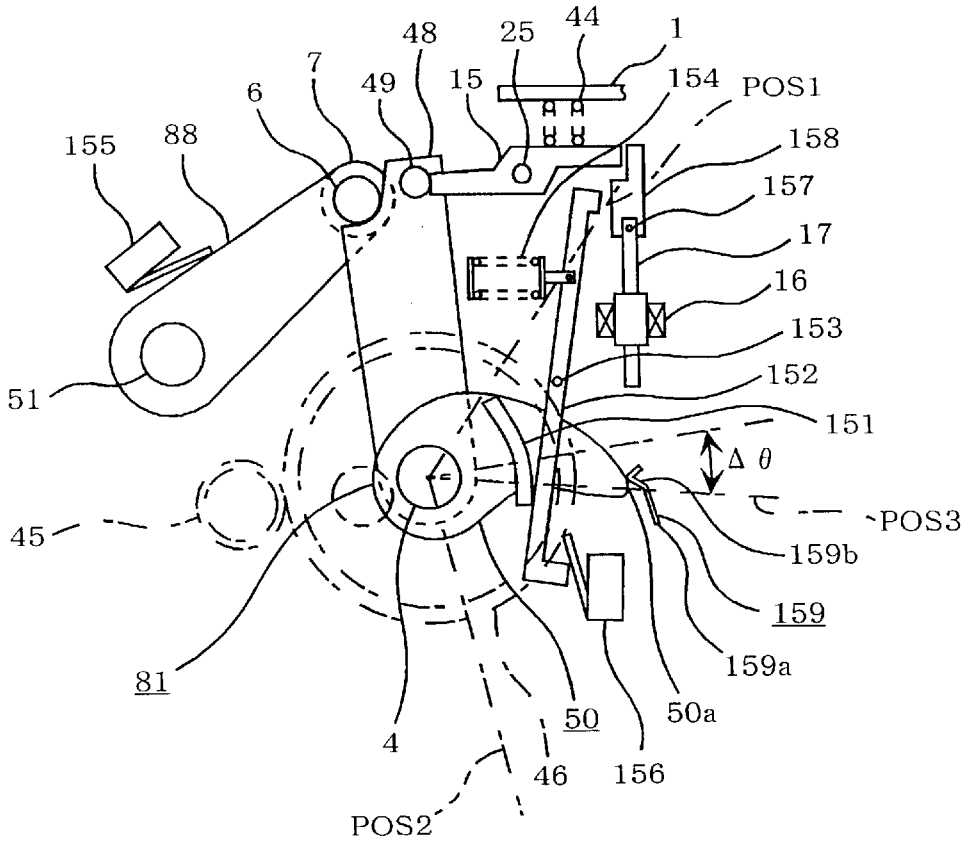
FIG. 25 is a constructional diagram of an energizing mechanism for energizing the circuit-making coil spring of the third embodiment showing a state in which the circuit-making coil spring is energized and a second cam is stationary within a specific angular range of rotation.
Figure 26:
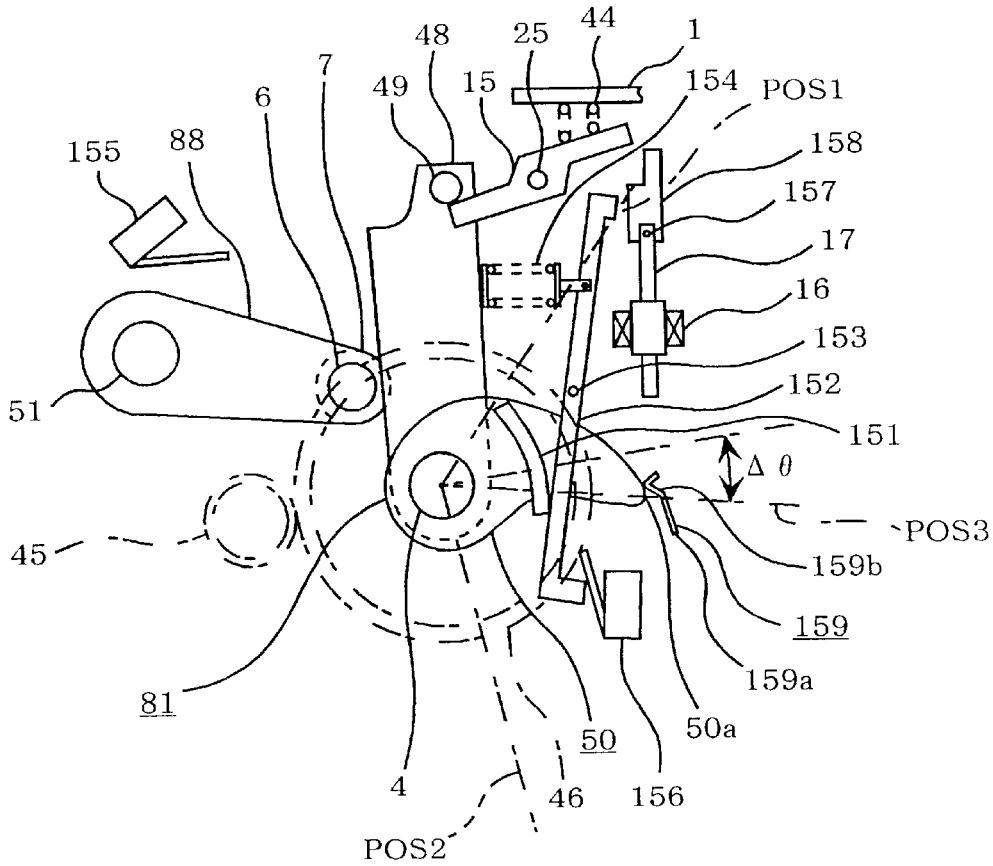
FIG. 26 is a constructional diagram of the energizing mechanism for energizing the circuit-making coil spring of the third embodiment showing a state in which the circuit-making coil spring is deenergized and the second cam is stationary within a specific angular range of rotation.

FIG. 25 is a constructional diagram of an energizing mechanism 81 for energizing the circuit-making coil spring 77 of the third embodiment showing a state in which the circuit-making coil spring 77 is energized and a second cam 50 is stationary within a specific angular range $\Delta\theta$ of rotation. FIG. 26 is a constructional diagram of the energizing mechanism 81 for energizing the circuit-making coil spring 77 of the third embodiment showing a state in which the circuit-making coil spring 77 is deenergized and the second cam 50 is stationary within a specific angular range $\Delta\theta$ of rotation.

Figure 27:
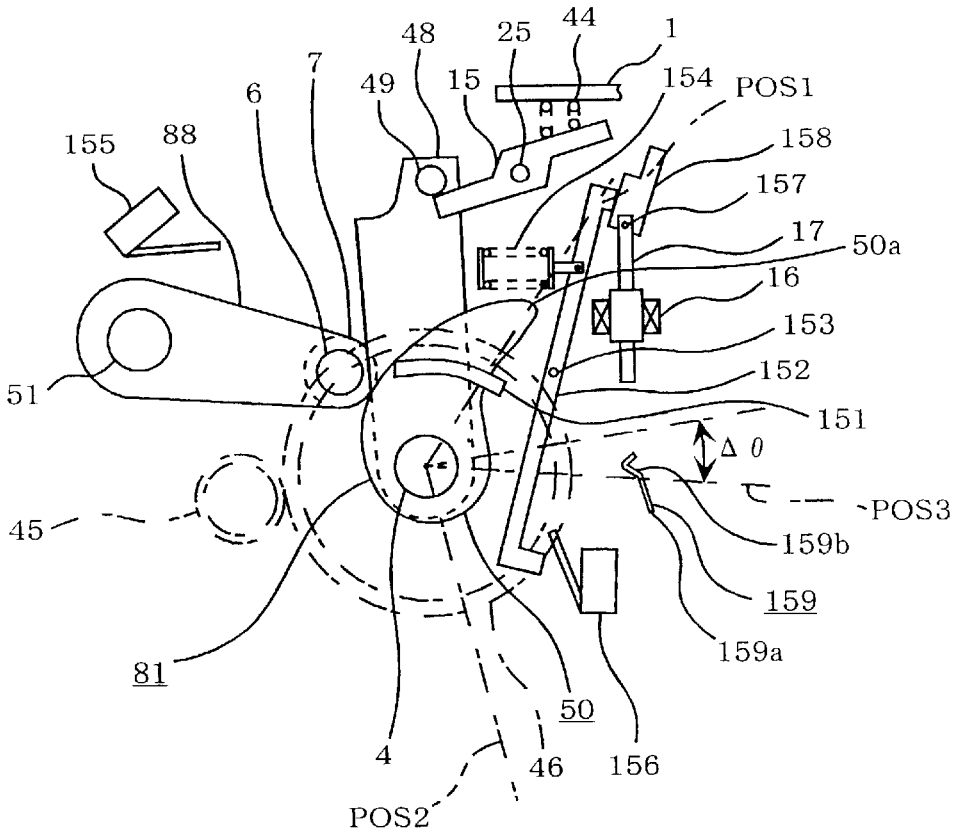
FIG. 27 is a constructional diagram of the energizing mechanism for energizing the circuit-making coil spring of the third embodiment showing a state in which the circuit-making coil spring has begun energizing operation from its deenergized condition shown in FIG. 26, and the second cam has come into contact with a closing lever.
Figure 28:
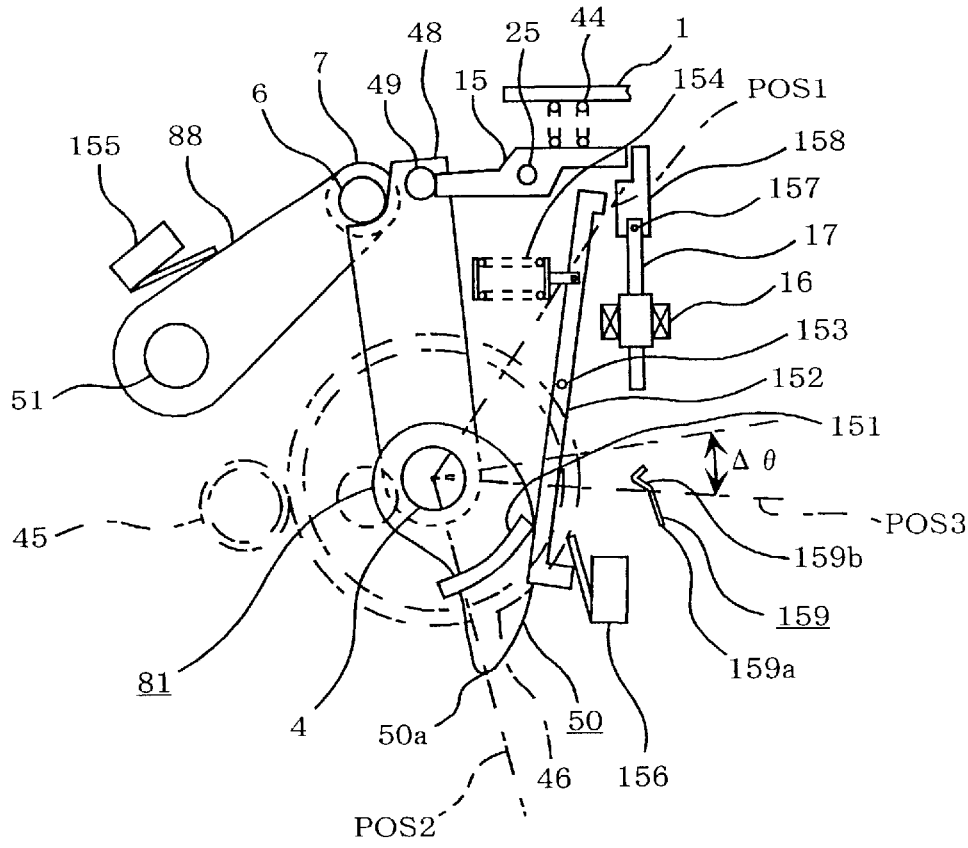
FIG. 28 is a constructional diagram of the energizing mechanism for energizing the circuit-making coil spring of the third embodiment showing a state in which the second cam has further turned and operated a cam switch after energizing the circuit-making coil spring from the state shown in FIG. 27.

FIG. 27 is a constructional diagram of the energizing mechanism 81 for energizing the circuit-making coil spring 77 of the third embodiment showing a state in which the circuit-making coil spring 77 has begun energizing operation from its deenergized condition shown in FIG. 26, and the second cam 50 has come into contact with a closing lever 76. FIG. 28 is a constructional diagram of the energizing mechanism 81 for energizing the circuit-making coil spring 77 of the third embodiment showing a state in which the second cam 50 has further turned and operated a cam switch 156 after energizing the circuit-making coil spring 77 from the state shown in FIG. 27.

Referring to these Figures, designated by the numeral 51 is a main shaft fixed to a housing 1, designated by the numeral 52 is a first interrupting lever mounted rotatably about the main shaft 51, designated by the numeral 53 is a first link, designated by the numeral 54 is second link, and designated by the numeral 55 is a second interrupting lever mounted rotatably about the main shaft 51. Designated by the numeral 91 is a pin connecting the first interrupting lever 52 and the first link 53, and designated by the numeral 92 is a pin connecting the first link 53 and the second link 54.

Designated by the numeral 93 is a pin connecting the second link 54 and the second interrupting lever 55, and designated by the numeral 59 is a rotary member mounted on a common axis with the pin 92. The pin 92 forms a joint 47*a* which allows the first link 53 and the second link 54 to be freely bent and stretched. The first link 53, the second link 54, the pin 92 and the rotary member 59 together constitute a link device 47.

Designated by the numeral 10 is an on-off switch of a main circuit of the circuit breaker. The on-off switch 10 has a stationary contact 12 and a movable contact 22. Designated by the numeral 23 is a link mechanism through which the movable contact 22 is linked to the first interrupting lever 52. Designated by the numeral 42 is a shock absorber, designated by the numeral 60 is the aforementioned circuit-breaking coil spring serving as an energy-storing device for circuit-breaking operation, and designated by the numeral 61 is a rod. The circuit-breaking coil spring 60 and the shock absorber 42 are connected to the first interrupting lever 52 via the rod 61.

Designated by the numeral 62 is a guide having an arc-shaped surface 62*a* serving as a guide surface and a pin 62*b* fixed to the body of the guide 62. The pin 62*b* is arranged such that it can mesh with a later-described second tripping latch 67. Designated by the numeral 63 is a rotary shaft which rotatably supports the guide 62. The center of the arc-shaped surface 62*a* is located on the axis of the main shaft 51 when the guide 62 is locked by a later-described first tripping latch 69. Designated by the numeral 64 is a pin provided on the second interrupting lever 55.

Designated by the numeral 65 is a spring which exerts such a force on the guide 62 that causes it to turn clockwise about the rotary shaft 63. Designated by the numeral 66 is a pin provided on the guide 62. Having a forward inclined surface 67*a* and a corner 67*b*, the second tripping latch 67 is mounted rotatably about the rotary shaft 63 and meshes with the pin 64 provided on the second interrupting lever 55. Designated by the numeral 68 is a spring which exerts such a force on the second tripping latch 67 that causes it to turn clockwise about the rotary shaft 63. The first tripping latch 69 is mounted rotatably about a rotary shaft 70 and meshes with the pin 66.

Designated by the numeral 71 is a pin provided on the first tripping latch 69, designated by the numeral 72 is a spring, designated by the numeral 73 is a tripping trigger, and designated by the numeral 74 is a rotary shaft. The spring 72 exerts such a force on the first tripping latch 69 that causes it to turn clockwise about the rotary shaft 70. The tripping trigger 73 is mounted rotatably about the rotary shaft 74 and meshes with the pin 71. Designated by the numeral 83 is a spring which exerts such a force on the tripping trigger 73 that causes it to turn counterclockwise about the rotary shaft 74. Designated by the numeral 20 is a tripping electromagnet having a plunger 21.

The closing lever 76 is installed rotatably about the main shaft 51. The aforementioned circuit-making coil spring 77 is connected to the closing lever 76 via a rod 78 and exerts such a force on the closing lever 76 that causes it to turn clockwise about the main shaft 51. Designated by the numeral 87 is a pin provided on the closing lever 76. This pin 87 goes into contact with and becomes separated from the second interrupting lever 55 as the closing lever 76 rotates.

Referring to FIG. 25, a later-described lever 88 is mounted rotatably about the main shaft 51 on the front side of the closing lever 76 shown in FIG. 20. This lever 88 is connected to the closing lever 76 in such a manner that they rotate together with each other as a single structure. Since the circuit-breaking coil spring 60 is energized by the circuit-making coil spring 77, the amount of energy stored in the circuit-making coil spring 77 is made larger than the amount of energy stored in the circuit-breaking coil spring 60.

The construction of the energizing mechanism 81 is now described with reference to FIG. 25. As stated above, the lever 88 shown in FIG. 25 and the closing lever 76 shown in FIG. 20 are connected such that they rotate together with each other. A reason why there is provided this separate lever 88 interlocked with the closing lever 76 and the circuit-making coil spring 77 is energized by turning this lever 88 is that this would help prevent a complicated arrangement of constituent elements around the later-described energizing mechanism 81.

As shown in FIG. 25, this embodiment employs the lever 88 instead of the closing lever 37 of the first embodiment shown in FIG. 6. Also, since this embodiment uses a link mechanism formed of the closing lever 76, the link device 47, the second interrupting lever 55 and the guide 62 shown in FIG. 20 to open and close the on-off switch 10 and to energize the circuit-breaking coil spring 60, the cam shaft 2, the cam 3 and the rotary shaft 4 of FIG. 6 are not necessary.

As the operating apparatus of the third embodiment has otherwise the same construction as that of the first embodiment shown in FIG. 6, elements identical or equivalent to those of the first embodiment are designated by the same reference numerals and a description of such elements is omitted here.

The circuit-breaking operation executed from the state in which the circuit breaker is closed, as well as circuit-remaking and circuit-rebreaking operations are described in this order in the following.

FIG. 20 shows the state in which the circuit breaker is closed and the first interrupting lever 52 receives a counterclockwise turning force exerted by the circuit-breaking coil spring 60 which is currently energized. On the other hand, the second interrupting lever 55 is locked in position as the pin 64 meshes with the second tripping latch 67.

Since the first link 53 and the second link 54 receive forces from both the first interrupting lever 52 and the second interrupting lever 55 in this condition, the rotary member 59 provided at the joint 47*a* of the link device 47 produces a force pushing against the arc-shaped surface 62*a* of the guide 62. As a result, a counterclockwise turning force is exerted on the guide 62 forcing to turn counterclockwise about the rotary shaft 63. The guide 62, however, is held in position as the first tripping latch 69 is engaged with the pin 66. The first tripping latch 69 is also held in position as the tripping trigger 73 meshes with the pin 71.

First, the circuit-breaking operation executed from the state of FIG. 20 in which the circuit breaker is closed is described. When the tripping electromagnet 20 is excited by a circuit-breaking command, the plunger 21 moves rightward and causes the tripping trigger 73 to turn clockwise about the rotary shaft 74 overwhelming the force exerted by the spring 83. As a result, the pin 71 is released from the tripping trigger 73 and the first tripping latch 69 turns counterclockwise due to a reaction force exerted by the pin 66 provided on the guide 62. As the first tripping latch 69 turns counterclockwise and becomes separated from the pin 66, the guide 62 whose arc-shaped surface 62*a* is pushed by the rotary member 59 begins to turn counterclockwise overwhelming the force exerted by the spring 65, and the first interrupting lever 52 which receives a torque from the circuit-breaking coil spring 60 begins to turn counterclockwise.

At the same time, the pin 62*b* provided on the guide 62 pushes the second tripping latch 67, causing it to turn counterclockwise overwhelming the force exerted by the spring 68. The second tripping latch 67 then releases the pin 64 provided on the second interrupting lever 55, whereby the second interrupting lever 55 thus far locked begins to be released. Shown in FIG. 21 is the state in which the circuit-breaking operation is currently in progress.

Processes up to the completion of the circuit-breaking operation are now described referring mainly to FIG. 21.

When the pin 64, or the second interrupting lever 55, locked by the second tripping latch 67 is released, the second interrupting lever 55 becomes rotatable. Also, the guide 62 begins to turn clockwise due to the force exerted by the spring 65 and thereby push back the rotary member 59. Since the first interrupting lever 52 continues to turn counterclockwise at this point, the second interrupting lever 55 which has become rotatable begins to turn counterclockwise as well.

The second interrupting lever 55 eventually goes into contact with the pin 87 on the closing lever 76 and halts, and the second interrupting lever 55 and the pin 87 are positioned as illustrated in FIG. 22. Specifically, the first interrupting lever 52 halts upon reaching a specific angular position, and the movable contact 22 of the on-off switch 10 is separated from the stationary contact 12. The circuit-breaking operation is completed as this point.

The guide 62 is forced in a clockwise direction by the spring 65 as mentioned above. Thus, when the second interrupting lever 55 turns counterclockwise, the guide 62 which is held in contact with the rotary member 59 turns clockwise up to a point where the pin 66 meshes with the first tripping latch 69. At this point, the guide 62 goes into contact with a stopper (not shown) and halts. At the same time, the first tripping latch 69 turns clockwise due to the force exerted by the spring 72 and meshes with the pin 66, and the tripping trigger 73 turns counterclockwise due to the force exerted by the spring 83 and meshes with the pin 71. The guide 62 is locked in position in the aforementioned manner. This means that the guide 62 is locked by the first tripping latch 69 upon completion of the circuit-breaking operation. This condition is shown in FIG. 22.

Next, the circuit-making operation is described. FIG. 22 shows the state in which the circuit-making coil spring 77 is energized and the circuit-breaking coil spring 60 is deenergized. In this condition, the closing lever 76 continuously receives a clockwise turning force exerted by the circuit-making coil spring 77 via the rod 78. Since the lever 88 (shown in FIG. 25) which turns together with the closing lever 76 is locked by a closing latch 48 and a closing trigger 15 meshes with a pin 49 provided on the closing latch 48, the circuit-making coil spring 77 is maintained in its energized condition.

When a closing electromagnet 16 is excited by a circuit-making command in the state shown in FIG. 22, its plunger 17 moves upward as illustrated in FIG. 25. As a result, a trigger lever 158 which is currently in line with the plunger 17 causes the closing trigger 15 to turn counterclockwise about its rotary shaft 25 overwhelming a force exerted by a spring 44. Then, the closing trigger 15 is released from the pin 49 and the closing latch 48 turns clockwise due to a reaction force exerted by a pin 6 provided on the lever 88.

When the closing latch 48 turns clockwise, it releases the pin 6 and the lever 88 which receives a torque from the circuit-making coil spring 77 begins to turn clockwise together with the closing lever 76 which is connected to the lever 88. At this time, the pin 87 provided on the closing lever 76 pushes the second interrupting lever 55, causing it to begin turning clockwise.

Since the guide 62 is locked by the first tripping latch 69 and the rotary member 59 moves while rotating in contact with the arc-shaped surface 62*a* of the guide 62, the guide 62 can only move along an arc drawn around the main shaft 51. Thus, the second link 54, the rotary member 59, the first link 53 and the first interrupting lever 52 turn clockwise as a whole about the main shaft 51 as the second interrupting lever 55 turns clockwise, and as a consequence, the movable contact 22 of the on-off switch 10 is moved in its circuit-making direction. At the same time, the circuit-breaking coil spring 60 connected to the first interrupting lever 52 is compressed and energized.

The second interrupting lever 55 continues to turn clockwise, the pin 64 provided on the second interrupting lever 55 goes into contact with the forward inclined surface 67*a* of the second tripping latch 67, causing the second tripping latch 67 to turn counterclockwise. When the pin 64 goes over the corner 67*b* of the second tripping latch 67, the second tripping latch 67 turns clockwise due to the force exerted by the spring 68 and meshes with the pin 64. On the other hand, the first interrupting lever 52 pushed by the pin 87 provided on the closing lever 76 reaches the aforementioned specific angular position, whereby the circuit-making operation and storage of elastic restoring energy in the circuit-breaking coil spring 60 are finished. This condition is shown in FIG. 23.

Even if the closing lever 76 is turned counterclockwise and the pin 87 becomes separated from the second interrupting lever 55 while the circuit-making coil spring 77 is being energized, the circuit-breaking coil spring 60 is maintained in its energized condition because the second tripping latch 67 meshes with the pin 64.

The circuit-rebreaking operation is now described in the following. If the tripping electromagnet 20 is excited by a circuit-breaking command in the state shown in FIG. 23 in which the circuit breaker is closed, the plunger 21 moves rightward and causes the tripping trigger 73 to turn clockwise about the rotary shaft 74 overwhelming the force exerted by the spring 83. When the tripping trigger 73 turns clockwise in this way, the pin 71 is released from the tripping trigger 73 and the first tripping latch 69 turns counterclockwise due to the reaction force exerted by the pin 66 provided on the guide 62.

As the first tripping latch 69 turns counterclockwise and becomes separated from the pin 66, the guide 62 whose arc-shaped surface 62*a* is pushed by the rotary member 59 begins to turn counterclockwise overwhelming the force exerted by the spring 65. When the guide 62 begins to turn counterclockwise, the rotary member 59 is no longer supported by the guide 62. As a result, the first interrupting lever 52 which receives the torque from the circuit-breaking coil spring 60 begins to turn counterclockwise, and the movable contact 22 of the on-off switch 10 is caused to move in a circuit-breaking direction.

At the same time, the pin 62*b* provided on the guide 62 pushes the second tripping latch 67, causing it to turn counterclockwise overwhelming the force exerted by the spring 68, and the second tripping latch 67 releases the pin 64 provided on the second interrupting lever 55. The second interrupting lever 55 becomes rotatable when the pin 64 is released from the second tripping latch 67. Unlike the earlier-described case where the circuit breaker is opened from a condition in which the circuit-making coil spring 77 is energized, however, the second interrupting lever 55 remains stationary without turning because the second interrupting lever 55 is in contact with the pin 87 provided on the closing lever 76.

Since the first interrupting lever 52 turns counterclockwise, the joint 47*a* of the link device 47 connecting the first and second interrupting lever 52, 55 turns, and the first interrupting lever 52 eventually goes into contact with the pin 93 and halts. At this point, the movable contact 22 of the on-off switch 10 is completely separated from the stationary contact 12 and the circuit-rebreaking operation is finished. This condition is shown in FIG. 24.

Strictly speaking, the torque exerted by the circuit-making coil spring 77 is sustained by an unillustrated stopper incorporated in the shock absorber 42 via the closing lever 76, second interrupting lever 55, the link device 47, the first interrupting lever 52, etc. Therefore, when the first tripping latch 69 unlocks the pin 66 and the guide 62 begins to turn counterclockwise leaving the rotary member 59 unsupported by the guide 62, the second interrupting lever 55 is pushed back slightly clockwise due to an elastic restoring force of the circuit-making coil spring 77 exerted via the pin 87 before the second interrupting lever 55 halts. Since the first interrupting lever 52 turns counterclockwise in this condition, the joint 47*a* of the link device 47 swings and the first interrupting lever 52 goes into contact with the pin 93 and halts.

Subsequently, the circuit-making coil spring 77 is energized by the energizing mechanism 81 shown in FIG. 25. Compared to the energizing mechanism 31 of the first embodiment shown in FIG. 6 in which the closing lever 37 is driven by the second cam 50, operation of the energizing mechanism 81 differs in that the lever 88 is driven by the second cam 50. The energizing mechanism 81 has otherwise the same operational and working effects as the energizing mechanism 31.

In this embodiment, the circuit-making coil spring 77 is energized by the energizing mechanism 81 from the state shown in FIG. 23 or 24 in which the circuit-making coil spring 77 is deenergized (extended) and the second cam 50 of the energizing mechanism 81 is stationary within the specific angular range $\Delta\theta$ of rotation shown in FIG. 26. When the second cam 50 turns counterclockwise from its position shown in FIG. 26 and an outermost point 50*a* (farthest from a rotary shaft 4) of the second cam 50 reaches a first angular position POS1 as shown in FIG. 27, the second cam 50 goes into contact with a second rotary member 7 which is provided on the lever 88. The second cam 50 further turns counterclockwise and energizes (compresses) the circuit-making coil spring 77.

When the second cam 50 further turns counterclockwise and its outermost point 50*a* reaches a second angular position POS2 as shown in FIG. 28, a projecting part 151 provided on the second cam 50 pushes against a lever 152 and, as a consequence, power supply to an electric motor (not shown) is interrupted in the same manner as described earlier with reference to the first embodiment. The electric motor continues to run due to inertia of its rotor. When the outermost point 50*a* of the second cam 50 reaches a third angular position POS3 as shown in FIG. 25, a peripheral surface of the second cam 50 goes into firm contact with an elastic brake member 159. As the elastic brake member 159 brakes the second cam 50 at this point, its outermost point 50*a* halts within the aforementioned specific angular range $\Delta\theta$ of rotation shown in FIG. 25.

When the circuit-making coil spring 77 is energized from the state shown in FIG. 23, the operating apparatus goes into a state in which the circuit breaker is closed and the circuit-breaking coil spring 60 and the circuit-making coil spring 77 are both energized as shown in FIG. 20, and the outermost point 50*a* of the second cam 50 is halted within the specific angular range $\Delta\theta$ of rotation. When the circuit-making coil spring 77 is energized from the state shown in FIG. 24, the operating apparatus goes into a state in which the circuit breaker is opened, the circuit-breaking coil spring 60 is deenergized and the circuit-making coil spring 77 is energized as shown in FIG. 22, and the outermost point 50*a* of the second cam 50 is halted within the specific angular range $\Delta\theta$ of rotation. Since the trigger lever 158 can go into contact with the closing trigger 15 and push it in this condition, it is now possible to perform the circuit-making operation.

In the operating apparatus of the third embodiment thus constructed, the guide 62 is already locked by the first tripping latch 69 prior to the beginning of the circuit-making operation. Therefore, it is not necessary to wait until shocks due to reaction forces caused by engagement of the guide 62 and the first tripping latch 69 as well as of the first tripping latch 69 and the tripping trigger 73 diminish and disappear. Rather, it is possible to initiate the circuit-rebreaking operation immediately upon completion of the circuit-making operation and improve operational performance of the circuit breaker. The energizing mechanism 81 of the third embodiment is thus applicable to the operating apparatus of the aforementioned type.

The energizing mechanism 81 shown in FIG. 25 is applicable not only to the operating apparatus of the third embodiment but also to that of the first or second embodiment if the lever 88 and the closing lever 76 which rotate together with each other as a single structure about the main shaft 51 are provided.

Fourth Embodiment

Figure 29:
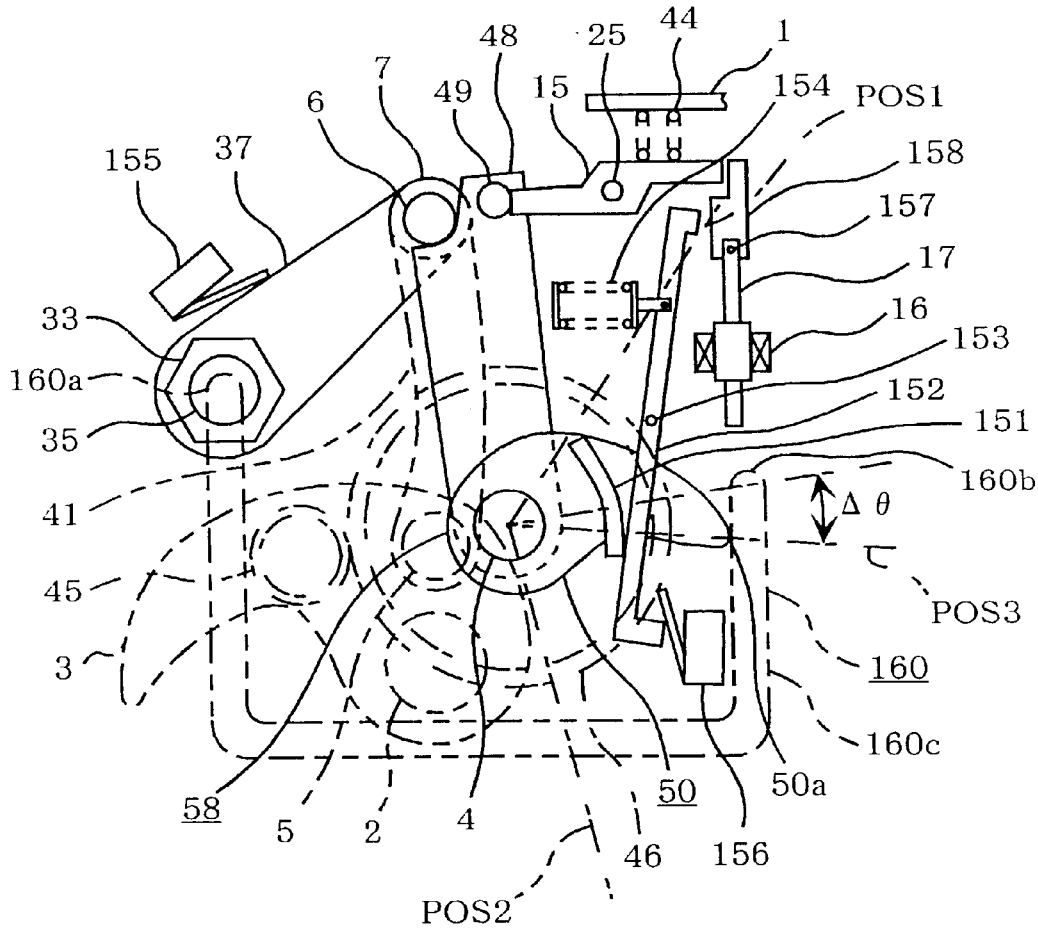
FIG. 29 is a constructional diagram of an energizing mechanism for energizing circuit-making torsion bars according to a fourth embodiment of the invention, the energizing mechanism being intended for use with the operating apparatus for the circuit breaker of FIG. 1.
Figure 30:
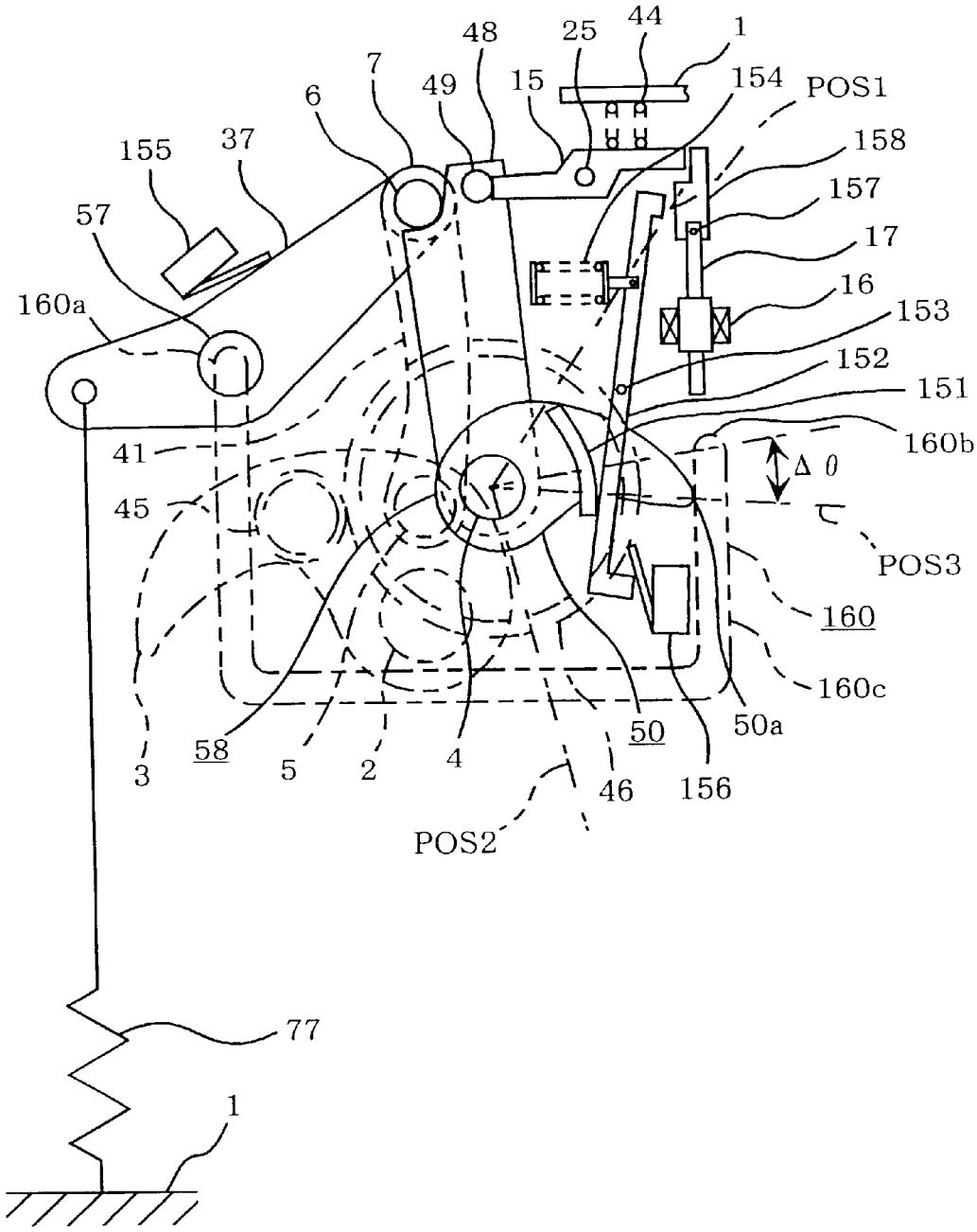
FIG. 30 is a constructional diagram of an energizing mechanism for energizing a circuit-making coil spring according to a variation of the fourth embodiment, the energizing mechanism being intended for use with the operating apparatus for the circuit breaker of FIG. 11.
Figure 31:
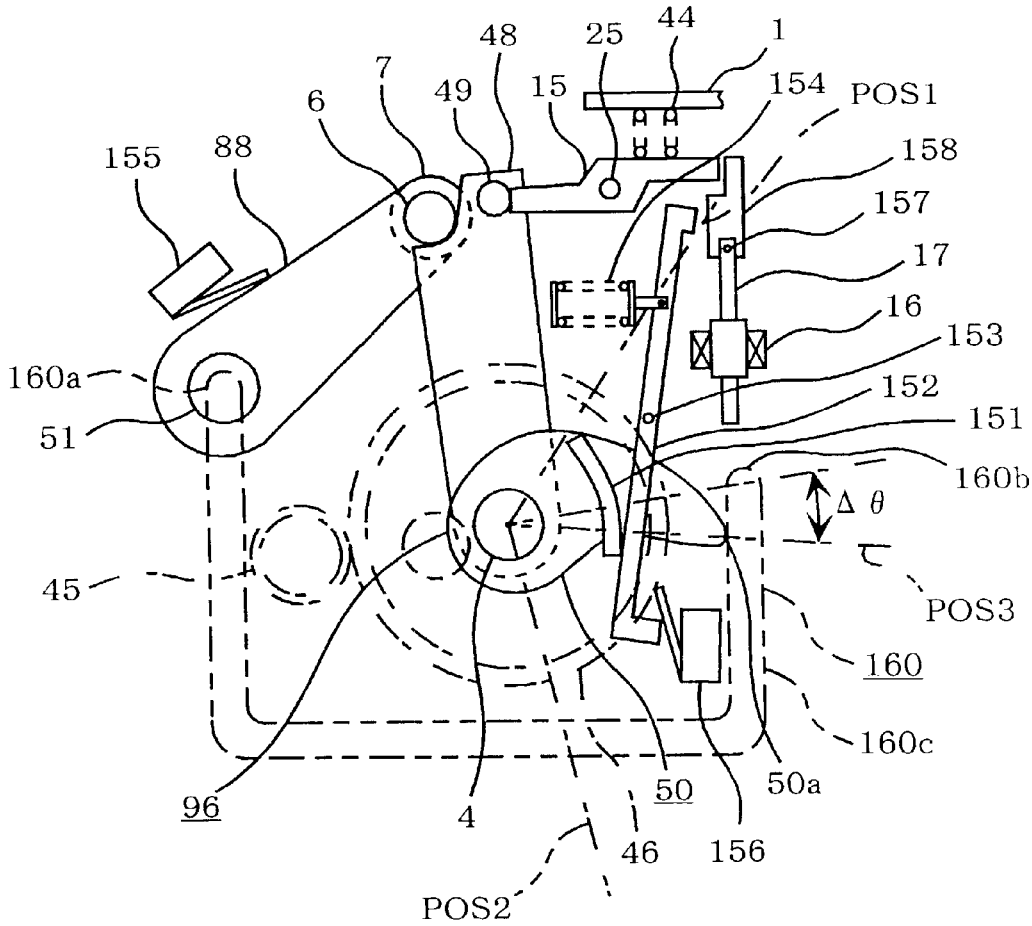
FIG. 31 is a constructional diagram of an energizing mechanism for energizing a circuit-making coil spring according to another variation of the fourth embodiment, the energizing mechanism being intended for use with the operating apparatus for the circuit breaker of FIG. 20.
Figure 32:
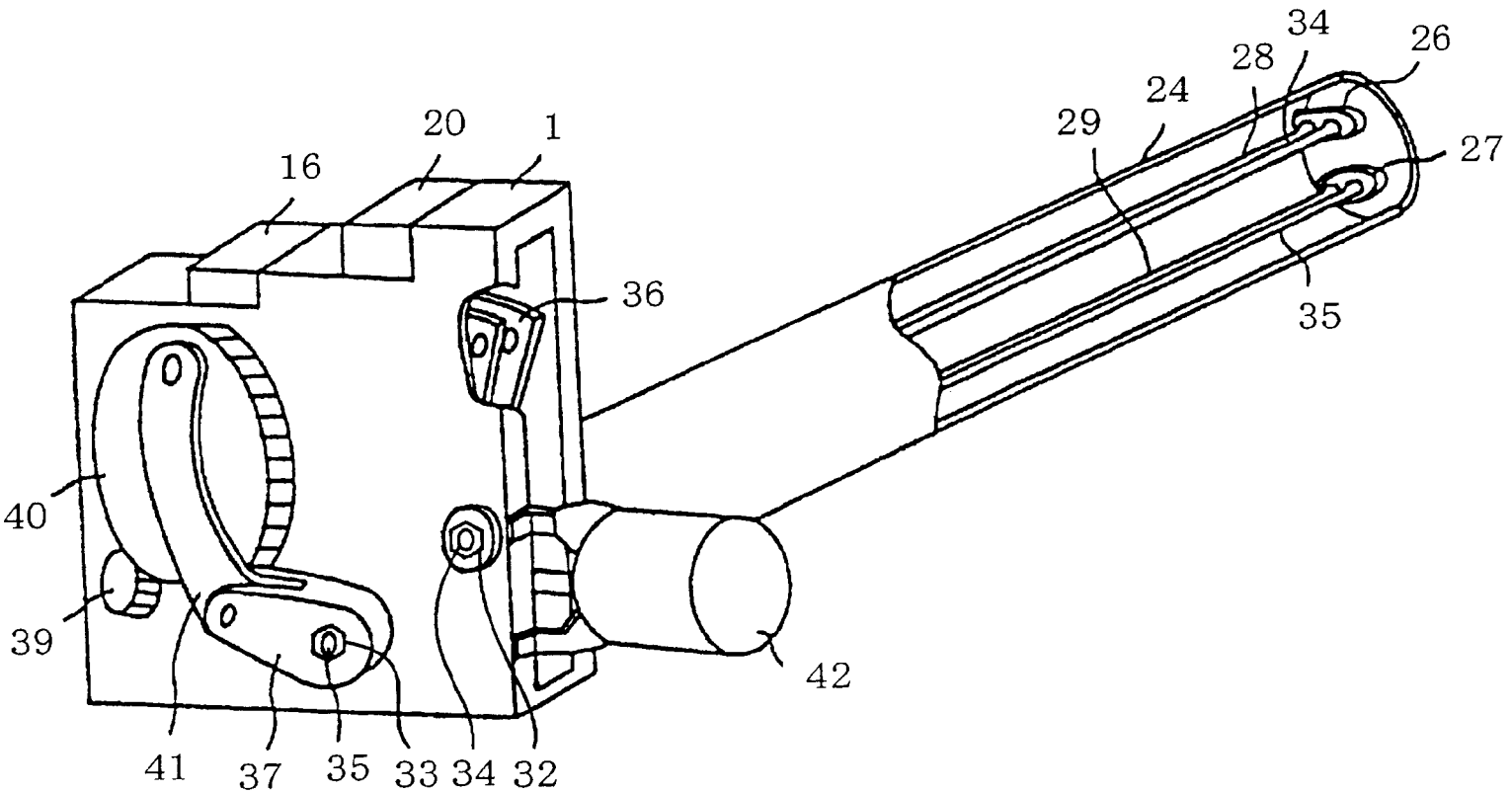
FIG. 32 is a perspective view generally showing the construction of a conventional operating apparatus for a circuit breaker.
Figure 33:
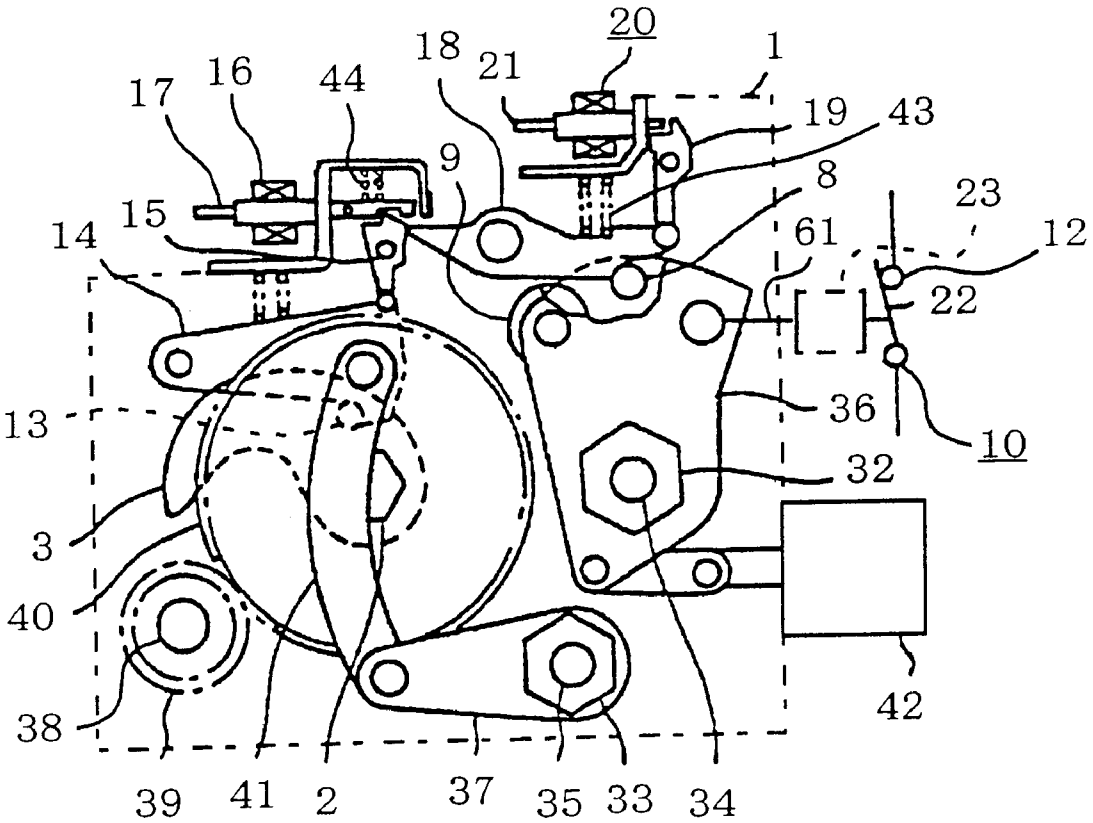
FIG. 33 is a constructional diagram of the conventional operating apparatus for the circuit breaker of FIG. 32 showing a state in which the circuit breaker is closed and torsion bars for making and breaking a circuit are all energized.
Figure 34:
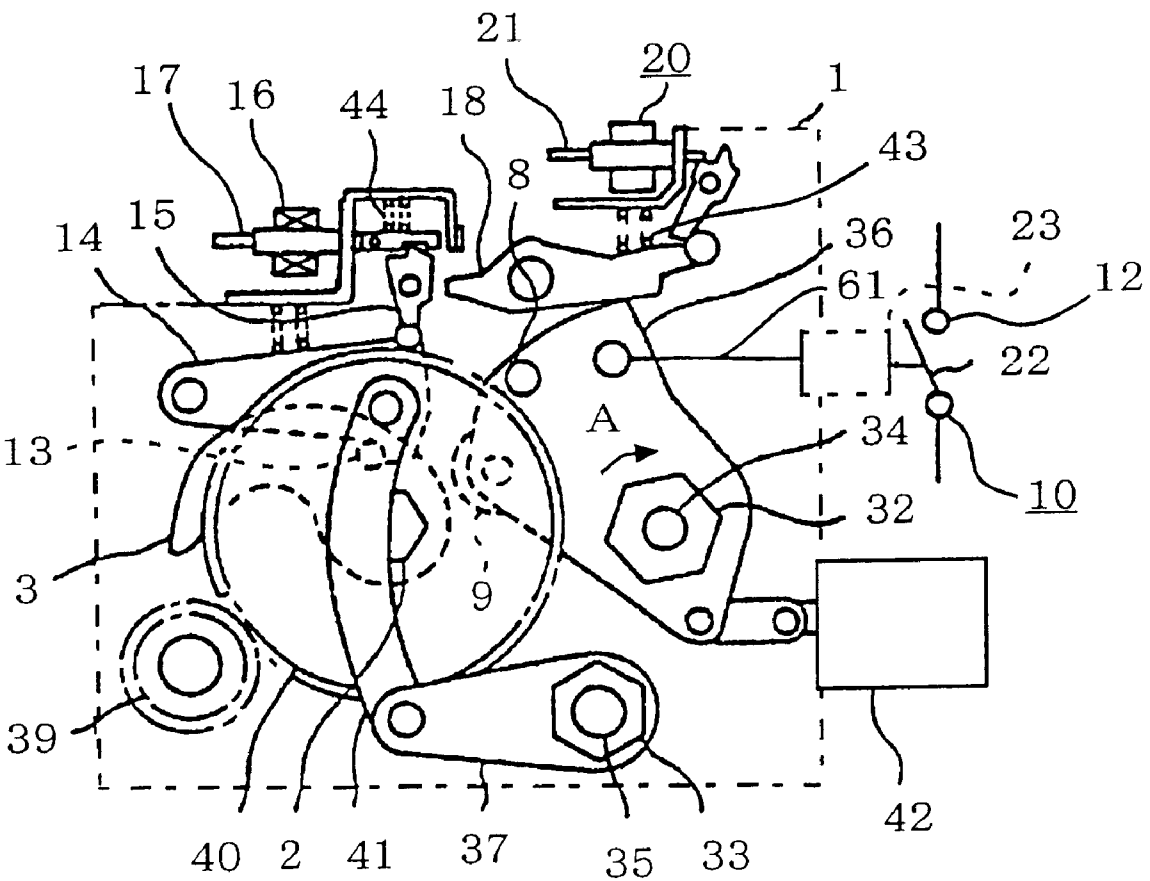
FIG. 34 is a constructional diagram of the conventional operating apparatus for the circuit breaker of FIG. 32 showing a state in which the circuit breaker is opened, the circuit-breaking torsion bars are deenergized, or released, and the circuit-making torsion bars are energized.
Figure 35:
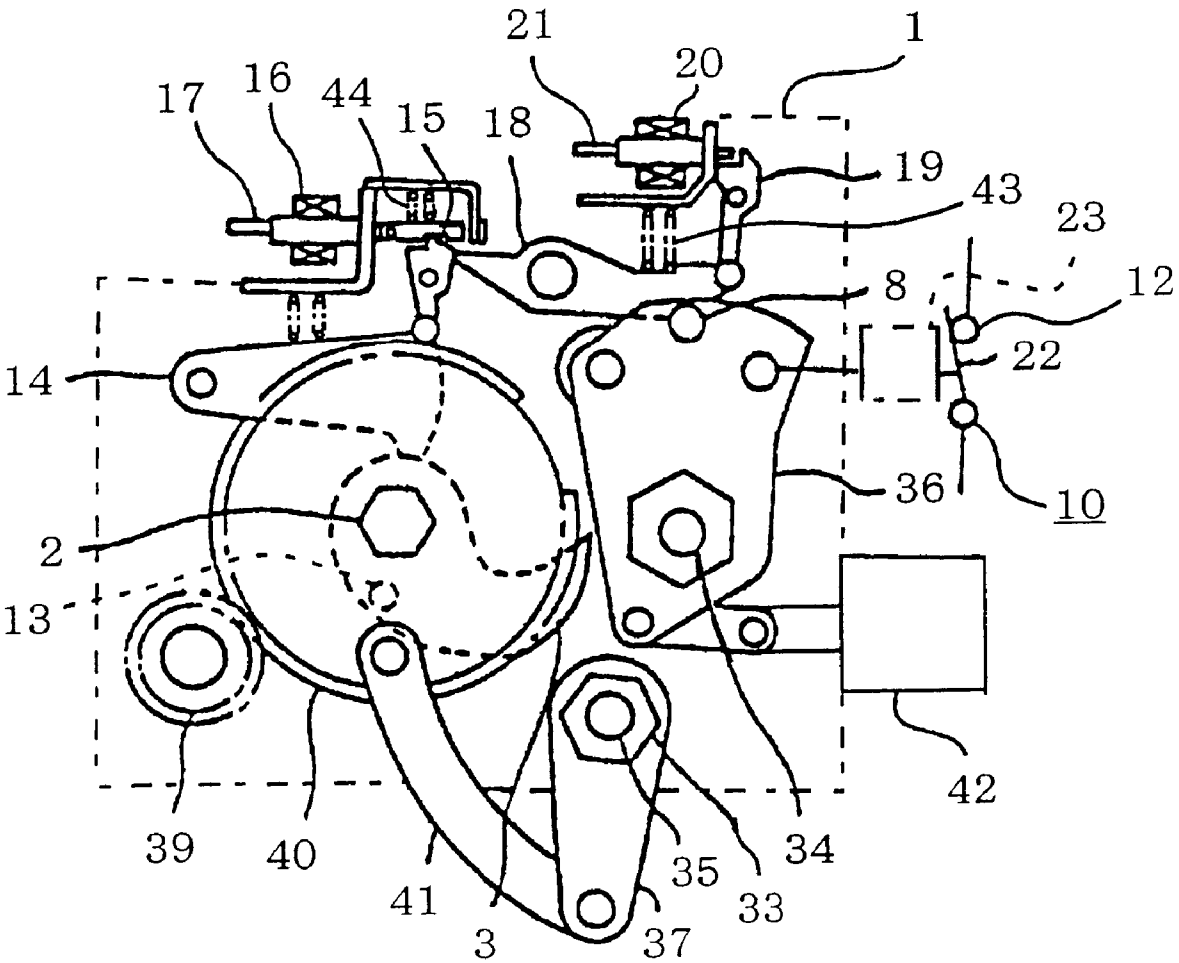
FIG. 35 is a constructional diagram of the conventional operating apparatus for the circuit breaker of FIG. 32 showing a state in which the circuit breaker is closed, the circuit-breaking torsion bars are energized and the circuit-making torsion bars are deenergized.
Figure 36:
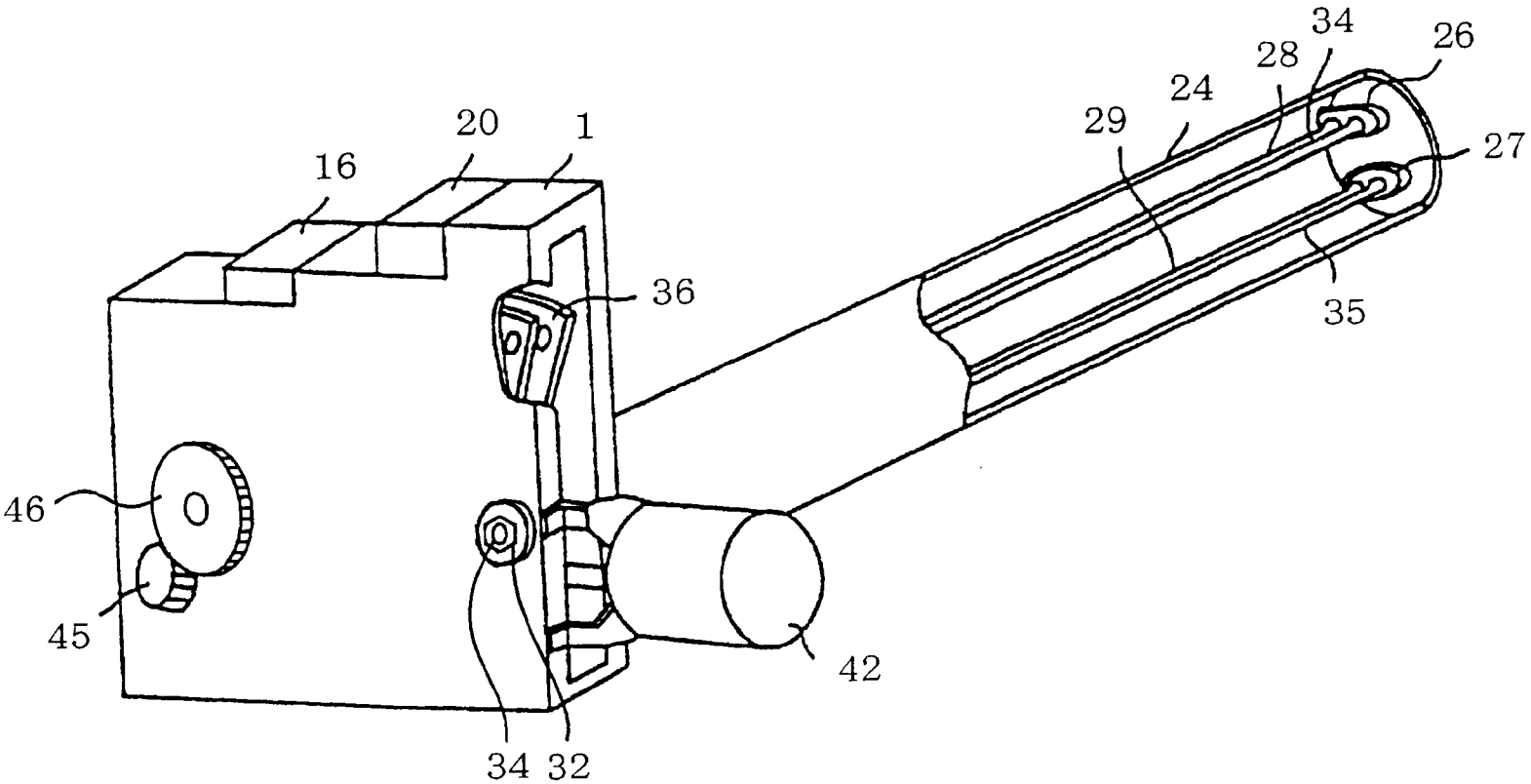
FIG. 36 is a perspective view generally showing the construction of another conventional operating apparatus for a circuit breaker in which elastic restoring energy is stored by using a cam.
Figure 37:
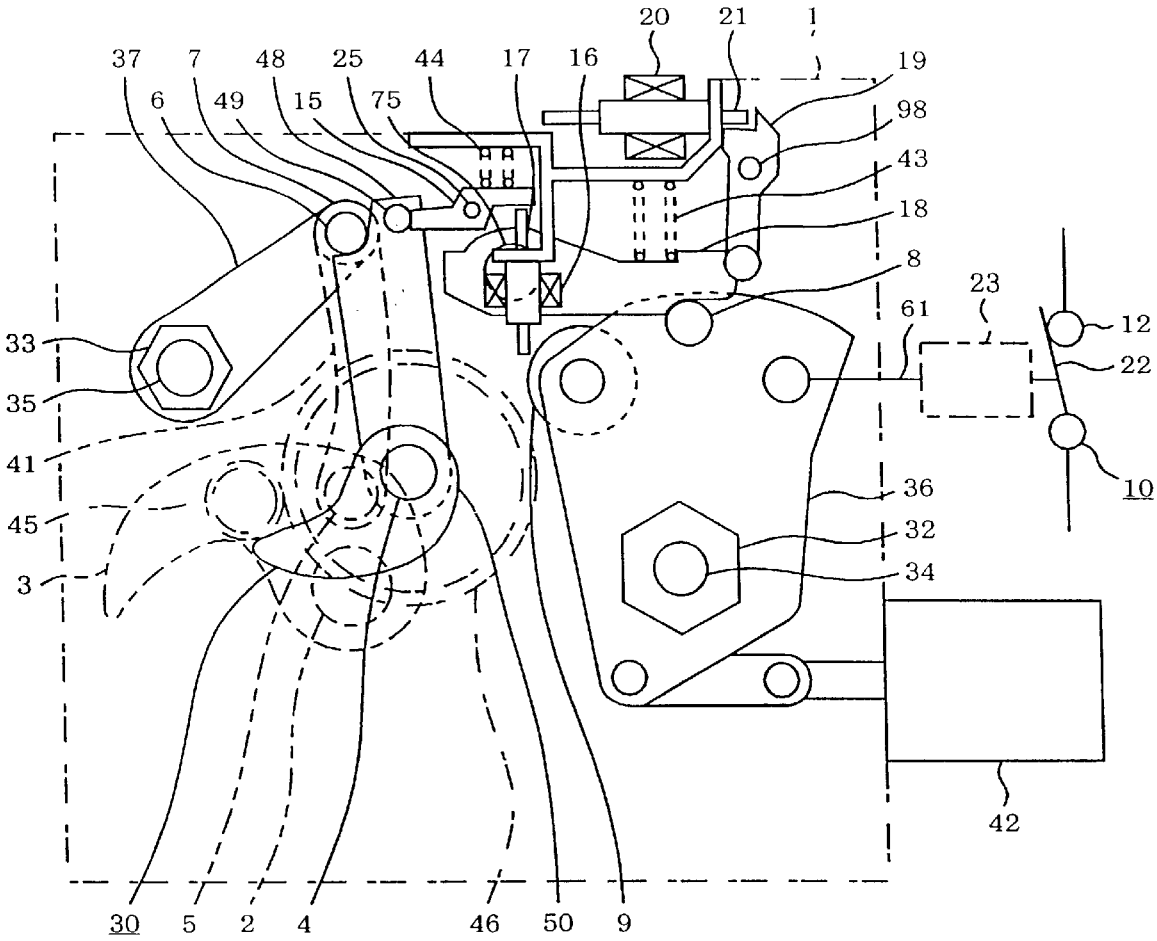
FIG. 37 is a constructional diagram of the operating apparatus for the circuit breaker of FIG. 36 showing a state in which the circuit breaker is closed and torsion bars for making and breaking a circuit are all energized.
Figure 38:
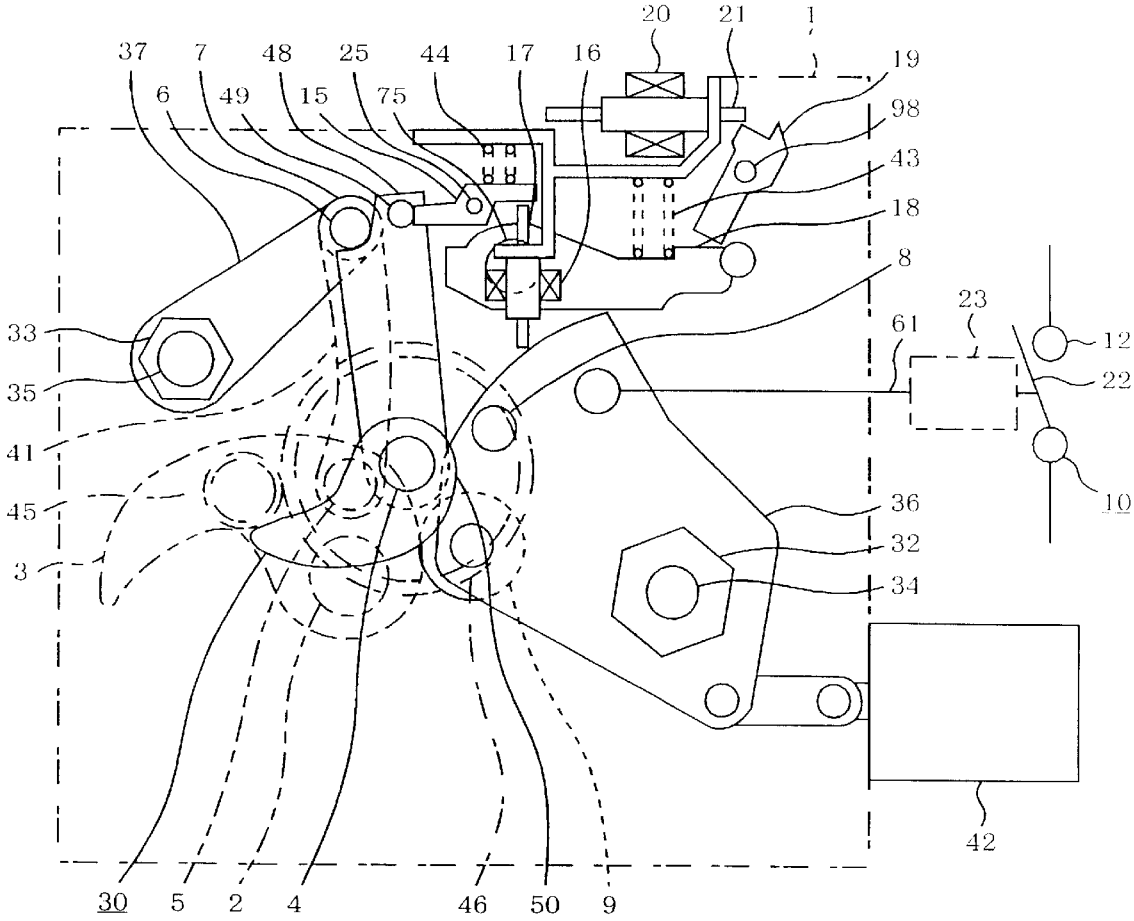
FIG. 38 is a constructional diagram of the operating apparatus for the circuit breaker of FIG. 36 showing a state in which the circuit breaker is opened, the circuit-breaking torsion bars are deenergized, or released, and the circuit-making torsion bars are energized.
Figure 39:
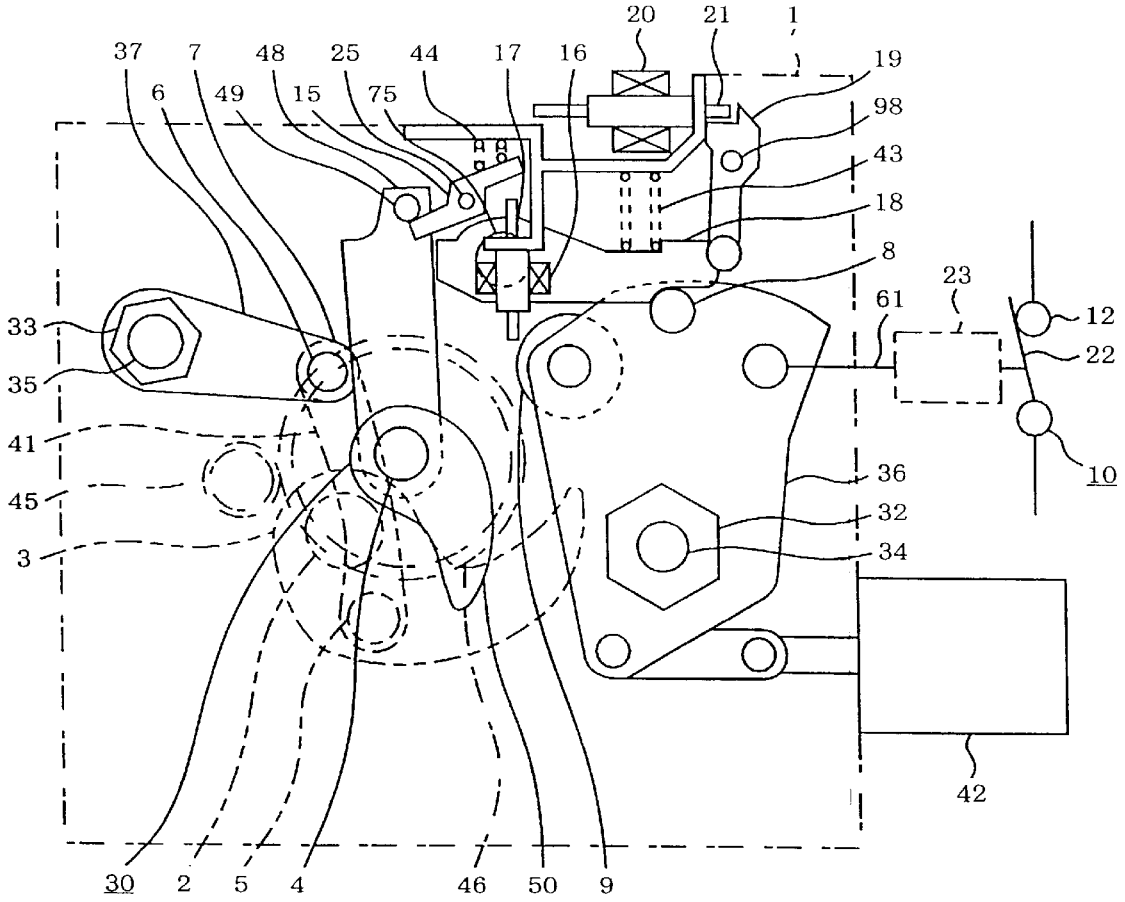
FIG. 39 is a constructional diagram of the operating apparatus for the circuit breaker of FIG. 36 showing a state in which the circuit breaker is closed, the circuit-breaking torsion bars are energized and the circuit-making torsion bars are deenergized.

FIGS. 29–31 show a fourth embodiment of the invention and variations thereof. Specifically, FIG. 29 is a constructional diagram of an energizing mechanism 58 for energizing circuit-making torsion bars 29, 35, the energizing mechanism 58 being intended for use with the operating apparatus for the circuit breaker of FIG. 1. Shown in FIG. 29 is a state in which the circuit-making torsion bars 29, 35 are energized and a second cam 50 is stationary within a specific angular range $\Delta\theta$ of rotation.

FIG. 30 is a constructional diagram of an energizing mechanism 58 for energizing a circuit-making coil spring 77 according to a variation of the fourth embodiment, the energizing mechanism 58 being intended for use with the operating apparatus for the circuit breaker of FIG. 11. Shown in FIG. 30 is a state in which the circuit-making coil spring 77 is energized and a second cam 50 is stationary within a specific angular range $\Delta\theta$ of rotation.

FIG. 31 is a constructional diagram of an energizing mechanism 96 for energizing a circuit-making coil spring 77 according to another variation of the fourth embodiment, the energizing mechanism 96 being intended for use with the operating apparatus for the circuit breaker of FIG. 20. Shown in FIG. 31 is a state in which the circuit-making coil spring 77 is energized and a second cam 50 is stationary within a specific angular range $\Delta\theta$ of rotation.

Referring to FIGS. 29–31, designated by the numeral 160 is a lever serving as a braking device. Made of a rodlike member, the lever 160 has a U-shaped portion 160*c*, a supporting portion 160*a* bent and extending rearward from one end of the U-shaped portion 160*c* in a direction perpendicular to the plane of the paper, and a braking portion 160*b* bent and extending rearward from the other end of the U-shaped portion 160*c* in a direction perpendicular to the plane of the paper. In FIGS. 29–31, the lever 160 is shown by alternate long and two short dashed lines for the sake of simplification.

In the energizing mechanism 58 of FIG. 29 for energizing the circuit-making torsion bars 29, 35, the lever 160 is fixed to a closing lever 37 in such a manner that they turn together with each other with the supporting portion 160*a* of the lever 160 disposed on a common axis with a rotary shaft 33 which also turns together with the closing lever 37. When the closing lever 37 is locked by a closing latch 48, the braking portion 160*b* is positioned such that it goes into contact with an outermost point 50*a* of the second cam 50 and can brake the second cam 50 as shown in FIG. 29.

When the circuit-making torsion bars 29, 35 are deenergized and the closing lever 37 is located at the position shown in FIG. 3, the lever 160 is located at a position turned clockwise by a specific angle from its position shown in FIG. 29, because the lever 160 and the closing lever 37 turn together with each other.

Operation of the energizing mechanism 58 of FIG. 29 is now described in the following. When the circuit-making torsion bars 29, 35 are energized, the closing lever 37 is at the position shown in FIGS. 3 and 7. The second cam 50 turns counterclockwise from this condition. When the outermost point 50*a* of the second cam 50 reaches the aforementioned first angular position POS1, it goes into contact with a second rotary member 7 provided on the closing lever 37. As the electric motor continues to run, the closing lever 37 pushed by the second cam 50 turns counterclockwise and the outermost point 50*a* of the second cam 50 passes the aforementioned specific angular position of rotation.

When the outermost point 50*a* of the second cam 50 passes the specific angular position of rotation, the closing lever 37 is locked by the closing latch 48 and the circuit-making torsion bars 29, 35 are held in their energized condition. At the same time, the closing lever 37 pushes against the lever switch 155 and opens it. The electric motor still continues to run. When the second cam 50 has turned by a first specific angle from the first angular position POS1 and its outermost point 50*a* has reached the aforementioned second angular position POS2, a projecting part 151 fixed to the second cam 50 comes into contact with a lever 152, causing it to turn counterclockwise. As a result, a cam switch 156 is opened and power supply to the electric motor is interrupted.

The electric motor still continues to run due to inertia of its rotor. When the second cam 50 has turned by a second specific angle from the second angular position POS2 and its outermost point 50*a* has reached the aforementioned third angular position POS3, a peripheral surface of the second cam 50 goes into firm contact with the braking portion 160*b* of the lever 160, whereby the second cam 50 is braked and its outermost point 50*a* halts within the aforementioned specific angular range $\Delta\theta$ of rotation shown in FIG. 29.

The circuit-making torsion bars 29, 35 are energized from a condition in which they are deenergized, the closing lever 37 is at the position shown in FIGS. 3 and the lever 160 is separated from the second cam 50. Thus, the electric motor does not receive any resisting force from the lever 160 and can begin energizing operation.

FIG. 30 shows one variation of the fourth embodiment in which the energizing mechanism 58 is used for energizing the circuit-making coil spring 77, and the lever 160 is fixed to a closing lever 37 in such a manner that they turn together with each other with the supporting portion 160*a* of the lever 160 disposed on a common axis with a rotary shaft 57. When the closing lever 37 is locked by a closing latch 48, the braking portion 160*b* is positioned such that it goes into contact with an outermost point 50*a* of the second cam 50 and can brake the second cam 50 as shown in FIG. 30. The construction and operation of this energizing mechanism 58 are otherwise the same as that of FIG. 29.

FIG. 31 shows another variation of the fourth embodiment in which the energizing mechanism 96 energizes the circuit-making coil spring 77 via a lever 88 provided separately from a closing lever 37. Compared to the energizing mechanism 58 shown in FIGS. 29 and 30 in which the second cam 50 drives the closing lever 76, the second cam 50 drives the lever 88 in the energizing mechanism 96 of FIG. 31. The construction and operation of the energizing mechanism 96 are otherwise the energizing mechanism 58 as that of FIG. 29.

According to the aforementioned fourth embodiment and variations thereof, the lever 160 is separated from the second cam 50 when executing the energizing operation. Therefore, the electric motor can begin the energizing operation without receiving any resisting force from the lever 160.

Although the cam switch 156 is operated by the second cam 50 via the lever 152 in the foregoing embodiments, there may be provided a lever which is fixed to the rotary shaft 4 and rotates together with the rotary shaft 4 to operate the cam switch 156 instead of the second cam 50. Also, the energy-storing devices are not limited to the aforementioned torsion bars or coil springs but may be other elastic members, such as pneumatic springs, rubber members or a combination of a tank storing compressed air and pneumatic cylinders connected to the tank. Furthermore, the on-off switch 10 may be replaced by a disconnector or a load-break switch, which produces the same operational effects.

What is claimed is:

1. An operating apparatus for a switchgear comprising:

an on-off switch driver including a rotatably mounted energizing lever linked to an on-off switch of the switchgear and an energy-storing device linked to the energizing lever;

a retaining device including a locking lever; and an energizing mechanism including a cam turned by an electric motor in a specific direction, a current interrupter and a braking device;

wherein the cam of said energizing mechanism turning in said specific direction begins to maintain contact with the energizing lever at a first angular position, turns the energizing lever in an energizing direction to energize the energy-storing device, causes the locking lever of said retaining device to lock the energizing lever such that the energizing lever remains in the energized condition without turning opposite to the energizing direction, and becomes separated from the energizing lever by further turning in said specific direction, the current interrupter is actuated and interrupts an electric current supplied to the electric motor when the cam reaches a second angular position after turning by a first specific angle from the first angular position, and the braking device brakes the cam when the cam reaches a third angular position after turning by a second specific angle from the second angular position due to inertial turning of the electric motor, whereby the cam stops within a specific angular range of rotation.

2. The operating apparatus for the switchgear according to claim 1, wherein said retaining device further includes an energizing lever deactivator which prohibits the locking lever from unlocking the energizing lever when an orientation of the cam is out of the specific angular range of rotation.

3. The operating apparatus for the switchgear according to claim 2, wherein the locking lever is rotatably mounted and maintains the energizing lever in the energized condition when locked by a rotatably mounted closing trigger, the energizing lever is unlocked when the locking lever locked by the closing trigger is released by turning the closing trigger by a swingable member swingably connected to a plunger of an electromagnet, and the energizing lever deactivator includes an operating member which causes the swingable member to swing when pushed by the cam and thereby prevents the closing trigger from turning even when the plunger moves.

4. The operating apparatus for the switchgear according to claim 1, wherein said energizing mechanism further includes an electric motor deactivator which prohibits the electric motor from operating when the energizing lever is locked by the locking lever.

5. The operating apparatus for the switchgear according to claim 4, wherein the electric motor deactivator is a lever switch operated by the energizing lever when the energizing lever is locked by the locking lever.

6. The operating apparatus for the switchgear according to claim 1, wherein said retaining device further includes an energizing lever deactivator which prohibits the locking lever from unlocking the energizing lever when an orientation of the cam is out of the specific angular range of rotation, and said energizing mechanism further includes an electric motor deactivator which prohibits the electric motor from operating when the energizing lever is locked by the locking lever.

7. The operating apparatus for the switchgear according to claim 1, wherein the braking device is an elastic member having a specific elasticity which elastically deforms and slides over the cam to brake it when the rotating cam reaches the third angular position and pushes the braking device.

8. The operating apparatus for the switchgear according to claim 1, wherein the braking device is a leverlike member joined to the energizing lever, and wherein the leverlike member is located at a position where it can go into contact with the cam and brake it when the rotating cam reaches the third angular position while the energizing lever is locked by the locking lever, and the leverlike member is located at a position where it does not go into contact with the cam when the energizing lever is released from the locking lever.

9. The operating apparatus for the switchgear according to claim 1, wherein the energizing lever of said on-off switch driver includes a first lever section which is connected to the energy-storing device and a second lever section which is connected to the first lever section and turned by the cam.

10. The operating apparatus for the switchgear according to claim 1, wherein the energy-storing device is a torsion bar which is connected to the energizing lever and elastically deforms when twisted by the energizing lever.

11. The operating apparatus for the switchgear according to claim 1, wherein the energy-storing device is a coil spring which is connected to the energizing lever and elastically deforms when compressed or extended by the energizing lever.

12. The operating apparatus for the switchgear according to claim 1, wherein the cam has a cam surface which produces a generally constant torque applied to the electric motor when the energy-storing device is energized by turning the energizing lever.

13. The operating apparatus for the switchgear according to claim 1, wherein said switchgear is a circuit breaker.

* * * * *